US005341196A

United States Patent [19]

Hodoshima et al.

[11] Patent Number: 5,341,196

[45] Date of Patent: Aug. 23, 1994

[54] IMAGE FORMING EQUIPMENT USING A TONER CARTRIDGE

[75] Inventors: Takashi Hodoshima, Kawasaki; Kouji Ishigaki, Yokohama; Kazuyuki Nakahara, Tokyo; Fumio Kishi, Yokohama, all of Japan

[73] Assignee: Ricoh Company, Ltd., Tokyo, Japan

[21] Appl. No.: 781,574

[22] Filed: Oct. 23, 1991

[30] Foreign Application Priority Data

Oct. 24, 1990 [JP] Japan ..... 2-286417
Oct. 24, 1990 [JP] Japan ..... 2-286418
Oct. 25, 1990 [JP] Japan ..... 2-288055

[51] Int. Cl.[5] ..... G03G 15/06

[52] U.S. Cl. ..... 355/260; 141/364; 220/359; 222/DIG. 1; 355/206; 355/208

[58] Field of Search ..... 355/208, 260, 215, 245, 355/205, 206; 222/DIG. 1; 141/98, 363, 364, 365, 366; 220/359

[56] References Cited

U.S. PATENT DOCUMENTS 3,599,682 8/1971 Altmann ..... 141/106
4,963,938 10/1990 Sonoda et al. ..... 355/260
4,967,234 10/1990 Tani et al. ..... 355/260
5,055,881 10/1991 Fukuchi ..... 355/260

FOREIGN PATENT DOCUMENTS 1922208 11/1969 Fed. Rep. of Germany .
3937198 5/1990 Fed. Rep. of Germany .

*Primary Examiner*—Leo P. Picard
*Assistant Examiner*—Christopher Horgan
*Attorney, Agent, or Firm*—Oblon, Spivak, McClelland, Maier & Neustadt

[57] ABSTRACT

Image forming equipment of the type supplying a toner to a developing device thereof by using a cartridge which is filled with a toner. The cartridge has a sealed opening and is brought to a toner supply position in the equipment without having the opening unsealed by the operator. Even when the cartridge is pulled out during the loading operation, the toner is not scattered about. A new cartridge for replacing a used empty cartridge is brought to the toner supply position without requiring the operator to remove the empty toner. During the replacement, the toner remaining on the walls of the empty cartridge is prevented from being sprinkled.

36 Claims, 56 Drawing Sheets

50
53
GA3
52
GA2
51
GA1
GA5
GA4
55
54
RAM
58
ADM
57
56
CLOCK GENERA-TOR
20
READ CONT-ROL CCT
45
A/D
44
40
43
10
EVEN
ODD
42
CCD
41
30
31
32
33

START
DOOR OPEN SENSOR BUILDUP SIGNAL ?
1
NO
YES
RESET JAM TIMER
6
SET INSERT FLAG
7
DOOR OPEN SENSOR ON ?
2
NO
YES
RESET JAM FLAG
3
SENSOR 130 ON ?
8
YES
NO
TURN OFF JAM INDICATOR
4
JAM TIMER > T6 ?
9
NO
YES
RET
RESET RETRY COUNTER
5
RETRY COUNTER ≥ 3 ?
10
YES
NO
RET

START
INSERT FLAG SET ?
1
NO
YES
RET
SENSOR 130 RISE SIGNAL ?
2
NO
YES
RESET JAM TIMER
3
SENSOR 130 ON ?
4
NO
YES
JAM TIMER > T7 ?
5
NO
YES
RET
SENSOR 130 FALL SIGNAL ?
6
NO
YES
SENSOR 119 OFF ?
7
NO
YES
RETRY COUNTER ≥ 3 ?
9
YES
NO
RET

| Fig. 47A | Fig. 47B |
|---|---|

| Fig. 53A |
| --- |
| Fig. 53B |

IMAGE FORMING EQUIPMENT USING A TONER CARTRIDGE

BACKGROUND OF THE INVENTION

The present invention relates to electrophotographic or electrostatic image forming equipment such as a copier, facsimile apparatus or printer and, more particularly, to image forming equipment of the type supplying a toner to a developing apparatus thereof by using a toner cartridge filled with a toner.

Image forming equipment of the type described has a developing device or unit which is loaded with a toner for developing a latent image electrostatically formed on an image carrier. A prerequisite with such equipment is that every time the toner is consumed to a predetermined degree, a supplementary amount of toner be fed to the developing unit. Conventional toner supply systems may generally be classified into two types, i.e., a system of the type directly supplying a to a toner hopper or similar supply section and a system of the type supplying a toner from a toner cartridge which is removably located at a toner supply position above the opening of a toner hopper. Today, the cartridge type system is predominant over the directly supply system because the latter is apt to cause the toner to scatter about to smear not only the equipment but also the operator's hands and cloths during the supply.

Even the cartridge type system has a problem left unsolved, as follows. When the amount of toner remaining in the developing unit decreases beyond a predetermined amount, the operator is expeted to unseal a new toner cartridge and substitute it for the toner cartridge existing in the equipment. When the operator strips a seal member from an opening which is formed in the new cartridge for supplying a toner, the toner deposited on the seal member is apt to sprinkle to smear the equipment and the operator's hands and cloths. To eliminate this problem, it has been proposed to dispose unsealing means in the toner supply position such that when a toner cartridge is inserted toward the toner supply position, the unsealing means contacts and cuts the seal member, as disclosed in, for example, Japanese Patent Laid-Open Publication No. 188182/1988 and Japanese Utility Mode Laid-Open Publication No. 122363/1988.

The above prior art unsealing scheme starts unsealing a cartridge as soon as the cartridge is inserted toward the toner supply position. This brings about a problem that when the operator interrupts the insertion of a cartridge noticing that the cartridge is not the one containing a desired color or having a proper size or that the orientation thereof is not correct, the seal of the cartridge has already been partly stripped. Should such a partly unsealed cartridge be pulled out from the equipment, the toner contained therein would be sprinkled to the inside and outside of the equipment. Moreover, the seal member cut by the unsealing section has the portions thereof adjoining the edges of the cartridge bent into the cartridge. The toner, therefore, remains between the bent portions of the seal member and the walls of the cartrige and is simply wasted.

Another problem with the conventional cartridge type system is that the operator has to replace the used toner cartridge with new one by removing the used cartridge by hand. Then, the toner adhered to the inner walls of the used cartridge is apt to contaminate the equipment and the hands and cloths by being sprinkled to the inside and outside of the equipment. In light of this, there has been proposed a toner supply system using a plurality of cartridges each having a particular size, as taught in, for example, Japanese Patent Laid-Open Publication No. 188171/1988. When one of the plurality of cartridges is to be located at the toner supply position of the developing unit, it is fitted in the preceding cartridge which is empty. In this manner, the cartridges sequentially brought to the toner supply position are each fitted in the preceding empty cartridge in a laminate core configuration. This allows the operator to supply a fresh toner to the developing unit without pulling out the empty cartridge.

However, the problem with the toner supply system using a plurality of cartridges as mentioned above is that when a new cartridge is forced into the empty cartridge remaining in the toner supply position, it generates a stream of air with the result that the toner remaining in the empty cartridge is scattered about to the inside and outside of the equipment. The empty cartridges in a laminate core configuration have to be removed from the equipment while sliding on members which define the toner supply position. Such an operation is troublesome. Moreover, it is likely that the toner adhered to the outermost empty cartridge is splinked. A mechanism for aligning an opening where a cartridge should be located and the opening of a toner hopper and a mechanism for preventing a toner from being sprinkled into the equipment via the hopper opening are densely arranged at the toner supply position. This forces the operator to take greatest care when inserting a cartridge to the toner supply position. Further, the operator has to locate a cartridge at the toner supply position accurately with the greatest care. In addition, the stack of empty cartridges have to be pulled out from the toner supply position via the limited space therearound.

SUMMARY OF THE INVENTION

It is, therefore an object of the present invention to provide image forming equipment which allows the operator to place a toner cartridge at a toner supply position of the equipment without requiring the operator to unseal it and prevents a toner contained in the cartridge from being sprinkled even when the operator pulls it out during the course of loading.

It is another object of the present invention to provide image forming equipment which allows the operator to place a toner cartridge at the toner supply position of the equipment without unsealing it and allows a minimum of toner to remain on the cartridge around the unsealed portion of the latter after the toner supply.

It is another object of the present invention to provide image forming equipment which allows the operator to supply a toner to the equipment without removing an empty toner from the toner supply position of the equipment and prevents the toner remaining on empty cartridges from being sprinkled.

It is another object of the present invention to provide image forming equipment which promotes the ease of insertion and removal of a toner cartridge from the toner supply position of the equipment.

In accordance with the present invention, image forming equipment of the type supplying a toner to a developing device thereof by using a cartridge which contains the toner therein and has an openable wall portion comprises a cartridge inserting section for inserting the cartridge into the equipment, a toner supplying section independent of the cartridge inserting section and having a toner supply position where the cartridge supplies the toner, and opening means for opening the openable wall portion.

Also, in accordance with the present invention, image forming equipment of the type supplying a toner to a developing device thereof by using a cartridge which contains a toner therein and has an opening for releasing the toner and a seal member for sealing the opening comprises a cartridge inserting section for inserting the cartridge, a toner supplying section independent of the cartridge inserting section and having a toner supply section where the cartridge supplies the toner, and unsealing means for removing the seal member from the cartridge.

Further, in accordance with the present invention, a cartridge filled with a toner and removably mounted on image forming equipment for supplying the toner to the equipment comprises an opening for releasing the toner, a seal member for sealing the opening, and unsealing means for removing the seal member from the cartridge.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
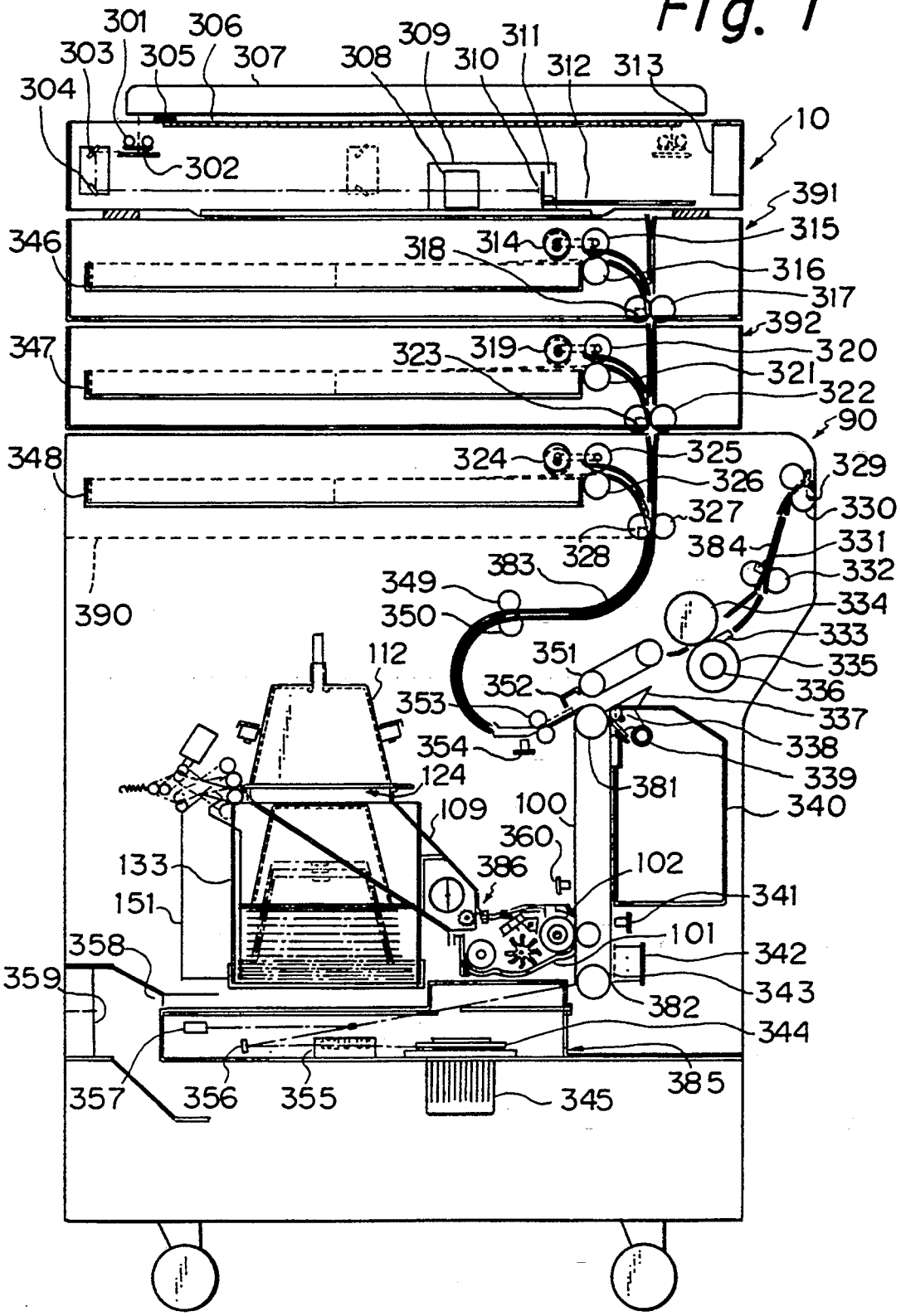
FIG. 1 is a front view of image forming equipment embodying the present invention and implemented as a digital copier.

Referring to FIG. 1 of the drawings, image forming equipment embodying the present invention is shown and implemented as a digital copier by way of example. As shown, the digital copier is generally made up of a document reading device (scanner) 10, and a copying device (printer) 90 which executes a sequence of steps for reproducing document information read on a recording medium.

Figures 2, 2A, 2B:
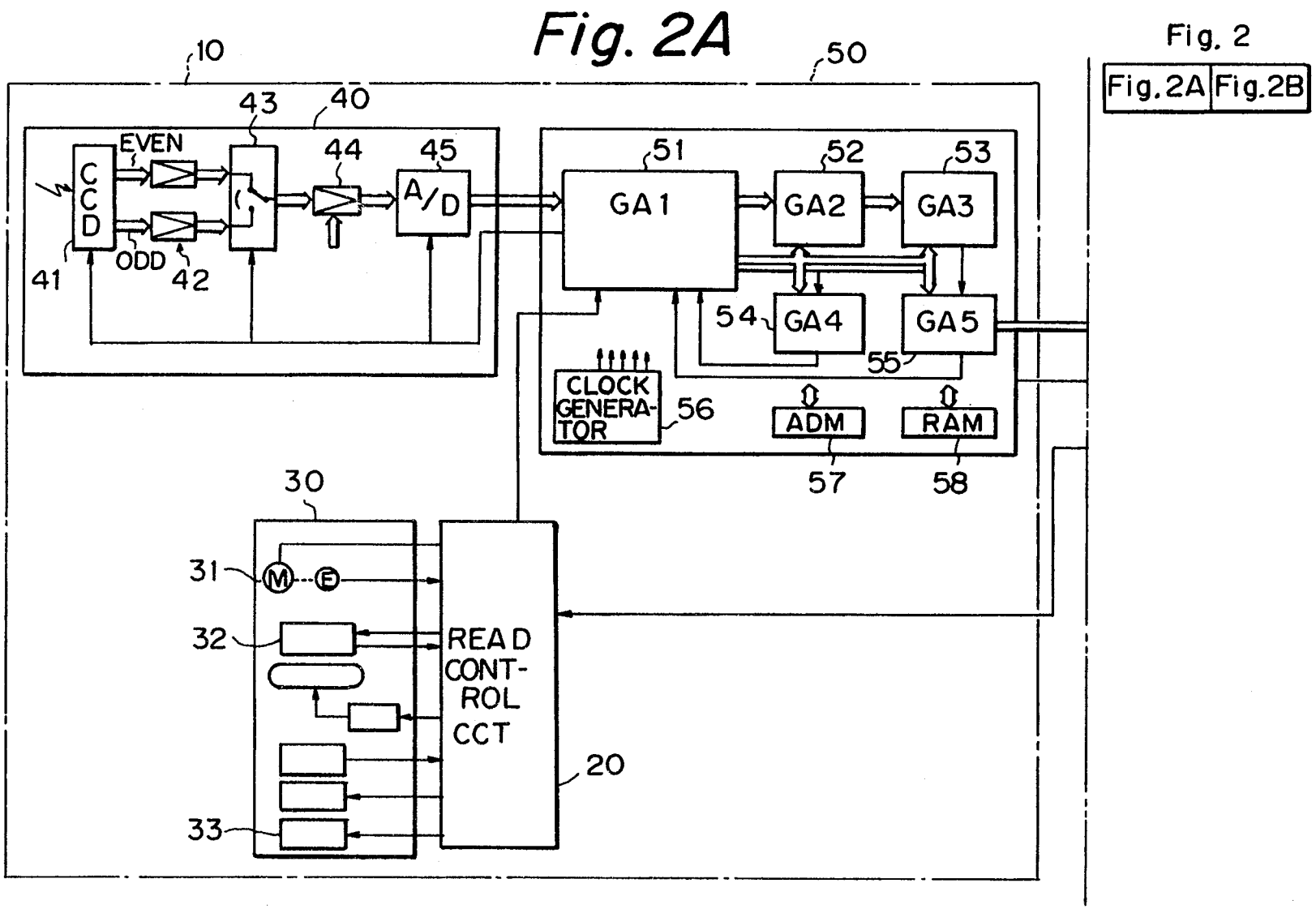
FIGS. 2A and 2B are a block diagram schematically showing an electrical arrangement incorporated in the embodiment.
Figure 2B:
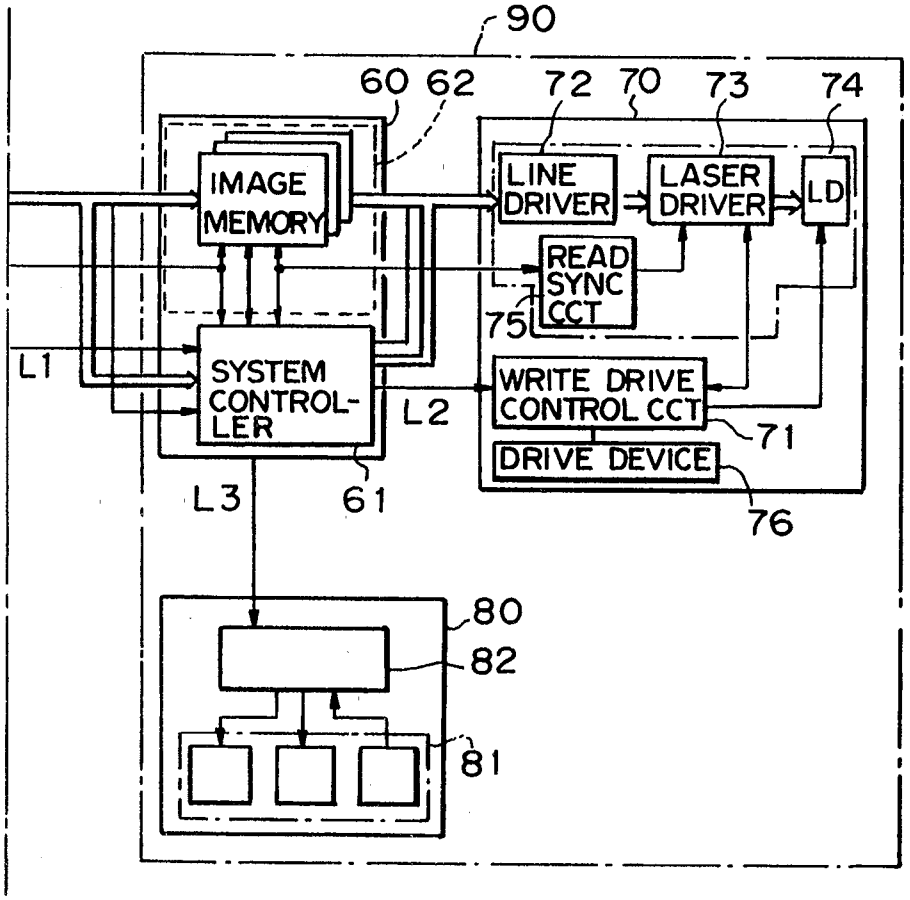

FIG. 2 shows an electrical arrangement of the digital copier. The reading device 10 has a housing accommodating a read control circuit 20, a read drive device 30, an image read circuit 40, and an image process circuit 50 are accommodated. The copying device 90 has a housing accommodating an image data store section 60, a copy circuit 70, a system controller 61, and an operating device 80 having keys and connected to the system controller 61. The data store section 60 has an image memory 62 and the system controller 61. The read control circuit 20, a write drive control circuit 71 built in the copy circuit 70, and the operating devie 80 are connected to the system controller 61 by signal lines L1, L2 and L3, respectively, and interchange data with each other.

The system controller 61 sends signals to the read control circuit 20 over the line L1 to cause it to control various components of the reading device 10, e.g., a scanner motor 1, lamp 32, a filter solenoid, and a fan. The image read circuit 40 has a CCD (Charge Coupled Device) image sensor 41 for converting an imagewise reflection from a document to an 80 dpi (dots per inch) analog signal. An amplifier 42 amplifies the output signal of the CCD image sensor 41 while dividing it into odd part and even part. This is because the time per pixel is too short for the amplifier 41 to handle the signal without dividing it. A switching device 43 combines the odd and even signals from the amplifier 42 to produce a serial analog signal. A variable amplifier 44 amplifies the analog signal from the switching device 43 by amplification degree command data AG which corrects a change in the illuminance of the lamp 32. An analog-to-digital converter (ADC) 45 transforms the resulting analog output of the variable amplifier 44 to a digital signal. The image process circuit 50 has five gate arrays 51–56, a clock generator 56, a ROM 57 and a RAM 58 for processing an image signal fed from the image read circuit 40. The gate array 51 senses the quantity of light, corrects shading, controls timings, controls commands, edits and outputs data, and generates a CCD drive clock. The gate array 52 changes the magnification in the main scanning direction. The gate array 53 processes halftone, binarizes image data, and detects a document size. The gate array 54 separates characters and halftone from each other and masks images. Further, the gate array 55 detects a marked area. The image memory 62 has a memory board and a memory control board. The system controller 61 controls the entire system and delivers commands for the write-in and read-out of image data. The control over the system includes monitoring the ready state of the system, sensing the size and the remaining amount of paper sheets, delivering a document read command and a paper feed start command, and controlling a scanner copy mode and a printer copy mode. When image data should be written in or read out, the system controller 61 determines the remaining capacity of the memory. The copy circuit 70 has a line driver 72 to which image data from the video memory 62 is applied, a laser driver 73 for amplifying an image data signal from a line driver 72, a semiconductor laser (LD) 74 driven by the laser driver 73, a read drive control circuit 75, a write drive control circuit 71, and a drive unit 76. The operating device 80 has an operation panel 81 having indicators and keys arranged thereon, and an operation control circuit 82.

Referring again to FIG. 1, the reading device 10 has a glass platen 306 to be loaded with a document. A scale 305 is positioned on the glass platen 306 adjacent to edge of the latter. A cover plate or platen cover 307 is capable of covering the entire area of the glass platen 306. A lamp 301 is disposed below the glass platen 306 for illuminating a document laid on the glass platen 306. An imagewise reflection from the document is sequentially reflected by a first to a third mirror 302, 303 and 304. The light from the third mirror 304 is routed through a lens 308 to a CCD image sensor 310 which is located at the focal point of the lens 308. The lens 308 is disposed in a cover 309. The CCD image sensor 310 is mounted on an image read board 311 which accommodates the ADC 45 therein. The image process circuit 50 is formed on a board 312. The reference numeral 313 designates a fan for cooling the image reading device 10.

As the operator sets a document on the glass platen 306 and then presses a copy start button provided on the operation panel 81, the optics including the lamp 301 is moved below and along the glass platen 306 to scan the document. The resulting reflection from the document is propagated through the mirrors and lens to reach the CCD image sensor 310. The CCD image sensor 310 reads the image represented by the incident light. Specifically, the image sensor 310 outputs an analog signal representative of the document image focused thereon in synchronism with a clock which is fed thereto from the image process circuit 50. The analog signal from the image sensor 310 is amplified, combined, variably amplified, and then applied to the ADC 45 to be converted to a digital signal. The image process circuit 50 converts the digital signal to digital image data and then delivers it to the image data storage 60.

As shown in FIG. 1, the copying device 90 has an image carrier in the form of a photoconductive belt 100 which is passed over an upper and a lower support roller 381 and 382. The support rollers 381 and 382 each extends perpendicular to the sheet surface of FIG. 1 and is deviated from the other in the vertical direction. A transfer charger 352 faces the belt 100 at a position where the belt 100 is passed over the support roller 381, constituting an image transfer station. A guide plate 383, a first transit roller pair 327 and an intermediate roller pair 349 define a transport path which extends from the above-mentioned image transfer station to a paper tray 348. The paper tray 348 is held in a horizontal position in an upper portion of the device 90 and loaded with paper sheets of particular size. A pick-up roller 324 and a reverse roller 326 are associated with the paper tray 348, serving as a sheet feeding device 390 in combination. A register roller pair 353 is located on the transport path adjacent to the image transfer station.

Figure 10:
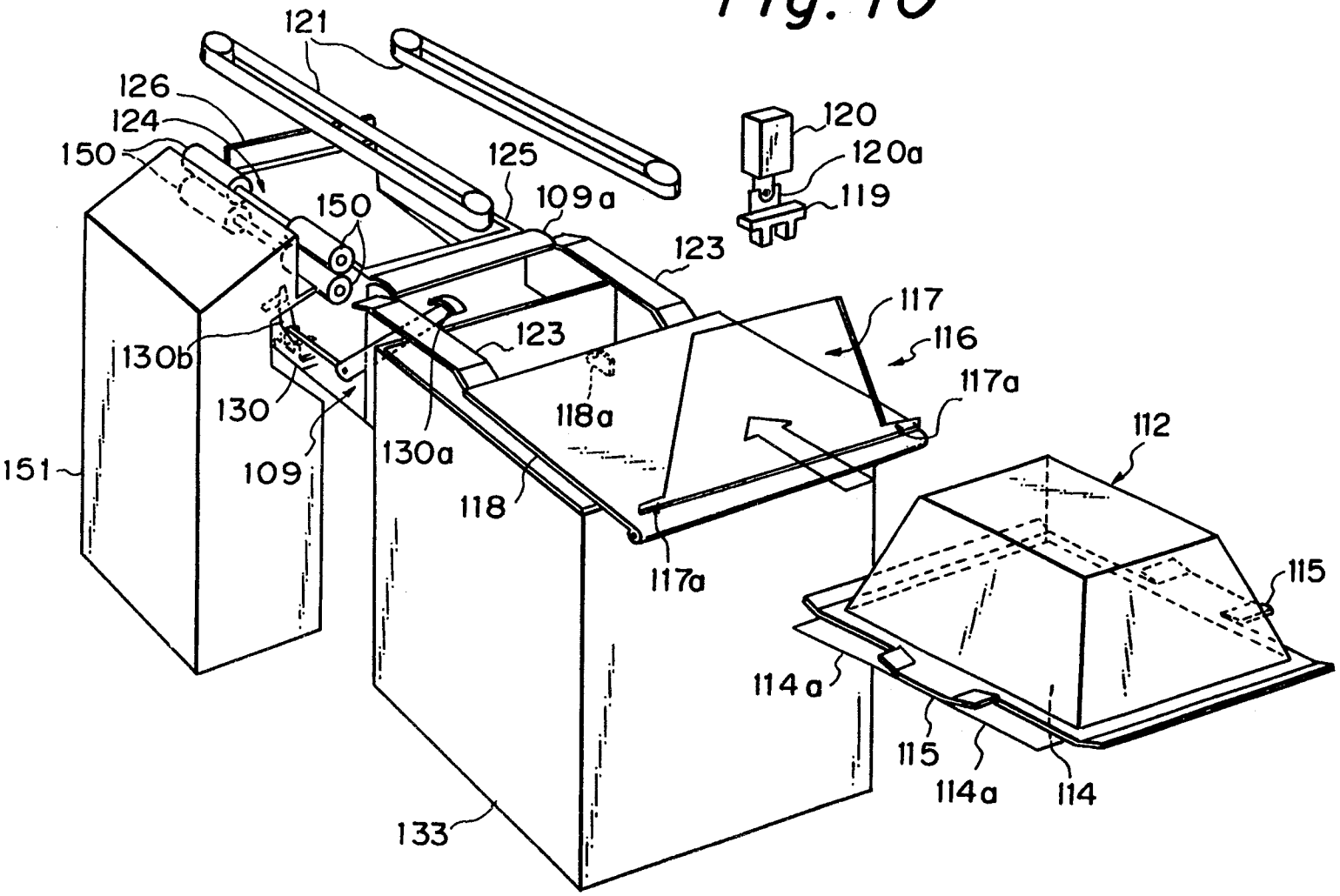
FIG. 10 is a perspective view of a toner supply mechanism included in the embodiment.
Figure 12:
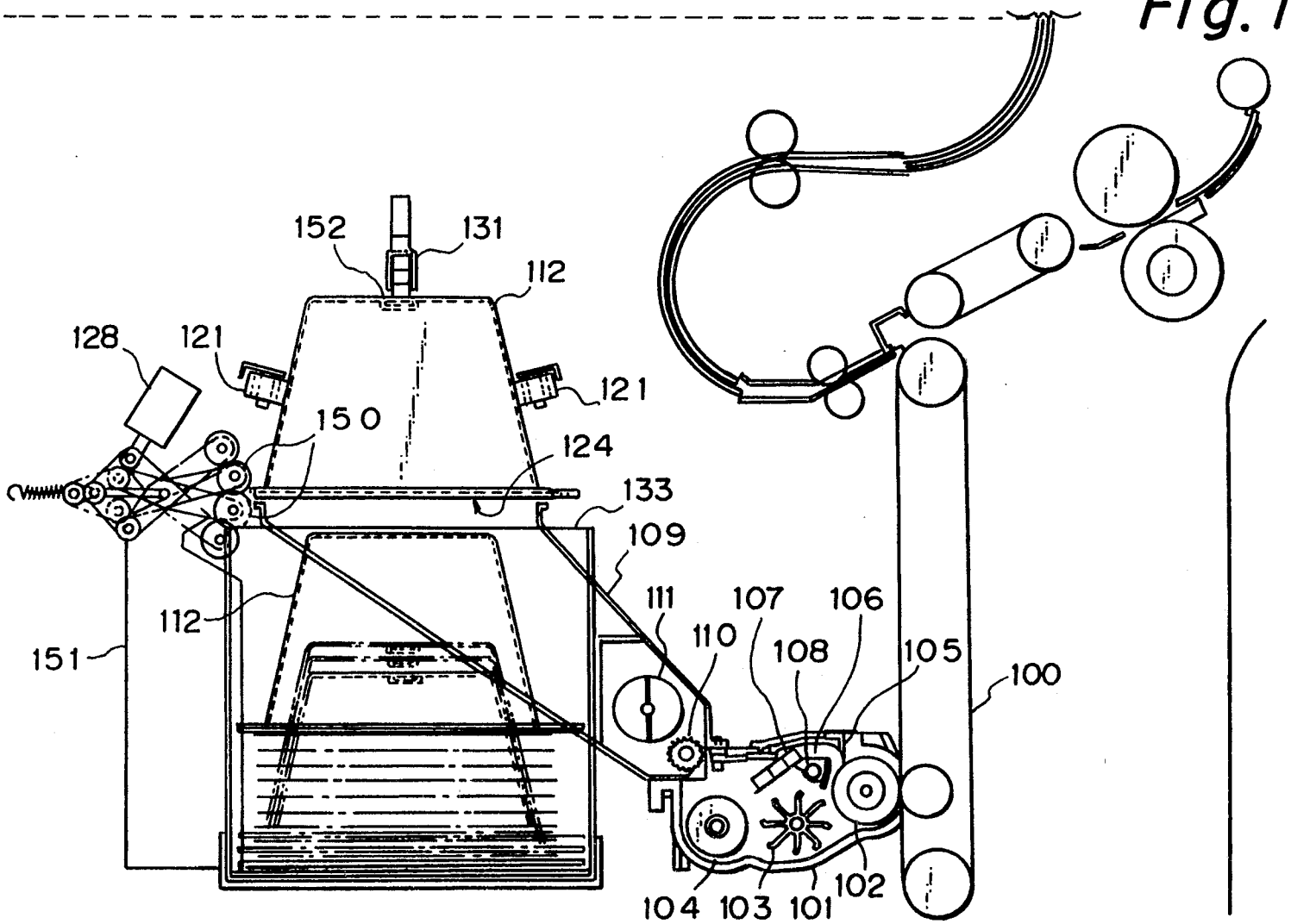
FIG. 12 is a front view showing an arrangement around a hopper opening included in the toner supply mechanism.
Figure 13:
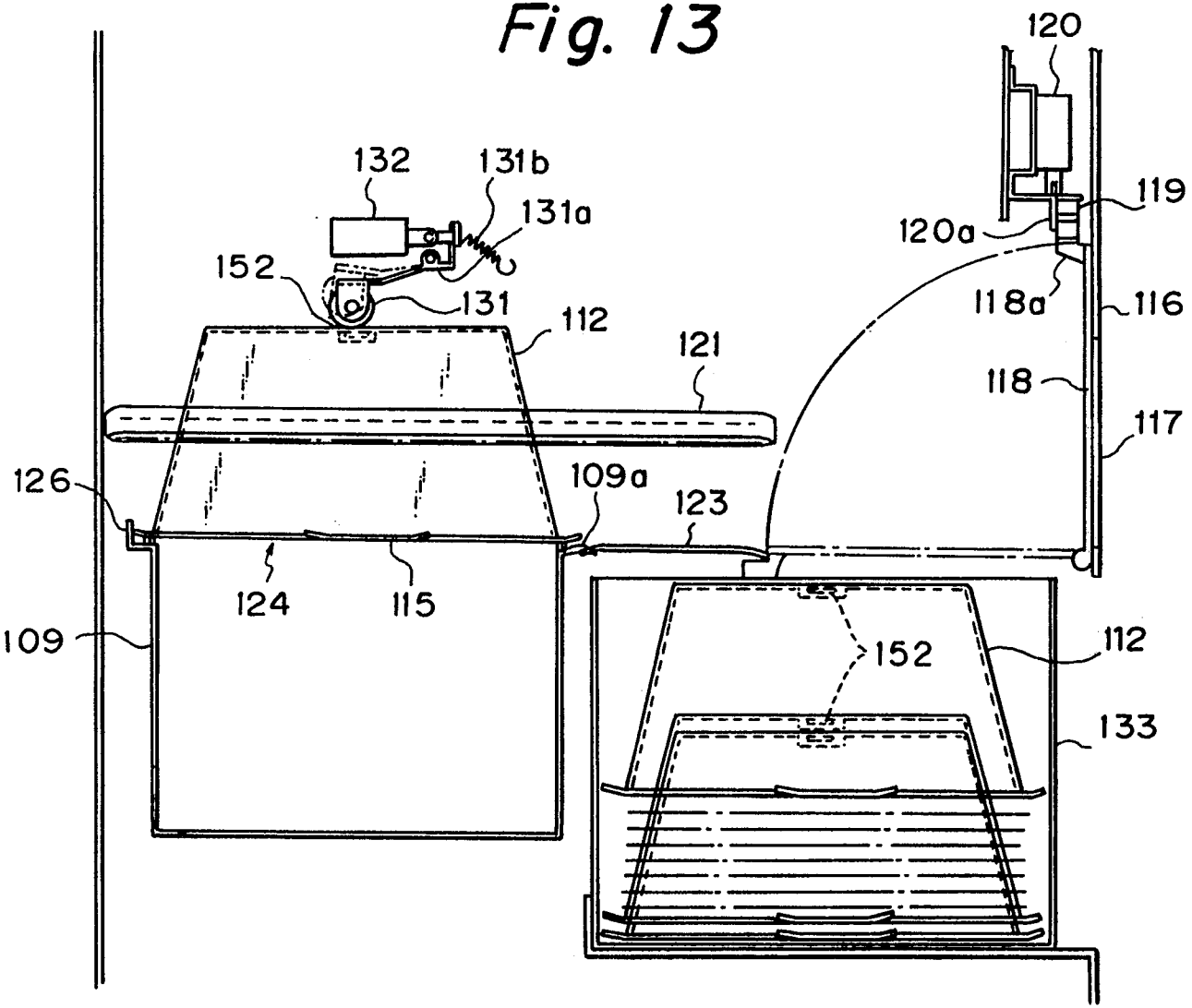
FIG. 13 is a view of the same arrangement as seen from the left.

A discharge roller pair 330 is disposed in an upper right portion of the device 90. A fixing device has a fixing roller 335 accommodating a heater 366 therein, and a pressing roller 334. A conductive separation and transport belt 351, the fixing device and a transport path defined by a roller pair 332 and a guide plate 384 are arranged between the image transfer station and the discharge roller pair 330. A separator in the form of a pawl 337 is located in close proximity to and downstream of the image transfer station with respect to an intended direction of movement of the surface of the belt 100. A cleaning fur brush 338 and a cleaning blade 339 are located downstream of the pawl 337. A waste toner bottle 340 is positioned at the right-hand side of the region where the surface of the belt 100 moves downward. A toner is removed from the surface of the belt 100 by the fur brush 338 and blade 339 and then collected in the waste toner bottle 340. A discharge lamp 342 and a main charger 342 which has a grid 343 are positioned below the waste toner bottle 340 and face the belt 100. The main charger 342 is connected to a high-tension power source of negative voltage so as to uniformly charge the surface of the belt 100 to −800 volts. An exposure station is defined in the portion where the belt 100 wraps around the lower support roller 382. An optical writing unit 385 is held in a horizontal position in a lower portion of the device 90 and emits a laser beam toward the above-mentioned exposure station. The writing unit 385 has the semiconductor laser 74, FIG. 2, a cylindrical lens, a polygonal mirror 344 driven by a motor 345 in a rotary motion, an f-theta lens 355, a mirror 356, and a synchronization detector 357. A developing device 386 is located above the writing unit 385 and has a casing 101 and a toner hopper 109. A developing roller 102 is accommodated in the casing 101 in such a manner as to face the region where the surface of the belt 100 moves upward. Also accommodated in the casing 101 are, as shown in FIG. 12, a doctor blade 105 for regulating the amount of developer deposited on the developing roller 102, a separator 106 for guiding the part of the developer removed by the doctor 105 and moving downward, a fin 107 and a conveyor screw 108 for agitating the developer in the casing 101 in the axial direction of the roller 102, a paddle 103 for agitating the developer in the casing 101 in a direction perpendicular to the axis of the roller 102, and a mixing roller 104 for mixing a fresh toner fed from a toner hopper 109 with the developer. The toner hopper 109 has an opening at the lower end thereof which is communicated to the casing 101. A toner supply roller 110 is disposed in the opening of the toner hopper 109. An agitator 111 is accommodated in the toner hopper 109 to agitate the toner thereinside. The toner hopper 109 has an opening at the upper end thereof also, forming a toner supply section. A toner cartridge 112 filled with a fresh toner is removably mounted on the toner supply section. A collecting box 133, FIGS. 10 and 13, is located at one side of the toner hopper 109 which is the viewer's side on FIG. 12. The collecting box 133 is ready to accomodate the toner cartridge 112 having released the toner contained therein, i.e., empty cartridge. Optional paper feed devices 391 and 392 are mounted on the top of copying device 90 and have respectively paper trays 346 and 347, pick-up rollers 314 and 319, feed rollers 315 and 320, and reverse rollers 316 and 321. A second and a third transit roller pair 322 and 317 are associated with the paper feed devices 392 and 391, respectively. Each of the paper trays 348, 347 and 346 can be pulled out, as desired. Set sensors and size sensors are associated with the paper trays 348, 347 and 346. When the set sensors sense paper sheets stacked on the associated paper trays 348, 347 and 346, a motor, not shown, is driven to raise the stacks of sheets until the the stacks abut against the associated pick-up rollers 324, 314 and 319. To monitor the paper transport condition on the transport paths, a third transit sensor 318, a second transit sensor 323, a first transit sensor 328, an intermediate sensor 350, a register sensor 354, fixation sensor 331 and a paper discharge sensor 329 are provided.

A fan 359 and a filter 358 are mounted on the inner lower portion of the left panel of the device 90, as viewed in FIG. 1. The fan 359 cools off the motor 345 which drives the polygonal mirror. The filter 358 collects toner particles entrained by a stream of air which is generated by the fan 359 in the vicinity of the collecting box, or empty cartridge accommodating section, 133.

Figure 3:
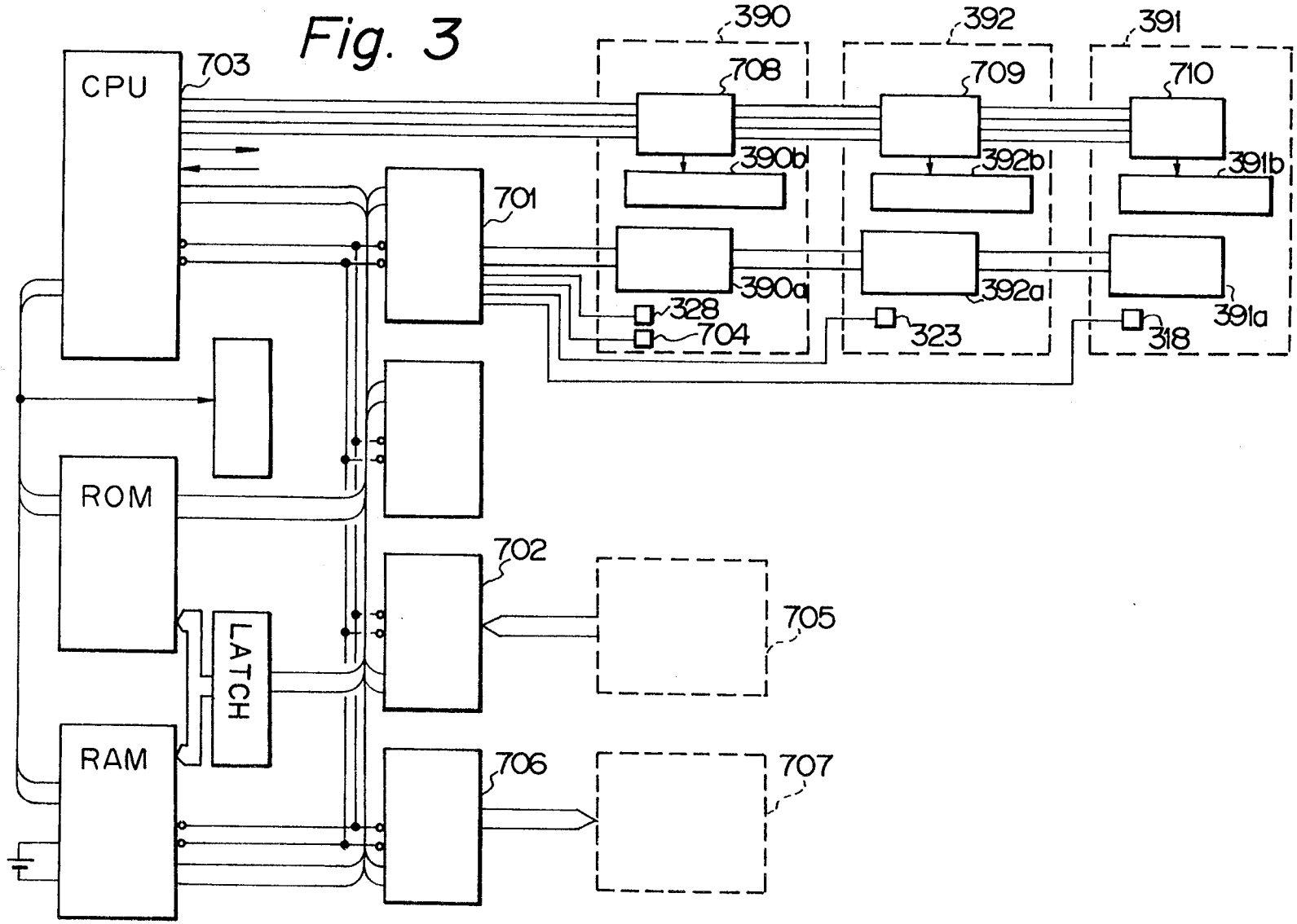
FIG. 3 is a block diagram schematically showing a specific construction of a write drive control circuit shown in FIG. 2.

FIG. 3 shows a specific construction of the write drive control circuit 71. As shown, the control circuit 71 has a CPU 703 which receives the outputs of the various sensors via input gate arrays 701 and 702. Sensor groups 390*a*, 391*a* and 392*a* are respectively arranged in the sheet feeding devices 390, 391 and 392 and connected to the gate array 701. The sensor groups 390*a*–392*a* each includes a paper size sensor, paper end sensor, tray set sensor, and connection sensor. Also connected to the gate array 701 are the first to third transit sensors 328, 323 and 318 and a door open sensor 704. A sensor group 705 is connected to the gate array 702 and includes the previously mentioned sensors 350, 331 and 329, sensors 119 and 130, which will be described, associated with a toner cartridge, a body door open sensor, and a toner concentrtion sensor 360 which is a photosensor. An output gate array 706 is connected to an actuator group 707 which includes a transit clutch for paper transport, an intermediate clutch, a register clutch, actutors 120, 122, 128 and 132 associated with a toner cartridge, a main motor, a cleaning blade solenoid, a toner supply solenoid, the polygonal mirror motor 345, the heater 336 for fixation, the high-tension power source for charging, a high-tension power source for image transfer, the discharge lamp 341, and the toner concentration sensor 360. Actuator groups 390*b*, 391*b* and 392*b* are respectively associated with the paper feed deviecs 390, 391 and 392 and connected to the output ports of the CPU 703 via serial parallel receivers 708–710. Each of the actuator groups 390*b*–392*b* includes a pack-up solenoid, a paper feed clutch, a tray lock solenoid, and an elevation motor.

In the above construction, the semiconductor laser 74 situated in the writing unit 385 is driven by the laser driver 73 in response to digital image data which is a one bit (record/non-record) per pixel bilevel signal. The beam issuing from the semiconductor laser 74 is reflected by the polygonal mirror 344 and then routed through the cylindrical lens, f-theta lens 355 and mirror 356 to reach the photoconductive belt 100. The polygonal mirror 344 is rotated at a constant speed by the motor 345 with the result that the laser beam is steered in the horizontal direction which is perpendicular to the moving direction of the belt 100.

The surface of the belt 100 is uniformly charged to −800 volts by the main charger 342 beforehand. As the laser beam representative of image data illuminates the charged surface of the belt 100, the charge deposited on the belt 100 is dissipated to ground via the conductive layer of the belt 100. The semiconductor laser 74 is turned on for areas where the document density is high (i.e. the bilevel signal has the record level) and is not turned on for areas where it is low (i.e. the bilevel signal has the non-record level). As a result, the areas of the surface of the belt 100 corresponding to low document densities have a potential of substantially −800 volts while the areas corresponding to high document densities have a potential of about −100 volts. In this manner, a latent image is electrostatically formed on the belt 100 in association with the density distribution of the document. The developing device 386 develops the latent image by a toner to form a toner image on the surface of the belt 100. The toner in the developing device 386 is negatively charged by agitation, and the developing roller 102 in the casing 101 is biased to about −550 volts by a bias generator. In this condition, the negatively charged toner deposits on the areas of the belt 100 where the surface potential is higher than the bias voltage, forming a toner image matching the document image.

A paper sheet is fed from selected one of the three paper trays 348, 347 and 346 to the register roller 353. The register roller 353 drives the paper sheet at a predetermined timing to the image transfer station. Then, the transfer charger 352 transfers the toner image from the belt 100 to the paper sheet. The paper sheet carrying the toner image thereon is separated from the belt 100 by the conductive separation and transport belt 351. Subsequently, the paper sheet has the toner image fixed thereon by the fixing roller 335 and pressing roller 334. Finally, the paper sheet with the fixed image, or copy, is driven out by the discharge roller pair 330 to a copy tray, not shown.

After the image transfer, the cleaning fur brush 338 and cleaning blade 339 remove the toner remaining on the belt 100 to prepare the belt 100 for another copying cycle.

Figure 4:
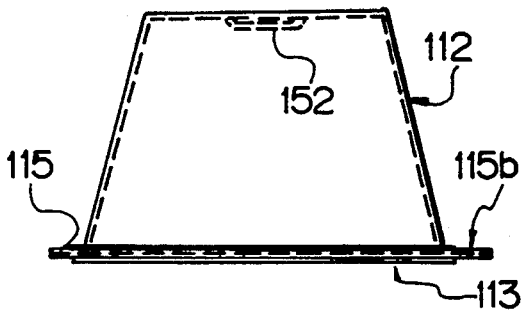
FIG. 4 is a front view of a cartridge usable with the digital copier.
Figure 5:
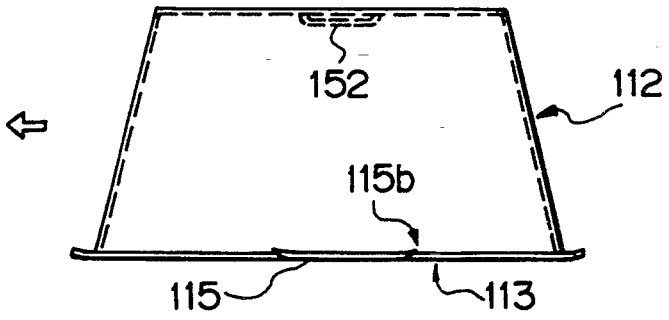
FIG. 5 is a side elevation of the cartridge as viewed from the left.
Figure 6:
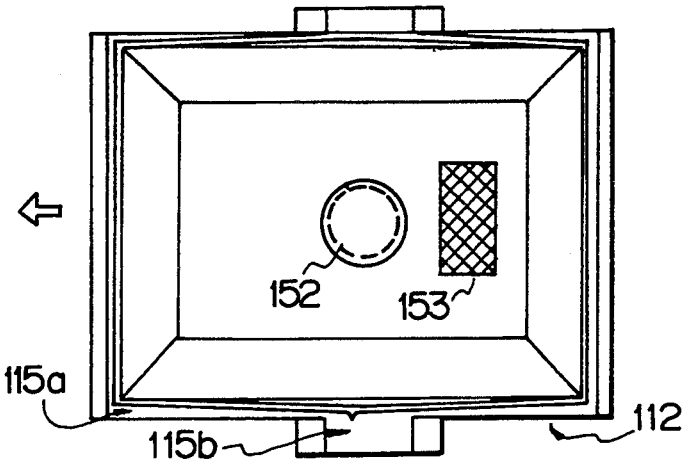
FIG. 6 is a bottom view of the cartridge.
Figure 7:
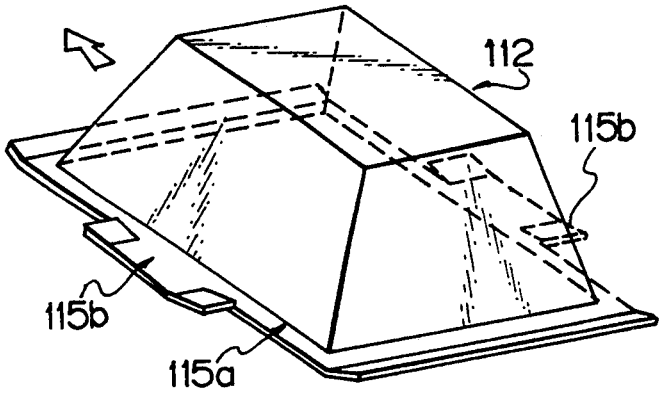
FIG. 7 is a perspective view of the cartridge as viewed from above.
Figure 8:
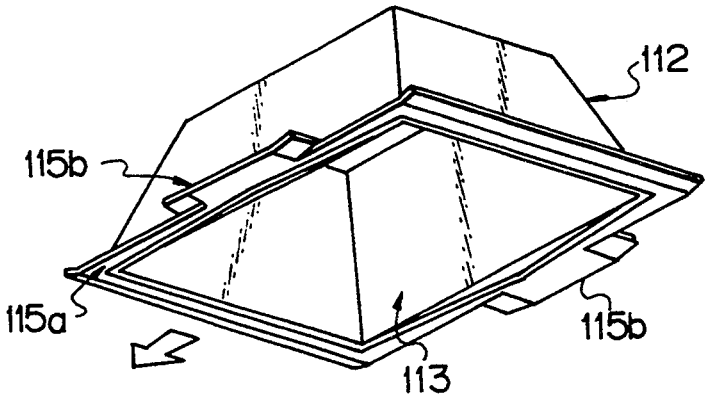
FIG. 8 is a perspective view of the cartridge as viewed from below.
Figure 9:
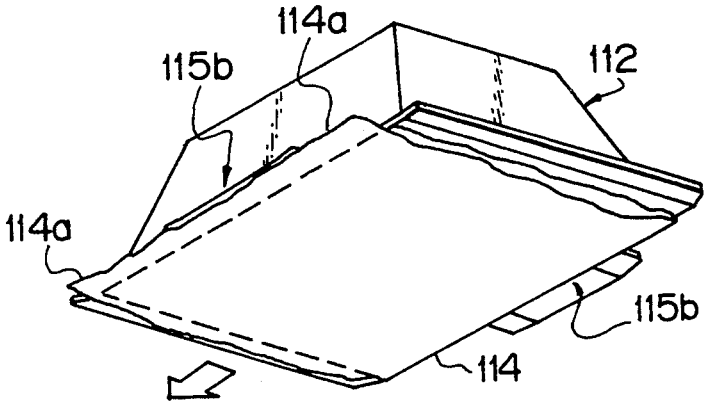
FIG. 9 is a perspective view showing the cartridge whose opening is closed by a seal member.

How a fresh toner is supplied from the toner cartridge 112 to the hopper 109 will be described hereinafter. Briefly, the cartridge 112 filled with a toner is set on the top opening 124 of the hopper 109, and the toner is supplied from the cartridge 112 to the hopper 109 via the opening 124. To begin with, a reference will be made to FIGS. 4 and 9 for describing the toner cartridge 112 applicable to the embodiment specifically.

The toner cartridge 112 has a generally truncated quadrangular pyramid configuration having an oblong bottom and has an opening 113 at the bottom thereof. The interior of the cartridge 112 is to be filled with a toner. An air vent is formed through the top of the cartridge 112 and covered by a filter 153 which stops a toner. A magnet 152 is affixed to substantially the center of the inner surface of the top wall. A flange 115*a* extends out from the edges of the bottom opening 113. A right and a left wings 115*b* extend further outward from opposite longer portions of the flange 115*a* and positioned at substantialy the center of the latter. The right ring 115*b* is wider than the left wing 115*b* as measured in the direction of the shorter sides of the cartridge 112. Each wing 115*b* is inclined upward at opposite ends thereof with respect to the longer sides of the cartridge 112. After a toner has been filled in the cartridge 112, a seal member 114 is adhered to the flange 115*a* to cover the entire opening 113. An unsealing mechanism which will be described adjoins the left portion of the flange 115*a* when the cartridge 112 is located above the opening 124 of the tonner hopper. For this reason, the seal member 114 is adhered to the left portion of the flange 115*a* first, then adhered to the other portions up to the right portion 115*a*, and then folded back to extend out from the left wing 115*b*. The edge of the free end extending out from the left wing 115*b*, i.e., a tag is adhered to the wing 115*b*.

Figure 11:
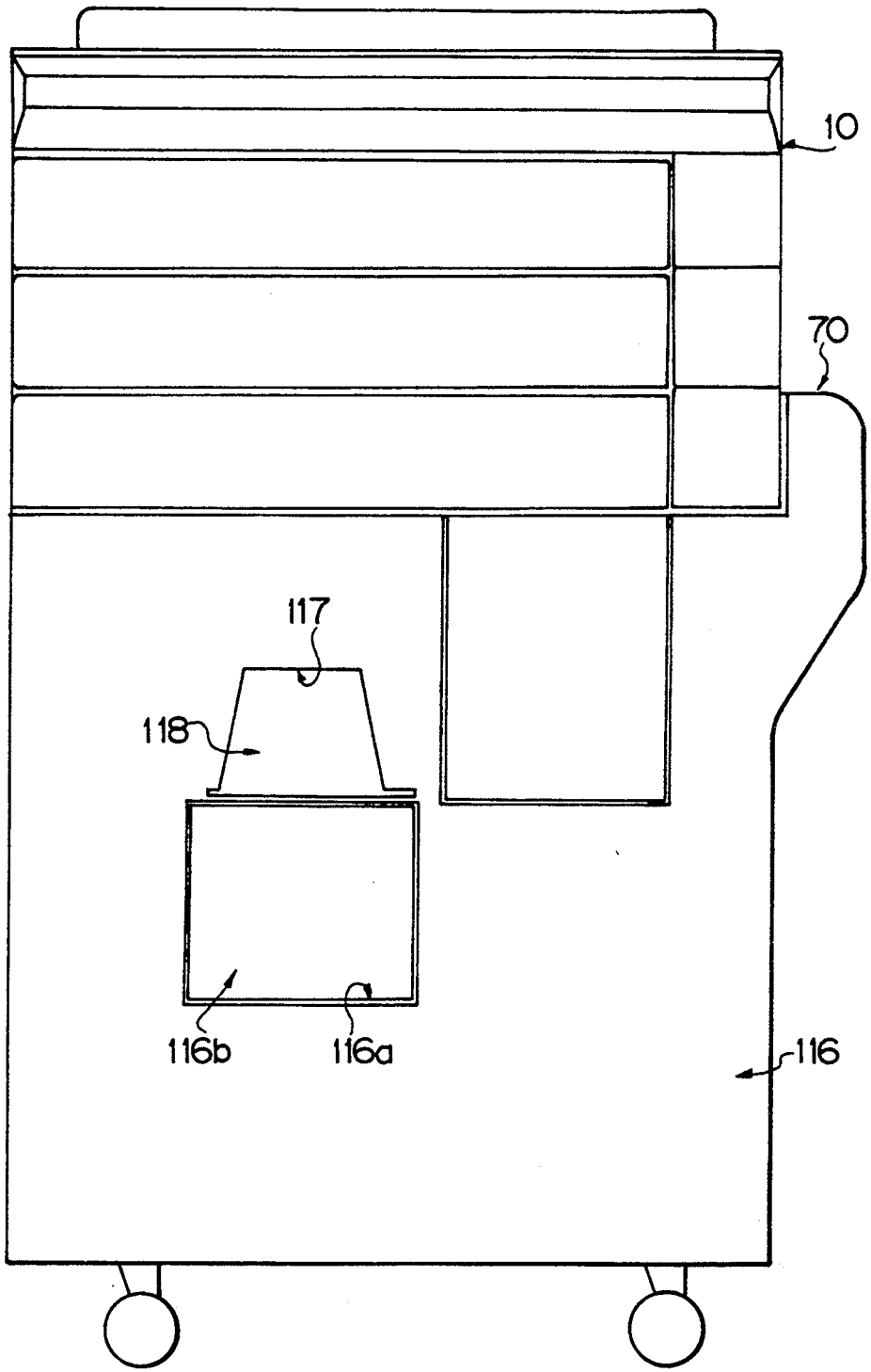
FIG. 11 is a front view showing the housing of the digital copier.

As shown in FIG. 10, the equipment body includes a cartridge inserting section implemented as an opening 117 which is formed through the front panel 116 of the equipment. The hopper 109 or toner supplying section is positioned at the rear side of the device. Unsealing means for opening the cartridge 112 is located at the left-hand side of the opening 124 of the hopper 109 and includes unseal rollers 150. A seal member collecting section is located face the unseal rollers 150 and implemented as a box 151. The empty cartridge accommodating section, i.e., collecting box 133 is interposed between the hopper 109 and the front panel 116. Transporting means is constituted by belts 121 and flat transit guides 123. As shown in FIG. 11, the front panel 116 is formed with, in addition to the opening 117, an opening 116*a* for the box 133. The opening 117 assigned to the cartridge 112 is slightly larger than the cartridge 112 with respect to a section of the cartridge 112 which is perpendicular to the direction of cartridge insertion. The opening 117 has horizontal extensions 117*a* and 117*b* which are dimensioned to accommodate the wings 115*b* of the cartridge 112 and, therefore, different in dimension from each other as measured in the right-and-left direction. Such a configuration prevents the cartridge 112 from being inserted into the opening 117 in a wrong position.

A door 118 is disposed inwardly of the front panel 116 and rotatably supported at the lower end thereof by a horizontal shaft which extends parallel to the panel 116. The door 118 covers the entire opening 117 when closed. The door 118 is constantly biased by means, not shown, in a direction for closing the opening 117 and usually held in a closed position. When the door 118 is pushed into the equipment against the action of the biasing means, it is tiltable by up to about 90 degrees about the horizontal shaft. A projection plate 118*a* is mounted on the inner surface of the door 118 that faces the interior of the device when the door 118 is closed. The projection plate 118*a* has a projection extending out beyond the edge of the door 118.

A locking mechanism is affixed to the inner surface of the front panel 116 above the opening 117. The locking mechanism is made up of a door sensor 119, an unlock solenoid 120, and a lock plate 120*a* affixed to the plunger of the solenoid 120. The door sensor 119 is positioned such that when the door 118 is closed, the projection of the projection plate 118*a* intervenes between the light emitting element and the light-sensitive element of the door sensor 119. The locking mechanism is positioned such that when the solenoid plunger is drawn out while the door 118 is closed, the lock plate 120*a* engages with the projection plate 118*a* from the opposite side to the front panel 116 and, when the solenoid plunger is pulled in, the lock plate 120*a* is released from the projection plate 118*a*.

A seal 125 is fitted on the upper surfaces of the edges of the hopper 109 which surround the opening 124, preventing a gap from being formed between the such edges and the lower surface of the flange 15*a* of the cartridge 112. An inlet guide 109*a* extends out from the hopper 109 toward the front panel 116 away from the hopper opening 124. An upright abutment or wall 126 extends from the rear end of the hopper 109 for positioning the cartridge 112 above the opening 124. As shown in FIG. 13, impacting means is disposed above the hopper opening 124 and made up of a roller 131 supported by a rotatable support plate 131*a*, a spring 131*b* constantly biasing the plate 131*a* in a direction for moving the roller 131 upward, and a solenoid 132 capable of moving the plate 131*a* and, therefore, the roller 131 downward against the action of the spring 131*b*.

Figure 14:
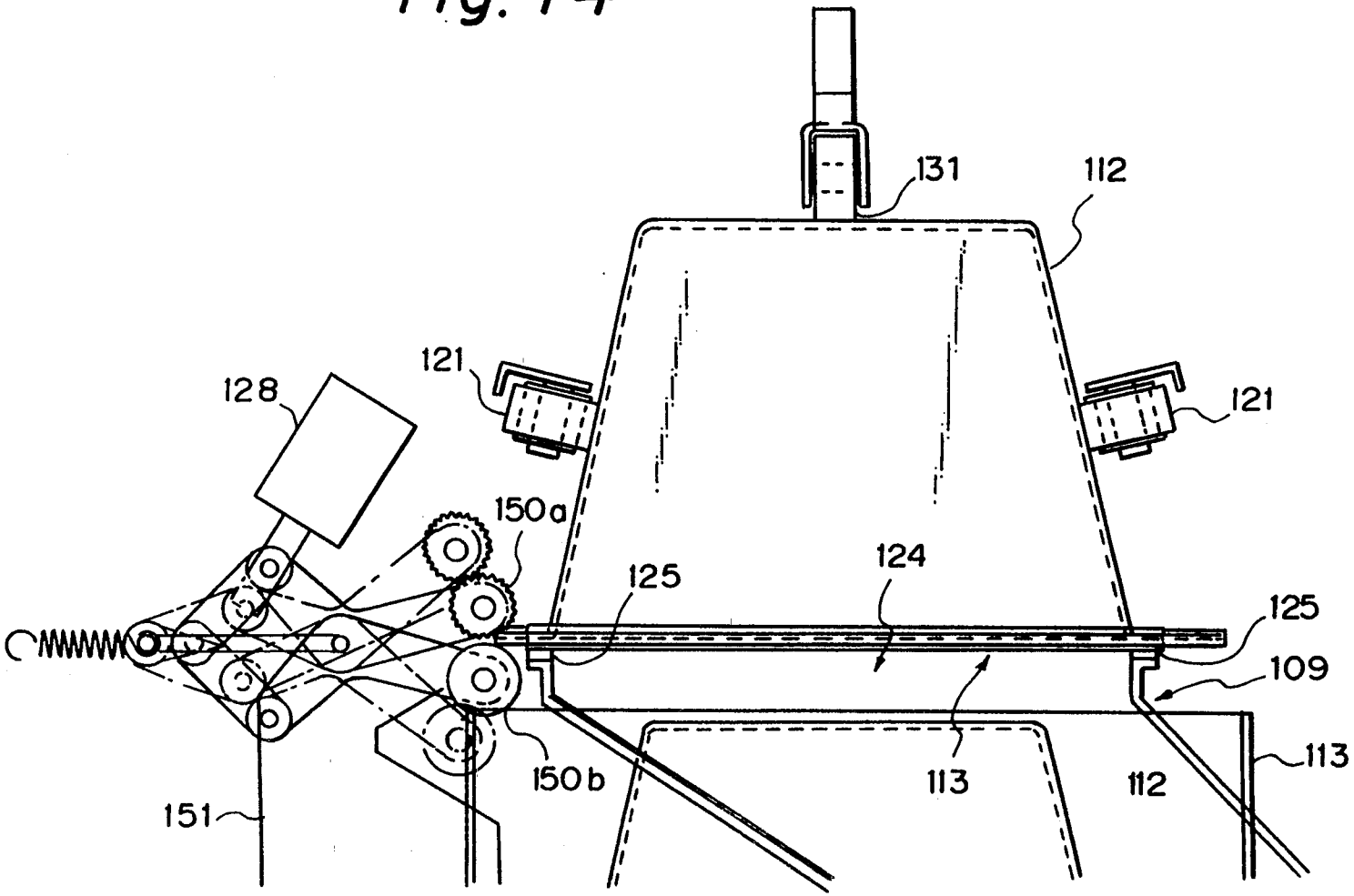
FIG. 14 is a front view showing part of the tone supply mechanism surrounding unseal rollers.
Figure 15:
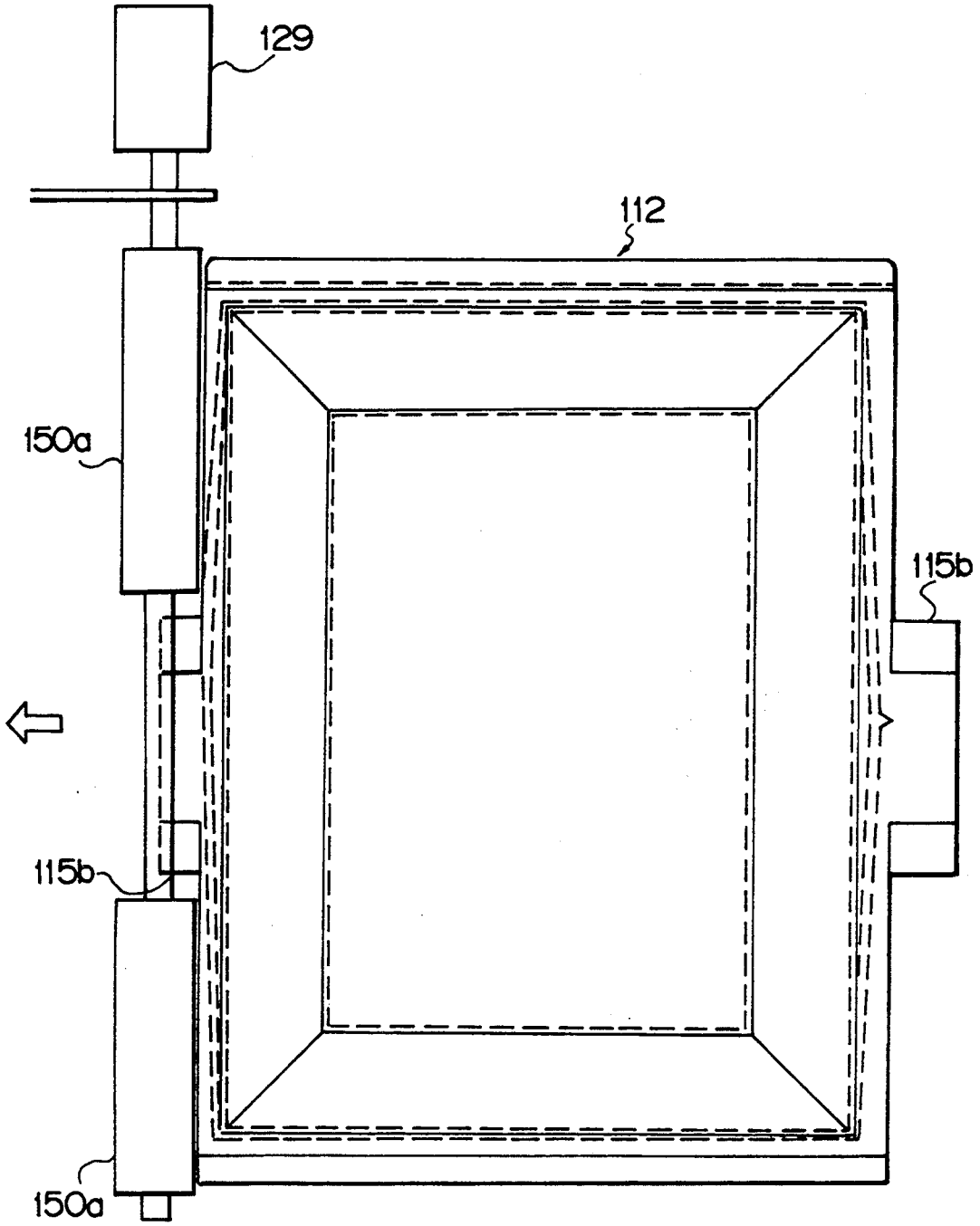
FIG. 15 is a plan view showing a positional relation between the unseal rollers and the cartridge.

As shown in FIGS. 14 and 15, the unseal rollers 150 included in the unsealing means is made up of a pair of upper rollers 150*a* and a pair of lower rollers 150*b*. The upper rollers 150*a* are affixed to an upper rotatable shaft and spaced apart from each other by a distance corresponding to the length of the left wing 115*b* of the cartridge 112. The lower rollers 150*b* are affixed to a lower rotatable shaft 150*b* and spaced apart from each other such that the they face the upper rollers 150*a*. To surely pull the seal member 114 fitted on the cartridge 112, the lower rollers 150*b* are implemented as cylindrical rollers made of an elastic material while the upper rollers 150*a* are provided with irregular surfaces. The upper and lower shafts are rotatably mounted on a link mechanism so that their distance are variable. An unseal motor 129, FIG. 15, drives the upper and lower shafts. As shown in FIG. 14, a spring and a pinch solenoid 128 are connected to the link mechanism. The spring connected to the link mechanism constantly biases the upper and lower shafts such that a gap capable of accommodating the wing 115*b* is defined between the upper and lower roller pairs. The pinch solenoid 128, when energized, reduces the gap between the upper and lower rollers against the action of the spring such that the upper and lower rollers nip the seal member 114 therebetween. The seal collecting box 151 has an opening to allow the seal member 114 being stripped from the cartridge 112 by the rollers 150 to enter the box 151.

The cartridge collecting box 113 is removably mounted on the equipment body and has an opening at the top thereof for receiving the cartridge 12. As shown in FIG. 11, a door 116*b* usually closes an opening 116*a* which is formed in the equipment body for pulling out the box 113. The cartridge collecting box 133 will be described in detail later.

Figure 16:
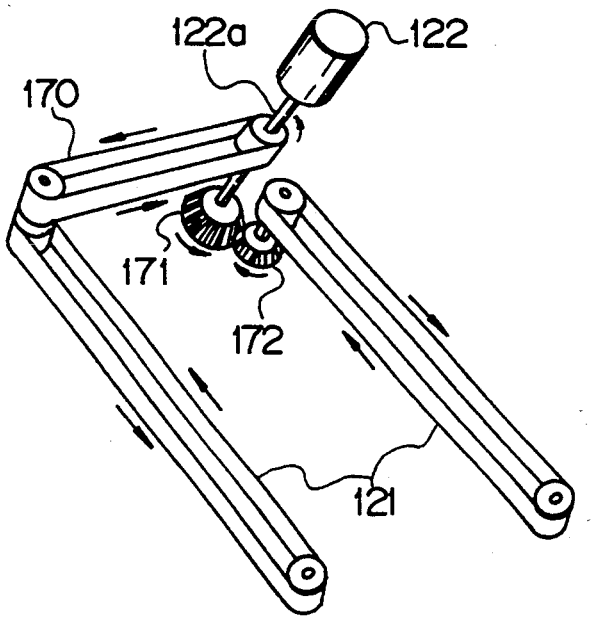
FIG. 16 is a perspective view showing transport belts included in the toner supply mechanism.
Figure 21:
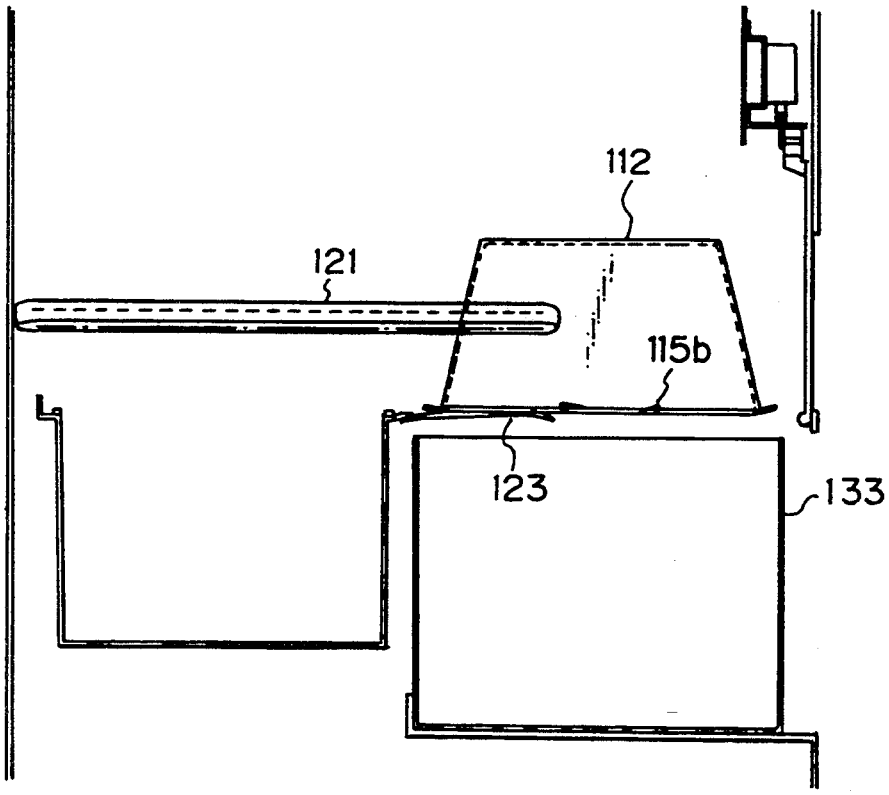
FIG. 21 is a side elevation, as viewed from the left, showing the toner supply mechanism in a condition wherein it has completed the reverse transfer of the cartridge.

As shown in FIGS. 14 and 16, the right and left transport belts 121 are driven by a motor 122, and each is passed over pulleys. The axes of the pulleys are positioned parallel to the right and left inclined walls of the cartridge 112, so that the belts 121 may contact the right and left inner surfaces of the cartridge 112. The output shaft 122*a* of the motor 122 is positioned parallel to the left inclined wall of the cartridge 112. A belt 170 is passed over a pulley mounted on the output shaft 122*a* of the motor 122 and a pulley mounted coaxially with the rear pulley over which the left belt 121 wraps. In this configuration, the rotation of the motor 122 is transmitted to the left belt 121 via the belt 170. A bevel gear 171 is mounted on the lower end of the motor output shaft 122*a* and held in mesh with a bevel gear 172 which is mounted coaxially with the rear pulley of the right belt 121. Hence, the rotation of the motor 122 is also transmitted to the right belt 121 via the gears 171 and 172. As shown in FIG. 16, when the output shaft of the motor 122 is rotated counterclockwise, the belts 121 transport the cartridge 12 toward the rear end of the equipment. Conversely, when the output shaft of the motor 122 is rotated clockwise, the belts 121 drive the cartridge 112 toward the front end of the equipment. The rotation of the motor 122 which causes the belts 121 to drive the cartridge 112 to the rear as viewed in FIG. 16 will hereinafter be referred to as forward rotation, and such a movement of the belts 121 will be referred to as forward transport. The rotation of the motor 122 in the other direction and the resulting movement of the belts 121 will be referred to as reverse rotation and reverse transport, respectively. Preferably, the front pulleys over which the belts 121 are passed are positioned such that the leading end of the cartridge 112 being inserted into the equipment through the opening 117 reaches the belts 121 while the trailing end of the cartridge 112 is still located at the outside, so that the operator does not have to put the hand into the equipment. In this embodiment, such pulleys are positioned above and at substantially the center of the opening of the collecting box 133 in the longitudinal direction of the opening. The material of the belts 121 and the contact pressure which the belts 121 exert on the inclined walls of the cartridge 121 are selected such that the emptied cartridge 121 would fall by gravity if it were not supported from below. The flat transit guides 123 are parallel to each other and extend in the direction in which the cartridge 112 is inserted into the equipment. The distance between the transit guides 123 is greater than the distance between the outermost edges of the right and left portions of the flange 115*a*, so that only the wings 115*b* may rest on the guides 123. The front end of each transit guide 123 is positioned above the opening of the box 133 while the rear end is located at one of opposite sides of an inlet guide 109*a* which extends out from the edge of the hopper opening 124. As shown in FIG. 21, the front end of each transit guide 123 assumes such a position that while the reverse transport of the cartridge 112 by the belts 121 is under way, the cartridge 112 is positioned at substantially the center of the box 133 in the longitudinal direction when the end of each wing 115*b* of the cartridge leaves the above-mentioned end of the transit guide 123. At the instant when the ends of the wings 115*b* of the cartridge 112 leave the front ends of the transit guides 123, the belts 121 are still capable of transporting the cartridge 112 in the reverse direction. However, because the door 118 has been retracted from the position above the opening of the box 113, the cartridge 112 is not sustained and, therefore, begins to fall into the box 133 by gravity.

Figure 17:
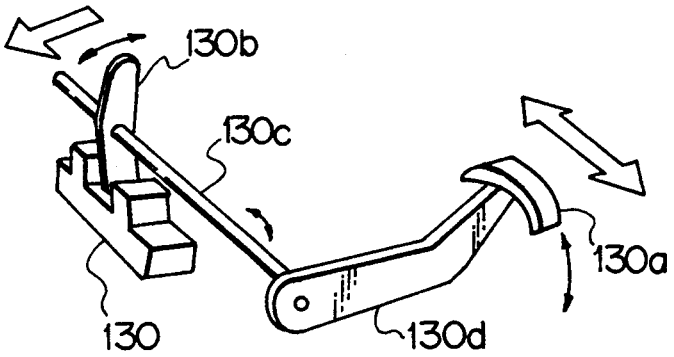
FIG. 17 is a perspective view showing a specific structure of a sensor included in the toner supply mechanism.
Figure 18:
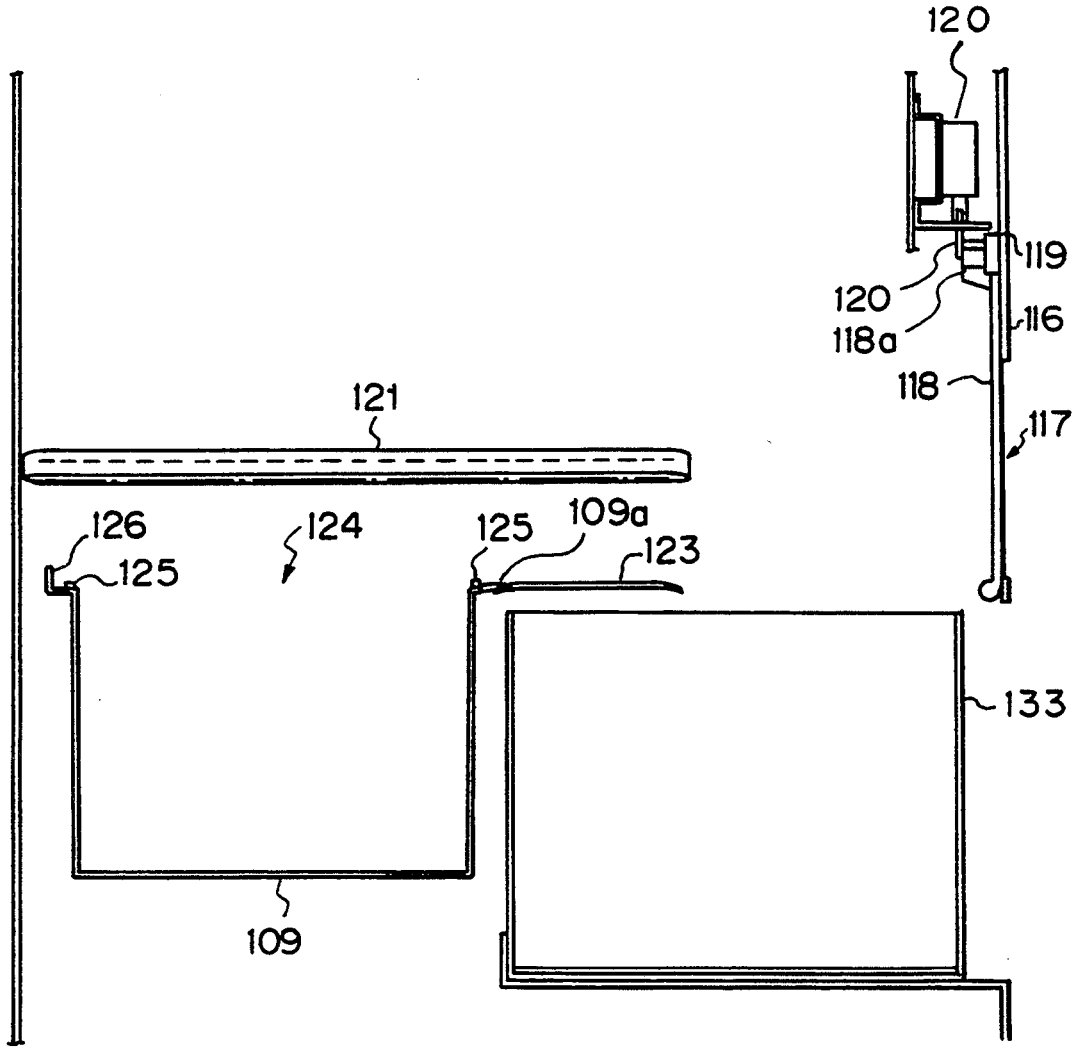
FIG. 18 is a side elevation as viewed from the left, showing the toner supply mechanism before the insertion of the cartridge.

A feeler 130*a*, FIG. 10, is located on the transport path between the box 133 and the hopper opening 124 in order to monitor the transport of the cartridge 112. When the cartridge 112 moves along the transport path, the left portion of the flange 115*a* presses the feeler 130*a* downward with the lower surface thereof. As shown in FIG. 17, the feeler 130*a* is affixed to the free end of an arm 130*d* which is rigidly mounted on a rotatable shaft 130*c*. The shaft 130*c* is constantly biased counterclockwise by a coil spring or similar biasing means, not shown. Also mounted on the rotatable shaft 130*c* is a feeler 130*b*. When the unseal rollers 150 strip the seal member 114 from the bottom of the cartridge 112, the seal member 114 in turn urges the tip of the feeler 130*b* to the left of the equipment. Such a counterclockwise force acting on the shaft 130*c* is selected such that when both the feelers 130*a* and 130*b* are in a free state, the force is balanced with the rotational moment ascribable to, among others, the weight of the arm 130*d*, positioning the lower end of the feeler 130*b* between the light emitting element and the light-sensitive element of the sensor 130.

The operation of the embodiment will be described with reference to FIGS. 18–22, 23 and 24. To begin with, a reference will be made to FIGS. 18–20 and 23 for describing the procedure from the insertion of the toner cartridge 112 to the supply of the toner which occurs at the position above the hopper opening 124.

Figure 19:
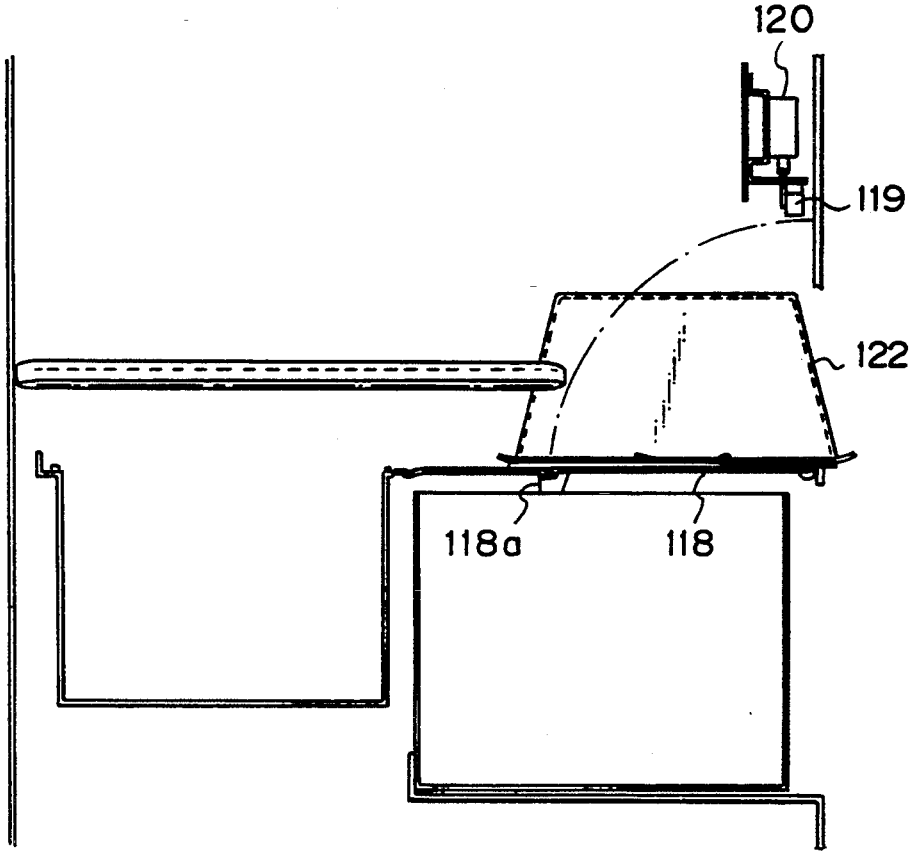
FIG. 19 is a view similar to FIG. 18, showing the mechanism with the cartridge.

The unlock solenoid 120 is usually deenergized by unlock solenoid control which will be described, locking the door 118 of the opening 117 in the closed position. When the cartridge 112 has to be inserted through the opening 117 such as in a toner near end condition, the unlock solenoid 120 is energized to unlock the door 118. Then, the cartridge 112 is inserted into the equipment while being positioned such that the seal member 114 faces downward and the right longer wing 115*b* is located at the right-hand side. At this instant, the leading end of the cartridge 112 forces the door 118 into the equipment. As shown in FIG. 19, the door 118 rotates about the horizontal shaft and stops rotating on tilting about 90 degrees. In this condition, the door 118 has covered part of the opening of the cartridge collecting box 133, preventing the cartridge 112 from falling into the box 133. At the same time, the door 118 cooperates with the transit guides 123 to form a transport path for transferring the cartridge 112 to the hopper opening 124. As soon as the door 118 begins to open, the tip of the projection plate 118 affixed to the inner surface of the door 118 moves out of the gap between the light emitting element and the light-sensitive element of the door sensor 119. As a result, the door sensor 119 is turned on to show that the door 118 has been opened.

Figure 20:
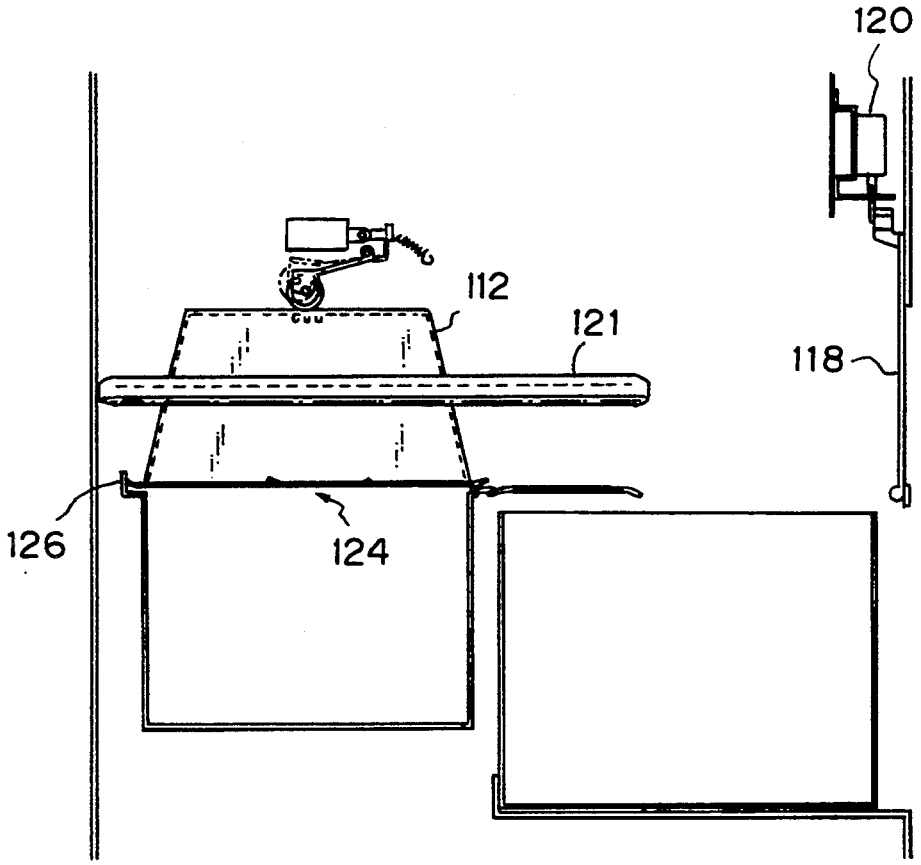
FIG. 20 is a side elevation as viewed from the left, showing the toner supply mechanism in a condition wherein it has completed the transport of the cartridge to a position above a hopper opening.
Figure 23:
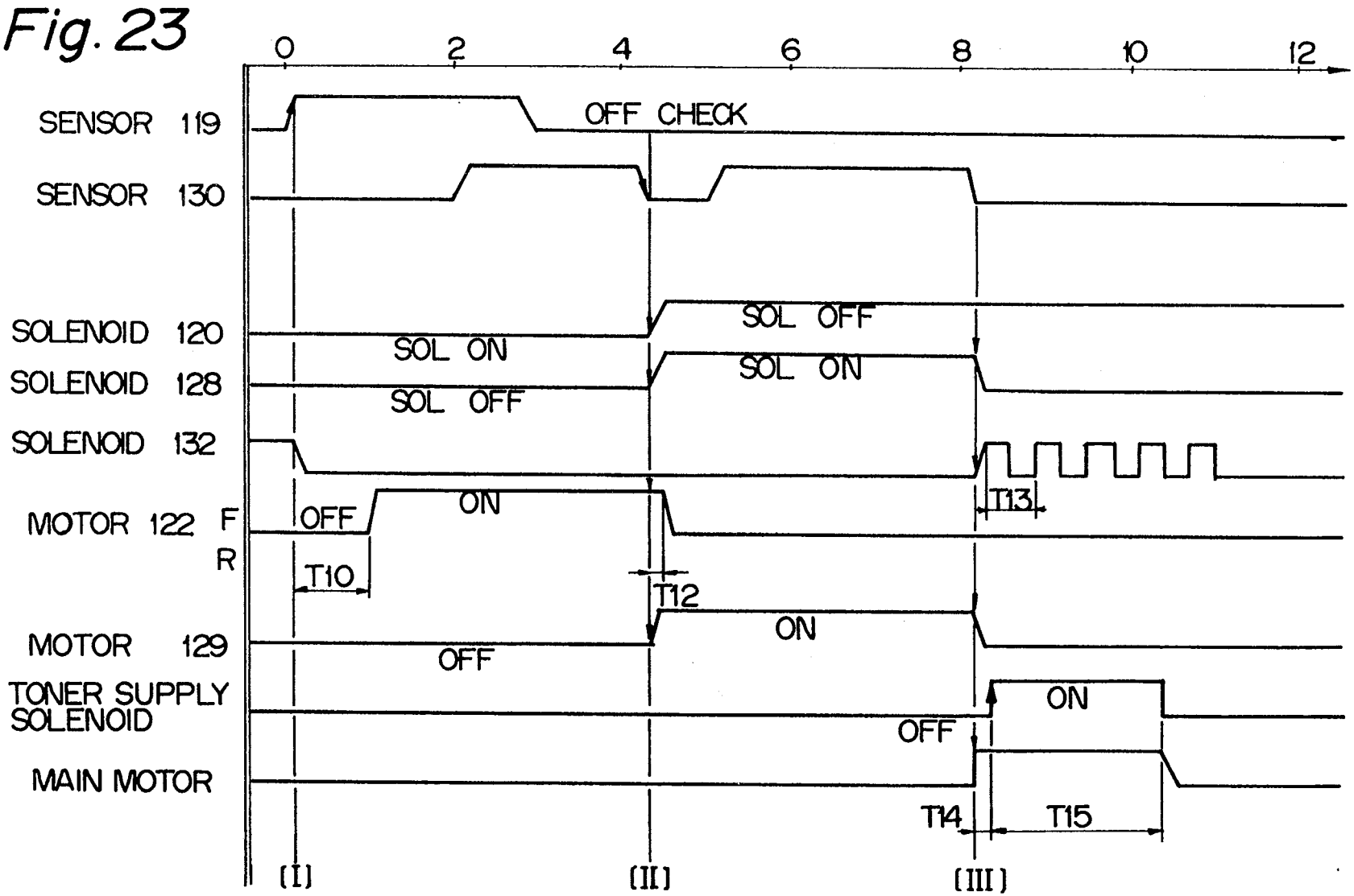
FIG. 23 is a timing chart demonstrating the operation of the toner supply mechanism for loading a cartridge.

When a predetermined period of time expires after the turn-on of the door sensor 119, the motor 122 for transporting the cartridge 112 starts on a forward rotation. The cartridge 112 is, therefore, pulled deeper into the equipment by the belts 121 without resorting to any further manual operation. The cartridge 112 is moved to the position above the hopper opening 124 while being guided by the door 118 and transit guides 123. When the leading end of the cartridge 112 (in the traveling direction of the cartridge 112) arrives at the feeler 130*a*, it turns on the sensor 130. As the trailing end of the cartridge 112 moves away from the sensor 130, the sensor 130 is turned off (FIG. 23, [II]). As the trailing end of the cartridge 112 moves away from the door 118, the door 118 rotates upward to close the opening 117 again, turning off the door sensor 119. At the time when the sensor 130 is turned off (FIG. 23, [II]), the cartridge 112 has reached a position above the hopper opening 124, i.e., a toner supply position and has the leading end thereof abutting against the wall 126. To position the cartridge 112 more positively, the motor 122 is rotated in the forward direction over an extra period of time (FIG. 23, T12). As a result, the cartridge 112 is located at the toner supply position, as shown in FIG. 20. At this instant, the transition from the cartridge transport procedure to a cartridge unsealing procedure occurs.

Specifically, at the time when the sensor 130 is turned off (FIG. 23, circled 2), it is determined that the door 118 has been closed as represented by the output of the door sensor 119. Then, the unlock solenoid 120 is turned off to lock the door 118 in the closed position. The pinch solenoid 128 is turned on to cause the unseal rollers 150 to nip the free left end of the seal member 114. At the same time, the motor 129 is energized to start rotating the rollers 150 with the result that the rollers 150 being to strip the seal member 114 from the bottom of the cartridge 112. Hence, the opening at the bottom of the cartridge 112 is sequentially uncovered. On reaching the feeler 130*b*, the leading edge of the seal member 114 turns on the sensor 130. After the seal member 114 has been fully removed from the cartridge 112, the trailing edge of the seal member 114 actuates the feeler 130*b* to turn off the sensor 130 (FIG. 23, circled 3). This state of the sensor 130 indicates that the bottom of the cartridge 112 has been fully uncovered. Then, the pinch solenoid 128 and motor 129 are deenergized. This is followed by a procedure for letting the toner surely fall from the cartridge 112, as follows.

After the sensor 130 has been turned off (FIG. 3, circled 3), the press solenoid 132 is repetitively turned on and off several times at predetermined intervals (five times in the embodiment). As a result, the roller 131 taps against the top of the cartridge 112 so as to cause the toner remaining in the cartridge 112 to fall into the hopper. Thereafter, the press solenoid 132 in continuously energized to urge the roller 131 against the top of the cartridge 112. Consequently, the lower surface of the flange 115*a* of the cartridge 112 is pressed against the upper surface of the seal 125, FIG. 10, surrounding the hopper opening 124. In this condition, the cartridge 112 plays the role of a lid for closing the hopper opening 124.

Further, when the sensor 130 is turned off (FIG. 23, circled 3), the main motor for driving the toner supply roller 110 and agitator 111 of the developing device 386 is turned on. On the elapse of a delay time (FIG. 23, T14) necessary fo the main motor to reach a steady state, a toner supply solenoid is turned on over a predetermined period of time (FIG. 3, T15) to transmit the rotation of the motor to the roller 110 and agitator 111. As a result, the toner in the hopper 109 is drien into the casing 101. The above-mentioned period of time T15 is determined on the basis of a toner concentration sensed by a toner sensor 360, as will be described later specifically.

Status flags each indicating a particular status included in the above sequence are set (ONE) or reset (ZERO) in a nonvolatile RAM. This allows the above sequence to be continued even when the power source is momentarily shut off while processing is under way.

Figure 22:
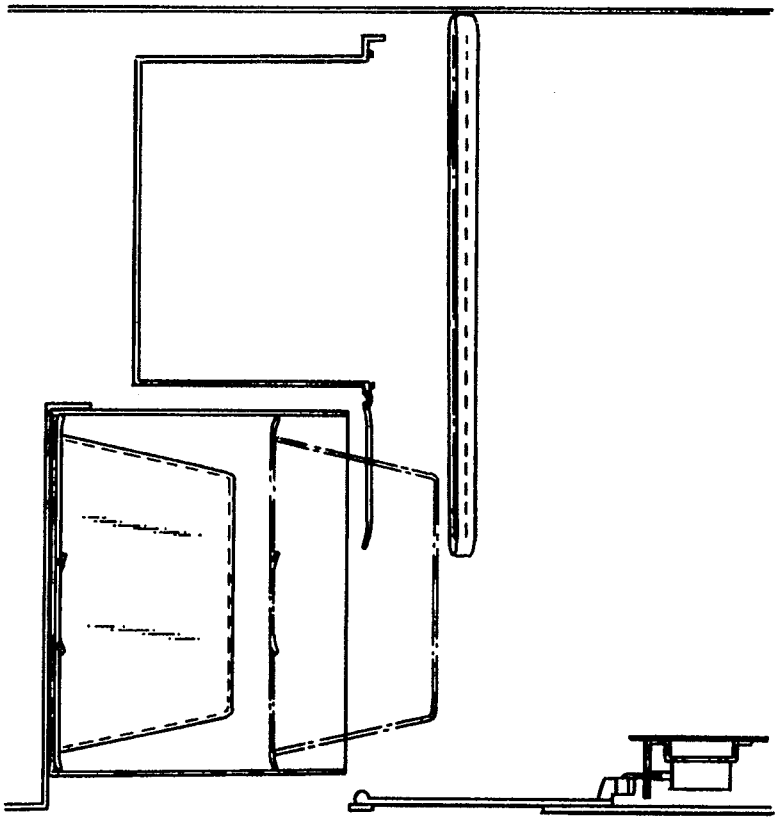
FIG. 22 is a side elevation as viewed from the left, showing how an empty cartridge is collected in a collecting box.
Figure 24:
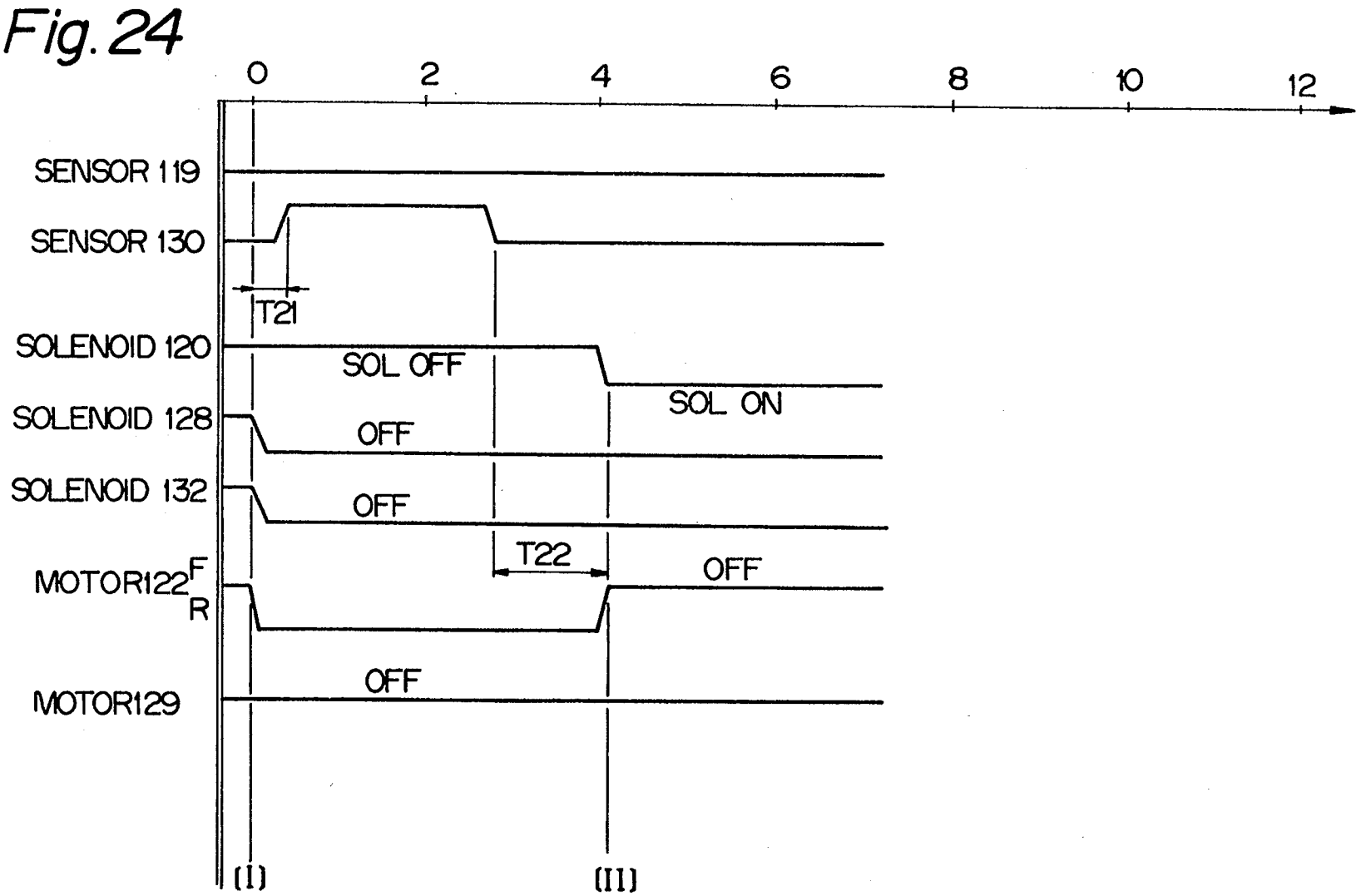
FIG. 24 is a timing chart representative of the reverse transport effected by the toner supply mechanism.

Referring to FIGS. 21, 22 and 24, how the cartridge 112 disposed above the hopper opening 124 is collected in the empty cartridge collecting box 133 will be described. This operation begins in a toner near end condition and after the near end condition has been stored in the nonvolatile RAM. The retraction of the empty cartridge 112 from the hopper opening 124 itself needs only to be completed after, for example, a toner near end condition has occurred and before a new cartridge is inserted. Nevertheless, because the embodiment assigns the role of a lid to the empty cartridge 112 to prevent the toner from being scattered about, it begins to move the empty cartridge 112 toward the collecting box 133 away from the hopper opening 124 by awaiting a toner near end condition.

First, the press solenoid 132 is deenergized to release the roller 131 from the top of the cartridge 112 while the pinch solenoid 128 is deenergized to retract the unseal rollers 150. Then, the motor 122 is reversed to start on the reverse transport of the cartridge 112. After a predetermined period of time which is selected with consideration given to, among others, the sleep rate of the cartridge 112 and transport section has expired, the trailing edge of the cartridge 112 (opening 117 side) arrives at the feeler 130*a* to turn on the sensor 130. As soon as the cartridge 112 bodily moves away from the feeler 130*a*, the sensor 130 is turned off. At this time, the leading ends of the wings 115*b* of the cartridge 112 (hopper opening 124 side) have substantially left the transit guides 123 and are ready to fall. Nevertheless, the reverse rotation of the motor 122 is continued over an extra period o time (FIG. 4, T22) to allow the cartridge 112 to surely reach the position where it should begin to fall, as shown in FIG. 21. The period of time T22 is selected to be longer than the time in which the cartridge 112 falls by gravity and the interval between the time when the cartridge 112 moves away from the sensor 130 and the time when it reaches the drop position (consideration given to a sleep rate and other factors). After the above operation, a counter for counting the empty cartridges 112 in the box 133 and implemented by the nonvoltile RAM is incremented by one. At this time, the device is ready to receive a new cartridge 112. Hence, the unlock solenoid 120 is energized to unlock the door 118 while a near end condition is displayed.

As stated above, in the illustrative embodiment, the cartridge 112 inserted into the body of image forming equipment through the opening 117 by the operator is transported by the belts 121 in the forward direction to a position above the hopper opening 124. At this position, the seal member 114 is striped from the cartridge 112 to let the toner fall into the hopper 109. As soon as the toner is consumed to such an extent that the equipment needs a new cartridge, the empty cartridge 112 is transported in the reverse direction from the hopper opening 124 to the collecting box 133. When the box 133 is filled with such empty cartridges 112, the operator will pull out the box 133 from the equipment and discard the used cartridges 112.

Regarding the toner supply, therefore, the operator has only to inset a full cartridge into the equipment through the opening 117. When the collecting box 133 is filled with empty cartridges 112, all that is required is to pull out the box 133 and discard the cartridges 112. This not only promotes easy attachment and detachment of a cartridge 112 but also minimizes the chance of smears due to the toner.

For example, assume that the cartridge 112 accommodates 300 grams of toner while the collecting box 133 accommodates ten cartridges 112. Then, the eleventh cartridge 11 can be inserted into equipment before the empty cartridges 112 in the box 133 are discarded. It follows that the operator has only to insert cartridges 112 one by one until 3,300 grams of toner has been consumed. By contrast, assume that the mechanism of the embodiment is not used and entirely replaced with a toner hopper, and that a toner is supplied from a bottle or similar container. Then, the capacity of the hopper 109 is limited to one corresponding to substantially four cartridges 114 for layout reasons (see FIG. 12, for example), requiring the operator to supply a toner every time 1,200 grams of toner is consumed.

Figure 27:
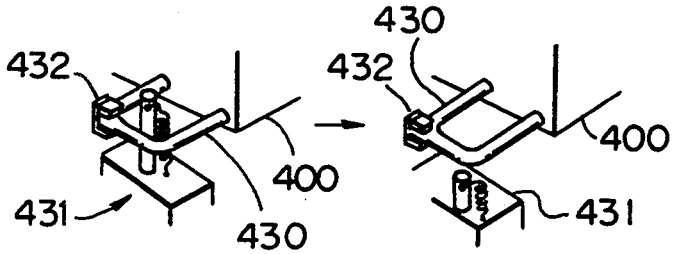
FIG. 27 is a view showing the operation of an arrangement for locking the collecting box in the equipment.
Figure 28:
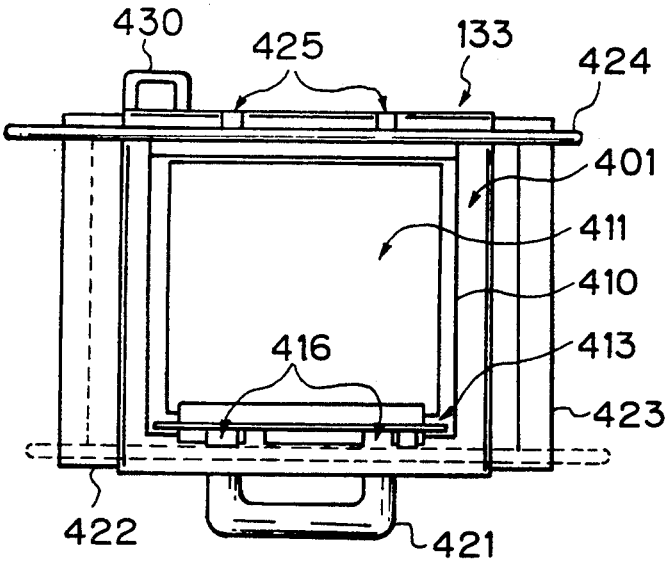
FIG. 28 is a plan view of the collecting box.
Figure 29:
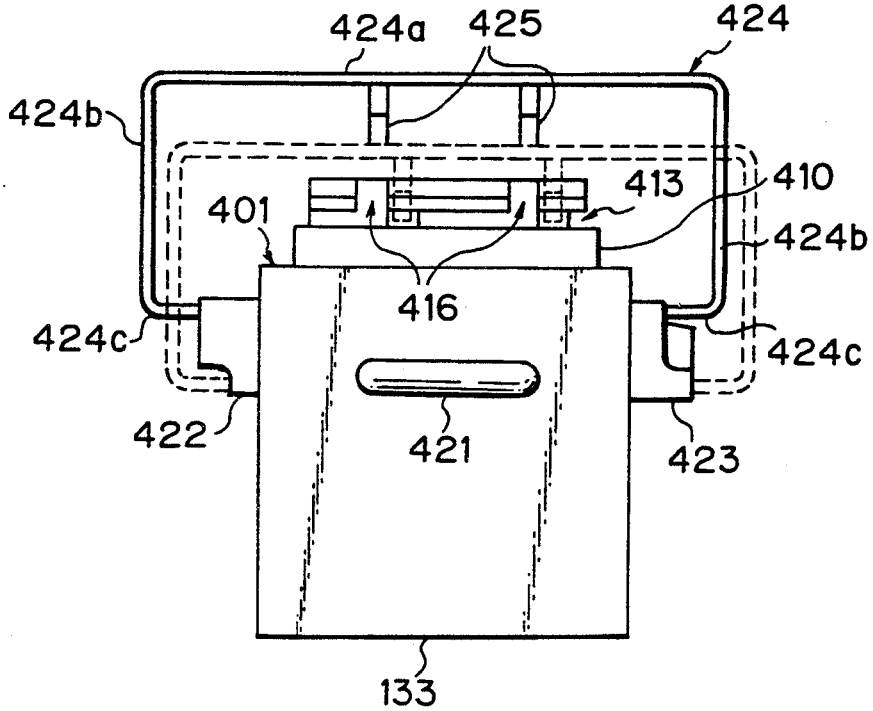
FIG. 29 is a front view of the collecting box.
Figure 30:
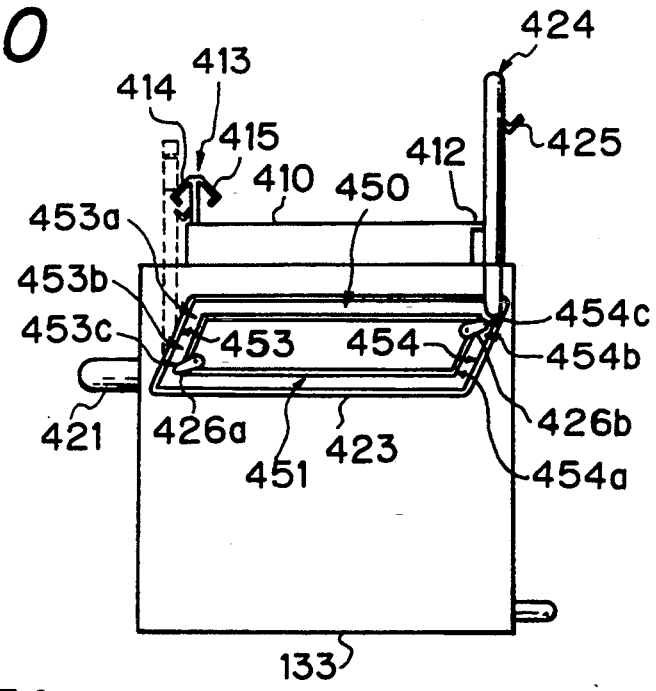
FIG. 30 is a side elevation of the collecting box as viewed from the right.

A reference will be made to FIGS. 25–40 for describing a specific construction of the box 133 for collecting empty cartridges 112. As shown, the box 133 has a removable corrugated cardboard box 410 for directly receiving the empty cartridges 112 thereinside. A know 421 is affixed to the front end of the collecting box 133 while a frame member or locking member 430 is affixed to the lower portion of the rear end of the box 133. As shown in FIG. 27, an unlock solenoid 431 is mounted on the equipment body in such a position that it is disposed below the frame member 430 when the box 133 is set in the equipment body. The unlock solenoid 431 has a plunger extending upward. A spring is associated with the unlock solenoid 431 to constantly bias the plunger toward the outside of the solenoid 431. When the solenoid 431 is deenergized, the plunger is pulled out by the spring to extend into the frame member 430 to thereby lock the box 133 in position. On the other hand, when the solenoid 431 is energized, it pulls the plunger out of the frame member 430 against the action of the spring, thereby unlocking the box 133. A set sensor 432 constituted by a light emitting element and a light-sensitive element is so positioned as to face the frame member 430 when the box 133 is mounted on the equipment body. The corrugated cardboard box 410 accommodated in the collecting box 133 has an opening 411 and a lid member 413 for closing it. The box 133 has a mechanism for moving the lid member 413 in interlocked relation to the movement of the box 133 out of the equipment body so as to close the opening 411. The mechanism is constituted by pawls 425 which are engageable with an upper bent member 414 affixed to the edge of the lid 413, a movable arm 424 to which the pawls 425 are affixed, and guide members 422 and 423 supporting the movable arm 424 movably on the box 133. The movable arm 424 has an upper horizontal portion 424*a* to which the pawls 425 are affixed and extending over a greater width than the body of the box 133, a right and a left arm portion 424*b* extending perpendicularly downward from both ends of the horizontal extension 424*a*, and a right and a left horizontal portion 424*c* extending from the lower ends of the opposite arm portions 424*b* toward each other, i.e., toward opposite sides of the box 133 and perpendicular to the arm portions 424*b*. The guide members 422 and 423 are implemented as a right and a left channel member affixed to opposite sides of the box 133. The channel members 422 and 423 each has a guide channel which received the end of one of the lower horizontal portions 424*c* of the arm 424 and allows it to slide therein. Specifically, the guide channels are each made up of an upper and a lower horizontal channel 450 and 451 having the same length, and a front and a read channel 453 and 454 connecting the horizontal channels 450 and 451 at the front and rear ends. The channel 450 is closer to the rear end of the box 133 than the channel 451, so that the channels 453 and 454 are inclined accordingly. The bottom of each upper horizontal channel 450 is configured to guide the arm 424 in a position relatively shifted to the left, as indicated by a solid line in FIG. 29. The bottom of each lower horizontal channel 451 is configured to guide the arm 424 in a position relatively shifted to the right, as indicated by a phantom line in FIG. 29. The front inclined channel 453 guides the arm 424 from the front end of the upper horizontal channel 450 to the front end of the lower horizontal channel 451. Specifically, the channel 453 has a first inclined portion 453*a* having a bottom which guides the arm 424 at the same position as the upper channel 450, a first shift portion 453*b* having a guide which guides the arm 424 while shifting it to the right, and a second vertical portion 453*c* having a guide which guides the arm 424 at the same position as the lower channel 451. A first eccentric member 426*a* is positioned at the corner where the lower end of the second vertical portion 453*c* merges into the lower channel 451. The eccentric member 426*a* is rotatable about an eccentric shaft to allow the arm 424 to move the vertical portion 453*c* to the lower channel 451 but to inhibit the arm 424 from moving from the channel 451 to the vertical portion 453*c*. The rear inclined channel 454 guides the arm 424 from the rear end of the lower channel 451 to the rear end of the upper channel 450. The channel 454, like the channel 453, has a third vertical portion having a bottom which guides the arm 424 at the same position as the upper channel 451, a second shift portion 454*b* having a bottom which guides the arm 424 while shifting it to the left, and a fourth vertical portion 455*c* whose bottom is configured to guide the arm 424 at the same position as the upper channel 450. A second eccentric member 426*b* is located at the corner where the upper end of the vertical portion 454*c* merges into the upper channel 450. The eccentric member 426*b* allows the arm 424 to move from the vertical portion 454*c* to the upper channel 450 but inhibits it from moving in the other direction. The upper channels 450 are located at such a level that while the arm 424 is guided thereby, the pawls 425 of the arm 424 do not contact the bent member 414 of the lid member 413. Conversely, the lower channels 451 are located at such a level that while the arm 424 is guided thereby, the pawl 425 are engageable with the bent member 414.

Figure 40:
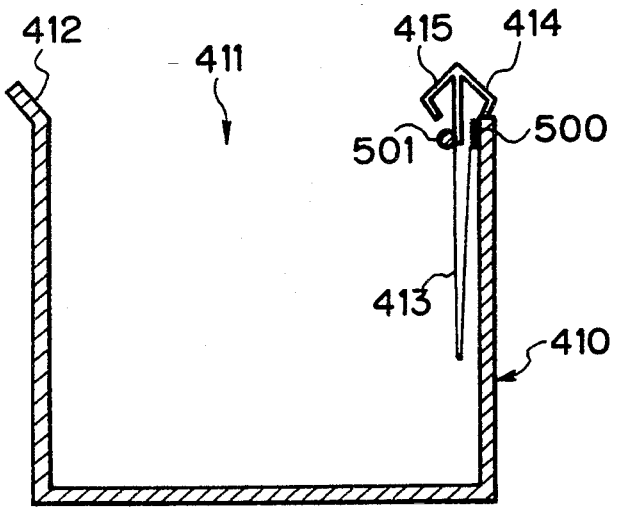
FIG. 40 is a section of the cardboard box.

The lid member 413 for closing the opening 411 of the cardboard box 410 is implemented as a flexible sheet. The lid member 413 is affixed to the inner surface of the front end of the cardboard box 410 with respect to a condition wherein the box 410 is accommodated in the collecting box 133. For example, as shown in FIG. 40, the rear end of the lid member 413 is connected to the inner surface of the box 410 by adhesive and received in the box 410 in a folded position. In FIG. 40, the reference numerals 500 and 501 designate respectively an area where the lid member 413 is adhered and a guide rod for guiding the member 413 when the latter is pulled out. The previously mentioned upper bent portion 414 and a lower bent portion 415 are provided on the front end of the lid member 413. Notches 416 are formed in the upper bent member 414 in positions which the pawls 425 of the arm 424 face when the arm 424 is guided by the first shift portion 453*b* or the second shift potion 454*b* of the guide channel. The cardboard box 410 has an upwardly inclined portion 412 at the upper edge of the rear end thereof. When the lid member 413 closes the opening 411, the lower bent member 415 of the lid member 413 is caught by the inclined portion 412.

As shown in FIGS. 36–39, a support member is provided on the inner surface of the front panel 116 of the equipment body at both sides of an opening 166*a* through which the collecting box 133 may be pulled out. The support member supports the arm 424 such that the arm 424 is freely movable in a plane parallel to the panel 116 while remaining in an upright position. Specifically, a base 440 is mounted on the front panel 116 and perpendicular to the latter. A front support arm 443 is affixed to the base 440 at one end thereof and extends from the base 440 to the inside of the opening 116*a* in parallel to the panel 116. The support arm 443 has a vertical support surface. A rear support member 442 is rotatably mounte on the base 440 by a shaft 445 which is parallel to the panel 116. The rear support member 442 has an upper and a lower support rod 441 extending to the inside of the opening 116*a* in parallel to the front support arm 443. Biasing means, no shown, constantly biases the rear support member 442 such that the support member 442 tends to rotate upward. A stop 444 is provided on the base 440 and usually abuts against the rear support member 442 to prevent if from rotating. In this condition, the support rods 441 are aligned in the vertical direction. The portion of the vertical support member of the arm 443 and the portions of the support rods 441 each extending to the inside of the opening 116*a* correspond in length, as measured in the horizontal direction, to the displacement of the arm 424 caused by the guide members in the right-and-left direction. The arm portion 424*b* of the arm 424 is interposed between the aligned support rods 441 and the vertical surface of the support arm 443.

The collecting box 133 having the above configuration assumes the position shown in FIGS. 28–30, 38 and 39 when pulled out from the equipment body to the extreme position. As shown, the ends of the lower horizontal portions 422*c* of the arm 424 are located at the rear ends of the upper channels 450 of the guide members and inhibited from entering the rear inclined channels 454 by the second eccentric members 426*b*. The arm portions 424*b* are supported by the support members incorporated in the equipment body. Hence, the arm 424 assumes the high level in the up-and-down direction and the leftmost position in the right-and-left direction, as viewed from the front. In this condition, the corrugated cardboard box 410 can be put in or taken out of the collecting box 133.

Figure 25:
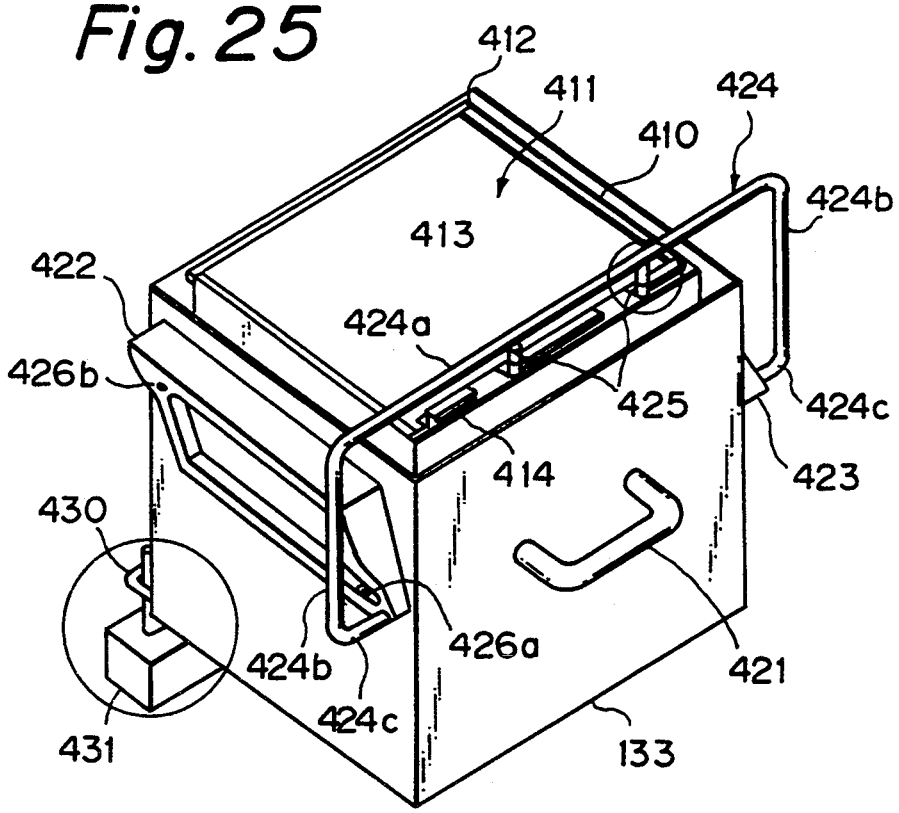
FIG. 25 is a perspective view of the collecting box.
Figure 26:
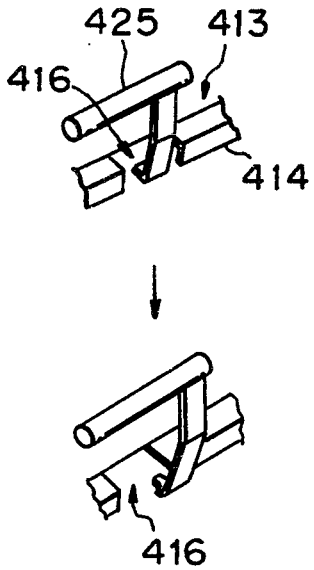
FIG. 26 is a view showing the operation of an arrangement which moves a lid member provided on a corrugated cardboard box accommodated in the collecting box.
Figure 35:
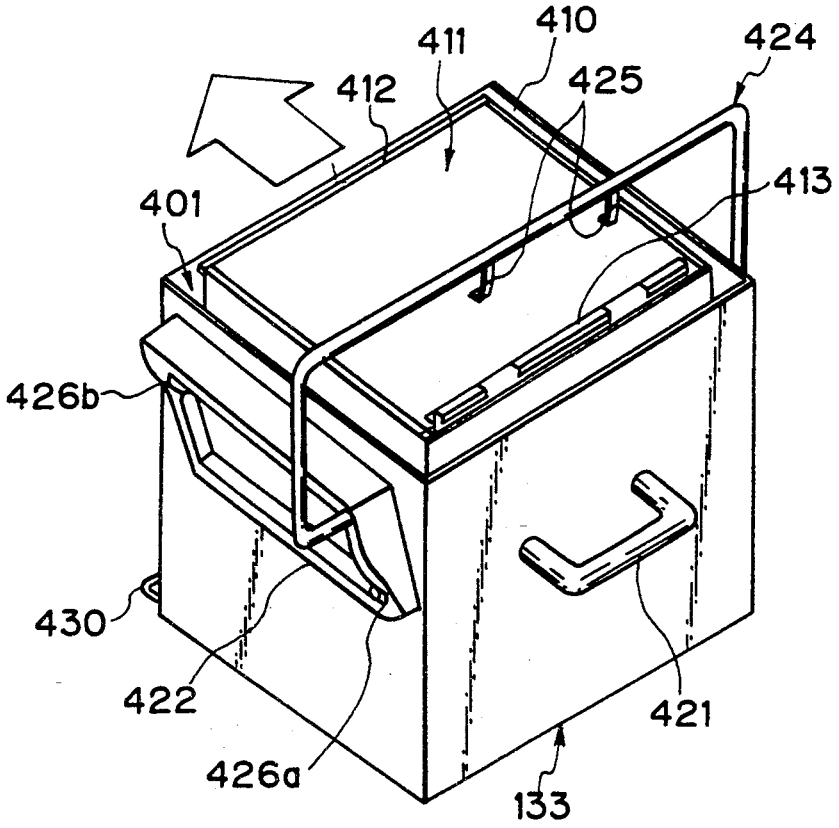
FIG. 35 is a perspective view of the collecting box which is about to be inserted into the equipment body.
Figure 36:
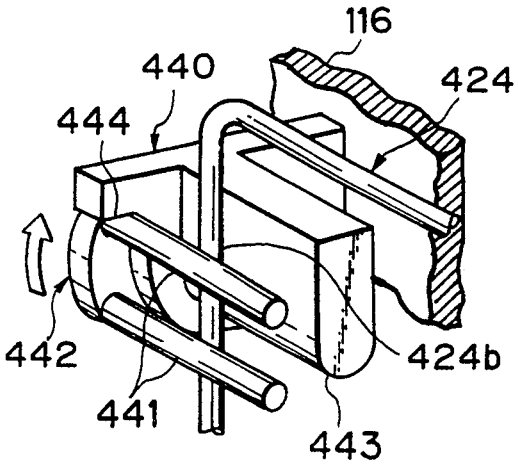
FIG. 36 is a fragmentary perspective view of an arrangement for supporting an arm provided on the collecting box.

After setting a new cardboard box 410 in the collecting box 133, the operator begins to insert the box 133 into the equipment body. Then, the arm portions 424*b* of the arm 424 are supported by the support members mounted on the equipment body in the predetermined position. The arm 424 is moved relative to the box 133 while being guided by the upper channels 450 of the guide members, until the lower horizontal portions 424*c* reach the front ends of the associated channels 450, as shown in FIG. 35. As the box 133 is inserted deeper into the equipment body, the lower horizontal portions 422 are guided by the front inclined channels 453 of the guide members with the result that the arm 424 is bodily lowered. At the same time, the arm 424 is bodily shifted to the right by the first shift portions 453*b* of the channels 453, as shown in FIG. 25. As shown in FIG. 25, the pawls 425 of the arm 424 pass the notches 416 of the upper bent member 414 of the lid member 413 while the arm 424 is bodily lowered. Further, the pawls 425 come to engage with the upper bent member 414 while the arm 424 is bodily shifted to the right. When the pawls 425 pass the corners where the front channels 453 and lower channels 451 join, they rotate the associated first eccentric members 426*a*. Thereafter, the eccentric members 426*a* are restored to prevent the pawls 425 from returning to the front channels 453. When the collecting box 133 is fully inserted into the equipment body, the set sensor 432 senses the frame member 430 provided on the rear end of the box 133. Then, the unlock solenoid 431 is turned off and has its plunger pulled out by the spring. As a result, the plunger protrudes into the frame member 430 to lock the box 133 in position. Under this condition, the previously stated copying operation is performed.

Figure 31:
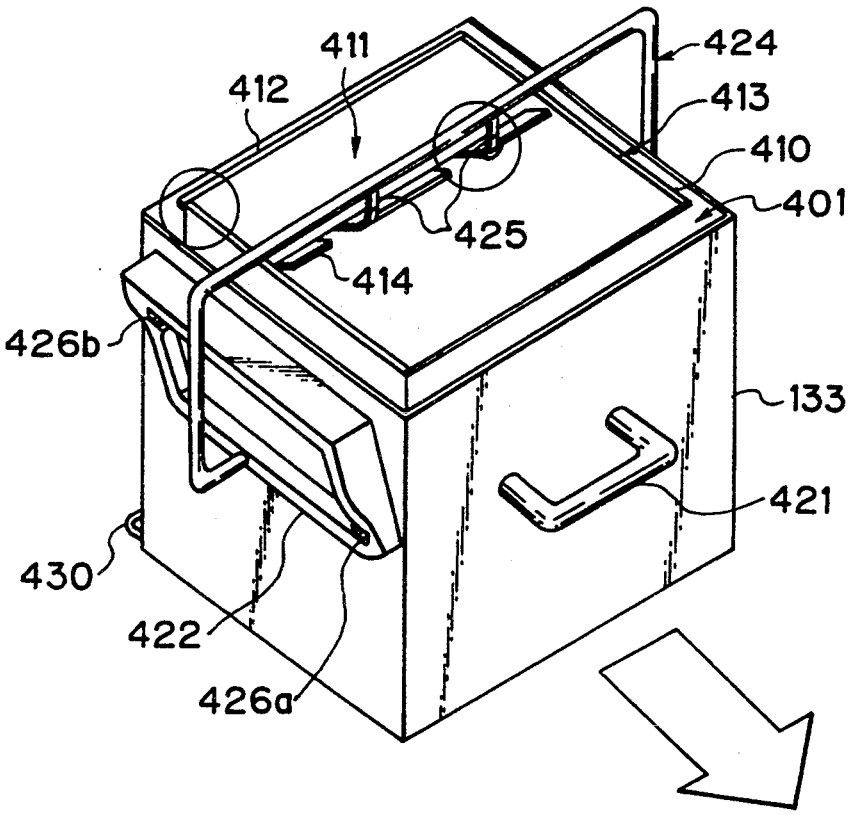
FIG. 31 is a perspective view showing the collecting box being pulled out from the equipment body.
Figure 32:
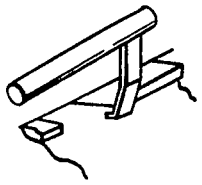
FIG. 32 is an enlarged perspective view of the end of the lid member provided on the cardboard box.
Figure 33:
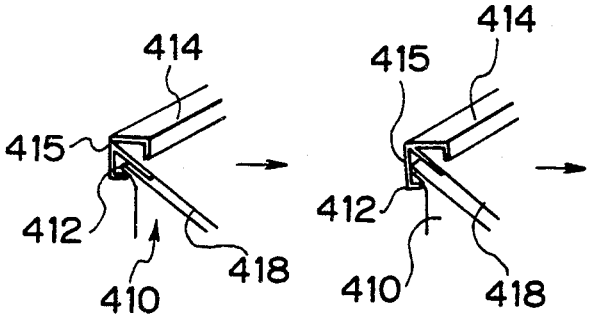
FIG. 33 is a view showing an arrangement for closing the lid of the cardboard box.
Figure 34:
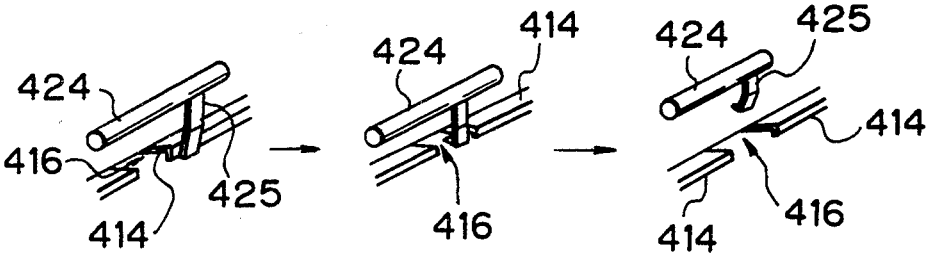
FIG. 34 is a view showing the lid moving arrangement in a condition near the end of operation.

Assume that the cardboard box 410 has been filled with a predetermined number of empty cartridges 112 and needs to be replaced with a new cardboard box 410. Then, the unlock solenoid 431 is turned on by a procedure which will be described. As the plunger of the solenoid 431 is retracted from the frame member 430, the collecting box 133 can be pulled out of the equipment body. As the operator begins to pull out the collecting box 133, the arm 424 is supported by the support members and assumes a predetermined position. Hence, as shown in FIG. 31, the arm 424 is moved relative to the box 133 while being guided by the lower channels 451 of the guide members. As a result, the lid member 413 having the upper bent member 414 thereof engaged with the arms 425 is sequentially pulled out of the cardboard box 410 to thereby cover the opening 411 of the box 410. After the lower horizontal portions 424*c* of the arm 424 have reached the rear ends of the lower channels 451 of the guide members, they are guided by the rear inclined channels 454 with the result that the arm 424 is bodily raised. While the lower portions 424*c* of the arm 424 are guided by the second shift portions 454*b* of the channels 454, the whole arm 424 is shifted to the left. As shown in FIG. 34, while the whole arm 424 is shifted to the left, the pawls 425 are moved to the notches 416 of the upper bent member 414 of the lid member 414. Then, as the arm 424 is bodily raised, the pawls 425 leave the notches 416 upward. As shown in FIG. 33, the lower bent member 415 of the lid member 413 is caught by the upward inclined portion 412 of the box 410. As the box 133 is further pulled out, the arm 424 reaches the upper channels 450 while rotating the second eccentric members 426*b*.

Figure 37:
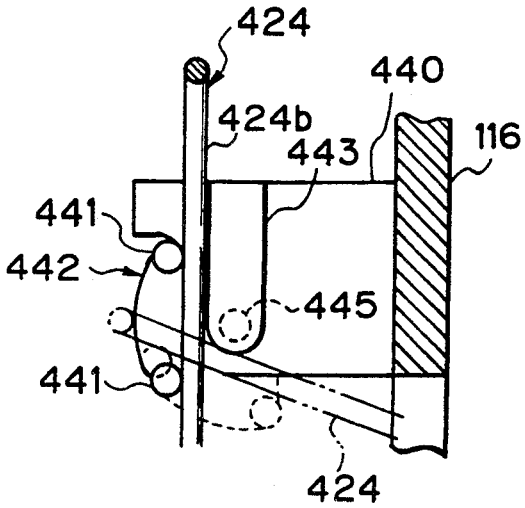
FIG. 37 is a fragmentary side elevation of the arrangement of FIG. 36 as viewed from the left.
Figure 38:
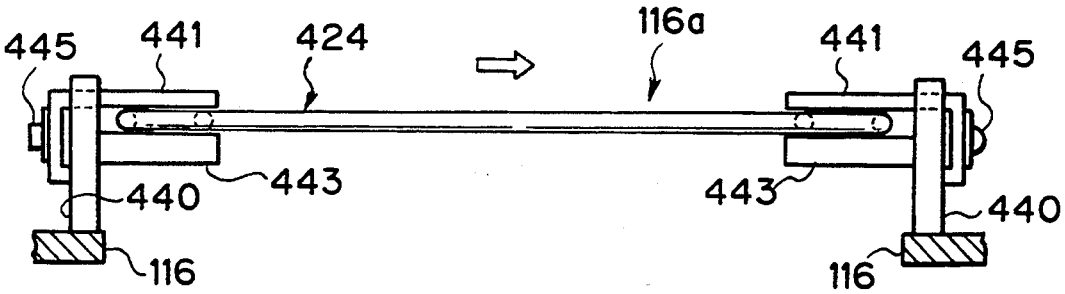
FIG. 38 is a plan view of the support arrangement.
Figure 39:
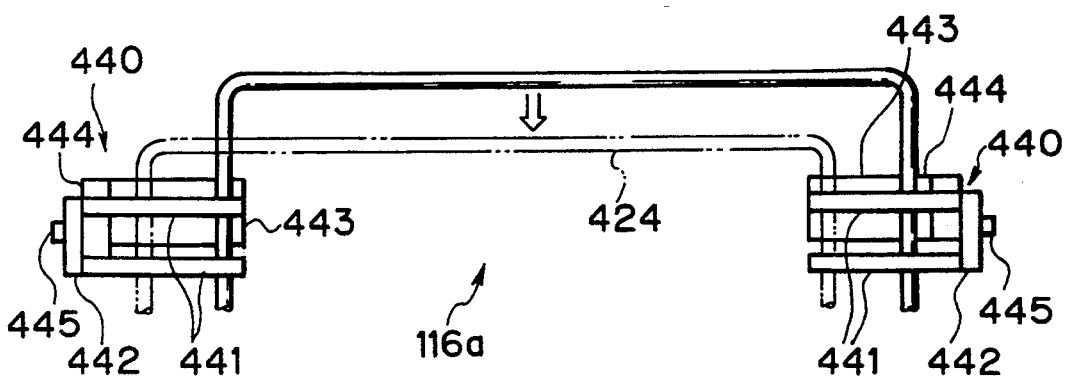
FIG. 39 is a rear end view of the support arrangement.

As the operator pulls the collecting box 133 further outward from the outermost position, the rear support members 442 of the support members are rotated, as shown in FIG. 37. As a result, the box 133 can be bodily removed from the equipment body because the arm portions 424*b* of the arm 424 slip out of the front support arms 443 and upper and lower support rode 441 while tilting from the upright position.

Assume that after the cartridge 112 has been inserted into the equipment body and started to be driven toward the toner supply position, the leading end of the cartridge 112 fails to reach the feeler 130*a* within a predetermined period of time. Then, a cartridge jam detection procedure is executed, as will be described with reference to FIG. 41. This procedure occurs in the former half of the interval between the times indicated by encircled 1 and 2 in FIG. 23.

So long as the cartridge 112 is not inserted into the equipment body, the door open sensor 119 does not produce a buildup signal or turn on. In this condition, the program executes the iterative loop of steps 1–5, i.e., resets a jam flag, turns off a jam indicator, and resets a retry counter. On the insertion of the cartridge 112, the door open sensor 119 is turned on. In response, the program starts a jam timer (step 6) and sets an insert flag (7). As the door open sensor 119 turns on, whether or not the sensor 130 has turned on is determined (8). At this stage of operation, a predetermined period of time is necessary for the sensor 130 to turn on by having the feeler 130*a* thereof actuated by the leading end of the cartridge 112 after the insertion of the cartridge 112. Hence, the program advances to a step 9 to see if the jam timer started at the turn-on of the door open sensor 119 has exceeded a set value T6. If the answer of the step 9 is negative, the program returns to the step 1. This is repeated until the sensor 130 turns on as determined in the step 8 or until the jam timer has exceeded the time T6 as determined in the step 9. The time T6 is the sum of the interval between the turn-on of the door open sensor 119 and the arrival of the leading end of the cartridge 112 at the feeler 130*a* and a scattering $\alpha$. Whether or not the cartridge 112 has jammed the path is determined on the basis of the relation of the count of the jam timer and the set value T6.

When the cartridge 112 is transported in a normal condition, the leading end thereof reaches the feeler 130 of the sensor 130 before the time T6 expires. On the turn-on of the sensor 130, the program resets the retry counter (5) and then returns to the step S1. On the other hand, when the cartridge 112 is not transported in a normal way due to a tilt or similar cause, the jam timer exceeds the set value T6. Then, the step 9 is followed by a step 10 for executing jam processing. Briefly, in the jam processing, the program tries to restore the cartridge 112 to a correct position on the transport path by repeating the steps of stopping the forward rotation of the motor 122, reversing it, and again causing it rotate in the forward direction up to, for example, three times, while determining whether or not the sensor 130 turns on. If the sensor 130 does not turn on even after such steps have been repeated three times, the program turns on the jam indicator and deenergizes the motor 122.

Specifically, whether or not the retry counter has exceeded 3 is determined (10). If the answer of the step 10 is negative, the motor 122 is stopped for 500 milliseconds (11), reversed for 2 seconds (12), and the retry counter is incremented (13). Subsequently, the motor 122 is stopped again (14) and then rotated in the forward direction (15), and the jam timer is reset and then restarted (16). This is followed by the step 8. At this time, because the step 8 immediately follows the first retry, the program advances to the step 9 determining that the sensor 130 has not turned on. In the step 9, too, the program determines that the jam timer has not exceeded the set value T6 because it immediately follows the restart of the jam timer, returning to the step 1. If the cartridge 112 is successfully transported by the first retry, the sensor 130 turns on before the jam timer exceeds the set value T6. Then, the step 8 is followed by the step 5 for resetting the retry counter. However, if the cartridge 112 fails to regain the expected position despite the first retry, the jam counter exceeds the set value T6 without the sensor 130 turning on. In this case, the second retry, the increment of the retry counter, and the restart of the jam timer are executed (10–16), followed by the step 8. Thereafter, the program executes the same procedure as after the first retry, until the sensor 130 turns on (8) or the jam timer exceeds T6 (9).

If the cartridge 112 fails to regain the correct position even after the second retry, the jam timer again exceeds T6 with the sensor 130 held in the OFF state. This is followed by the third retry, the increment of the retry counter, and the restart of the jam timer. If the third retry fails to restore the cartridge 112 to the expected position, the retray counter is incremented to 3. Then, a jam flag is set (17), the jam indicator is turned on (18), and the motor 122 is deenergized (19). In this condition, the program waits until the operator removes the cartridge 112 jamming the transport path. As soon as the operator removes the jamming cartridge 112 and then closes the door 118, the door open sensor 119 turns off. In response, the steps 1, 2, 3 an 5 are executed to reset the jam flag, turn off the jam indicator, and reset the retry counter.

As stated above, when the transport of the cartridge 112 is disturbed due to some inclination thereof or similar cause, it is restored to a normal condition. Even if such a transport error cannot be removed, a serious condition otherwise brought about by the continuous drive of the motor 122 is eliminated while the operator is informed of the jam.

Assume that a cartridge 112 inserted in a toner near end condition jams the transport path and, therefore, the motor 122 is deenergized. Even in such a condition, the image forming operation itself can be continued with the motor 122 deenrgized or if the jamming cartridge 112 is removed from the transport path. However, the casing 101 will soon run out of toner because the supply of toner from a new cartridge 112 is not available. The illustrative embodiment inhibits the image forming operation by a particular procedure which will be described, as soon as a toner end condition occurs.

Figures 42, 42A, 42B:
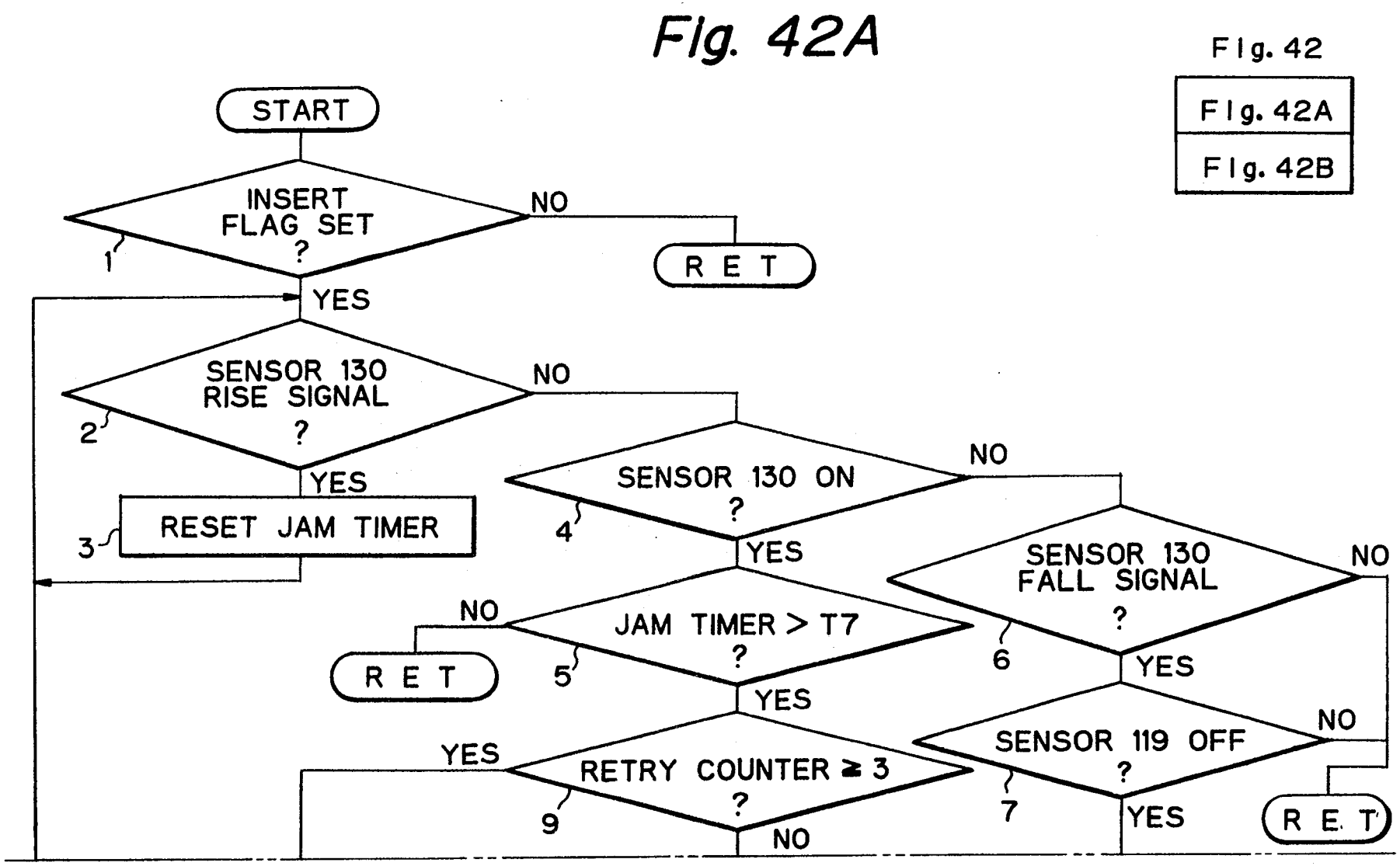
Figure 42B:
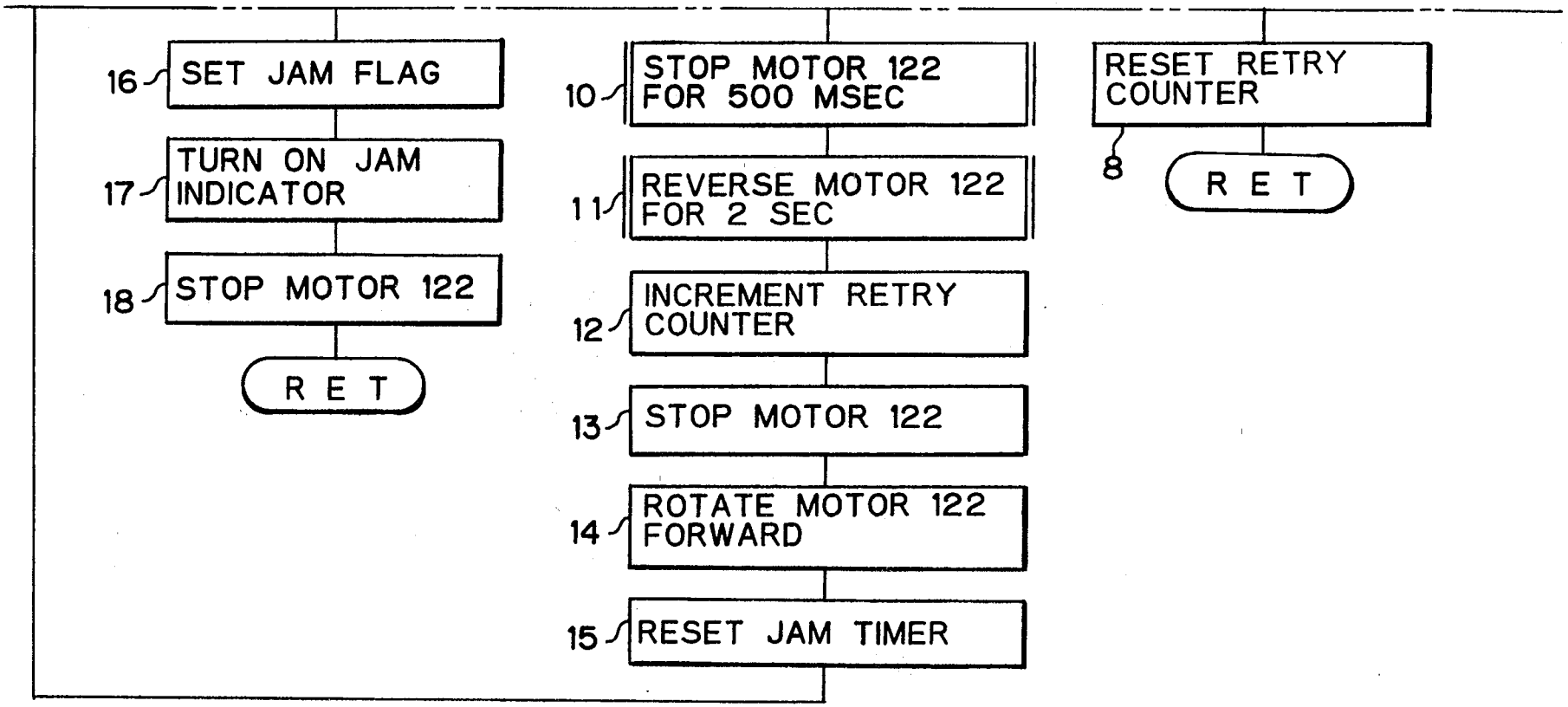

Hereinafter will be described a procedure to be executed when a predetermined period of time expires after the leading end of the cartridge 112 has arrived at the feeler 130*a* of the sensor 130 and before the trailing end thereof moves away from the feeler 130*a*, shown in FIG. 42. Such a procedure occurs in the latter half of the interval between the times indicated by circled 1 and 2 in FIG. 23.

Figures 41, 41A, 41B:
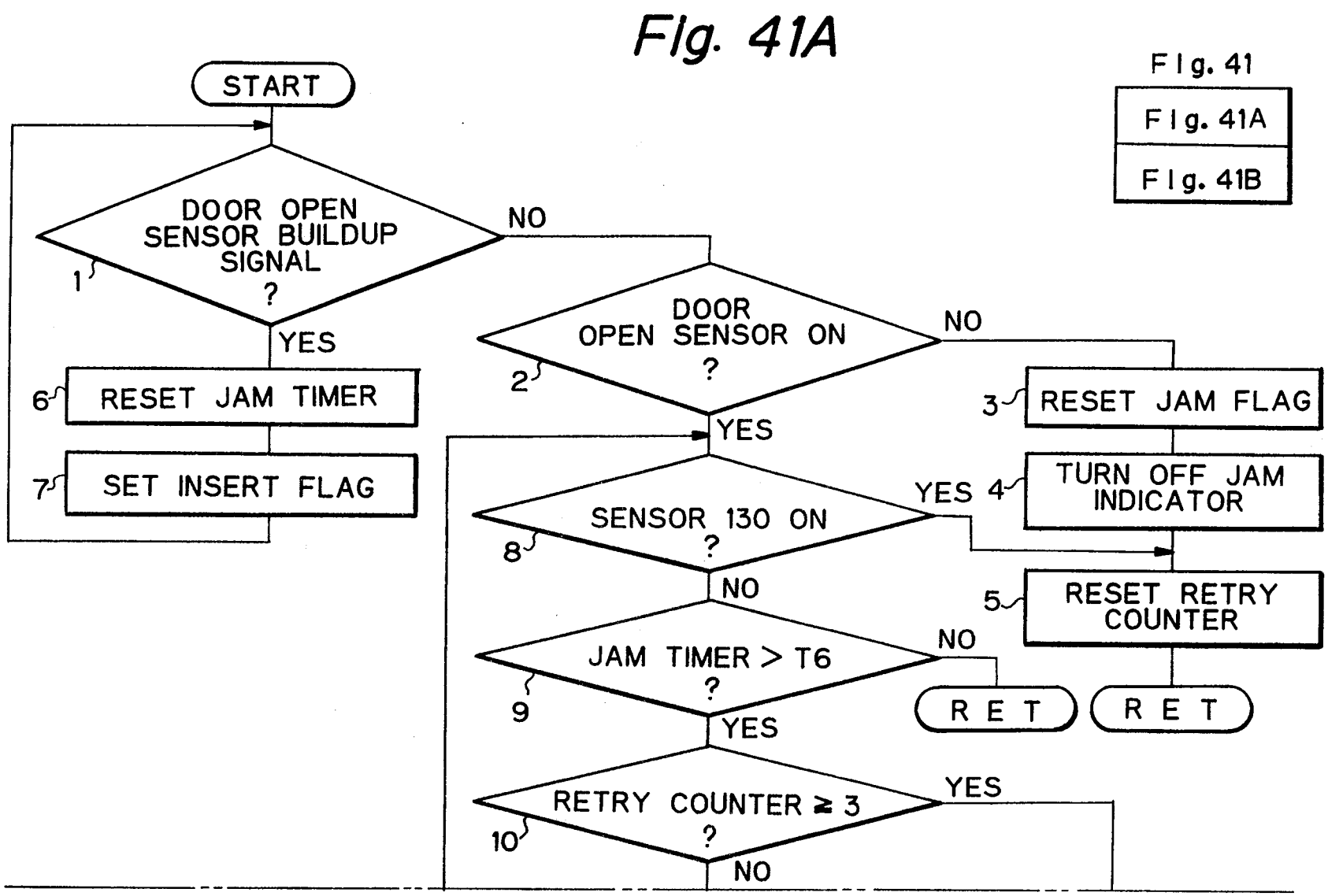
FIGS. 41A, 41B, 42A, 42B, 43A, 43B, 44A, 44B, 45A, 45B, 46A, 46B, 47A, 47B, 48A, 48B, 49, 50, 51A, 51B, 52, 53A, 53B, and 54 are flowcharts each showing a particular control procedure to be executed by the embodiment.
Figure 41B:
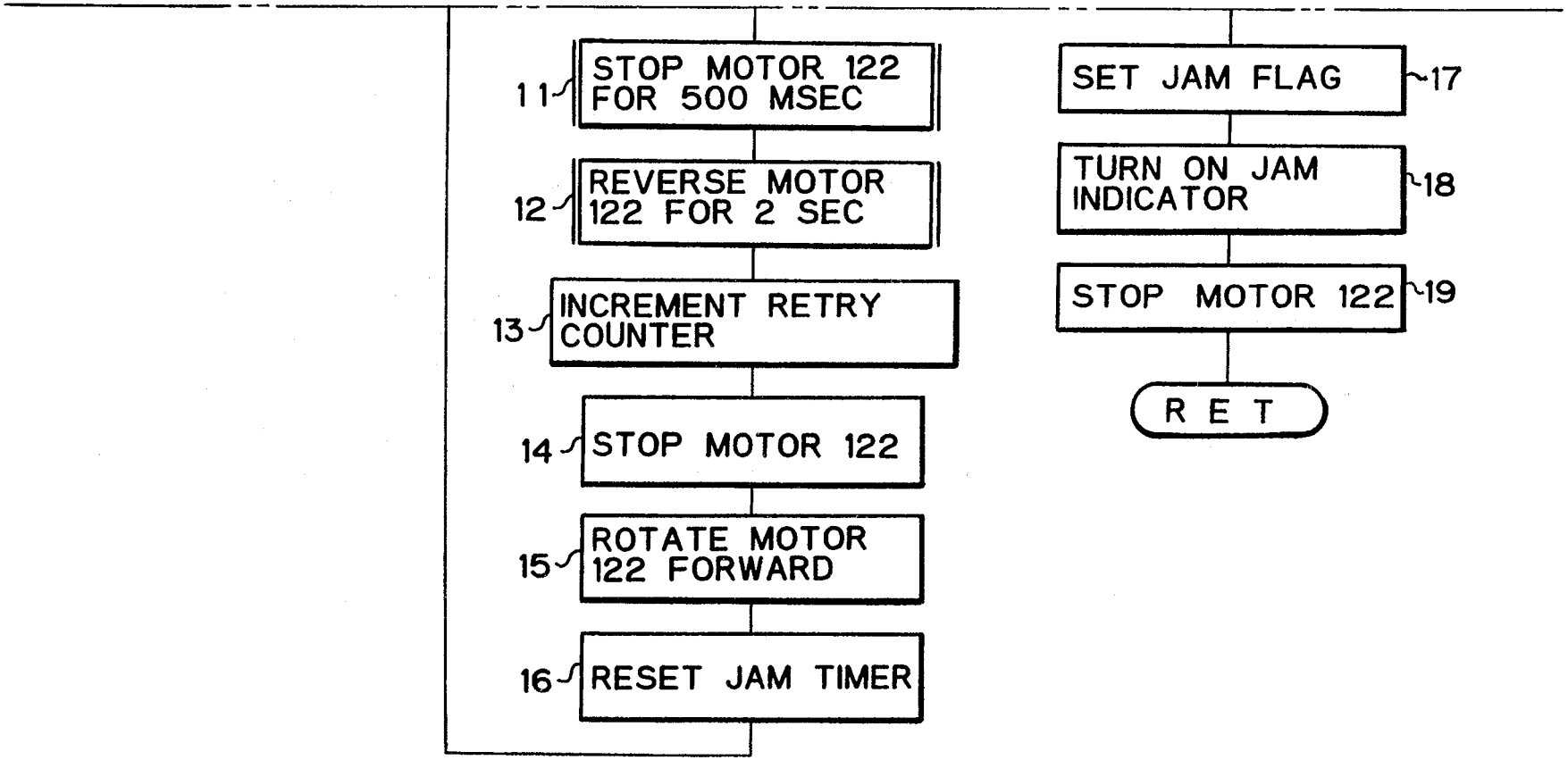

Specifically, assume that the cartridge 112 inserted into the equipment body is transported in a normal condition without the motor 122 being deenergized by the previously stated jam processing (see FIG. 41, step 19). In this condition, the insert flag is set, and the sensor 130 is in an ON state because the leading end of the cartridge 112 has moved away from the feeler 130 and the left portion of the flange 115*a* is pressing the feeler 130*a* downward with the underside thereof. When the leading edge of the cartridge 112 arrives at the feeler 130*a* to cause the sensor 130 to turn on, steps 1–3 are executed to start a jam timer and then followed by steps 4 and 5 for determining whether or not the sensor 130 has turned on. Specifically, whether or not the leading end of the cartridge 112 has actuated the feeler 130*a* to turn on the sensor 130 is determined. At this instant, a predetermined period of time is necessary for the trailing end of the cartridge to move away from the feeler 130*a*, i.e., for the sensor 130 to turn off after the leading end of the cartridge has reached the feeler 130*a*. Therefore, the program advances from the step 4 to the step 5 to see if the jam timer has exceeded a set value T7 and then returns to the step 1. Thereafter, the steps 1, 2, 4 and 5 are repeated until the answer of the step 5 changes to positive or the answer of the step S4 changes to negative. The set value T7 is the sum of the interval between the time when the sensor 130 turns on due to the arrival of the leading end of the cartridge 112 at the feeler 130*a* and the time when the trailing end of the cartridge 112 moves away from the feeler 130*a* and a scattering $\alpha$. Whether or not the cartridge 112 has jammed the path around the feeler sensor 130 is determined on the basis of the relation between the content of the jam timer and the set value T7.

So long as the transport of the cartridge 112 is normal, the trailing end of the cartridge 112 moves away from the feeler 130*a* and, therefore, the sensor 130 turns on before the jam timer exceeds T7. Because the trailing end of the cartridge 112 has already moved away from the free end of the door 118 and the door 118 has regained the closed position, the door open sensor 119 is in OFF state. Hence, the program advances from the step 4 to the steps 6–8 to reset the retry counter. On the other hand, when the cartridge 112 is not transported in a normal condition due to the tilt of the cartridge or similar cause, the jam timer exceeds T7. Then, the step 5 is followed by a step 9 to execute jam processing, as follows.

In the jam processing, the program tries to restore the cartridge 112 to the expected position by repeating the steps of stopping the forward rotation of the motor 122, reversing it, and again causing it to rotate in the forward direction up to, for example, three time while determining whether or not the sensor 130 turns on. If the sensor 130 does not turn on even after the three times of retry, another jam indicator assigned to this kind of jam is turned on while the motor 122 is deenergized. Specifically, whether or not a retry counter assigned to such a jam has exceeded 3 is determined (9). If the answer of the step 9 is NO, the motor 122 is deenergized for 50 milliseconds (10) and then reversed for 2 seconds (11), and the retry counter is incremented (12). Then, the motor 122 is again deenergized (13) and caused into a forward rotation (14). The jam timer is reset (15) and then restarted (15). Thereafter, the program returns to the step 2. At this time, because the step 2 immediately follows the first retry, the program executes the steps 2, 4 and 5 determining that the sensor 130 is in an ON state. In the step 5, too, the program returns to the step 1 determining that the jam timer has not exceeded T7. Then, the steps 1, 2 4 and 5 are repeated until the sensor 130 turns on (S4) or the jam timer exceeds T7 (S5).

If the first retry successfully restores the cartridge 112 to the expected condition, the trailing edge of the cartridge 112 moves away from the feeler 130 to turn off the sensor 130 before the jam timer exceeds T7. Because the trailing end of the cartridge 112 has already moved away from the free end of the door 118 and the door 118 has regained the closed position, i.e., the door open sensor 119 has turned off. In this condition, the step 4 is followed by the steps 6–8 to reset the retry counter. On the other hand, if the transport condition of the cartridge 112 is not corrected despite the first retry, the jam counter exceeds T7 without the senor 130 turning off. Then, the step 5 is followed by the steps 9–15 for effecting the second retry, the increment of the retry counter, and the restart of he jam timer. Thereafter, the steps 1, 2, 4 and 5 are repeated until the answer of the step 4 changes to negative or the answer of the step 5 changes to positive.

If the cartridge 112 fails to regain the expected position even after the second retry, the jam timer again exceeds T7 without the sensor 130 turning off. Then, the step 5 is again followed by the steps 9–15 for effecting the third retry, the increment o the retry counter, and the restart of the jam timer. If the third retry fails to restore the cartridge 112 to the expected position, the retray counter is incremented to 3. Then, a jam flag is set (16), the jam indicator is turned on (17), and the motor 122 is deenergized (18). In this condition, the program waits until the operator removes the cartridge 112 jamming the transport path. As soon as the operator removes the jamming cartridge 112, the sensor 130 turns on and the door open sensor 119 turns off due to the closure of the door 118. In response, the steps 1, 2, 4, 6, 7 and 8 are executed to reset the retry counter. It is to be noted that the turn-off of the jam indicator and the reset of the jam flag are effected on a reset button provided on the equipment. Alternatively, such a resetting operation may be effected automatically by the removal of the jamming cartridge 112, as in the previously stated jam processing.

As stated above, when the transport of the cartridge 112 is disturbed due to some inclination thereof or similar cause, it is restored to a normal condition. If such a transport error cannot be removed, a serious condition otherwise brought about by the continuous drive of the motor 122 is eliminated while the operator is informed of the jam.

Assume that a cartridge 112 inserted in a toner near end condition jams the transport path and, therefore, the motor 122 is deenergized. Even in such a condition, the image forming operation itself can be continued with the motor 122 deenrgized or if the jamming cartridge 112 is removed from the transport path. However, the casing 101 will soon run out of toner because the supply of toner from a new cartridge 112 is not available. The illustrative embodiment inhibits the image forming operation by a particular procedure which will be described, as soon as a toner end condition occurs.

Figure 43A:
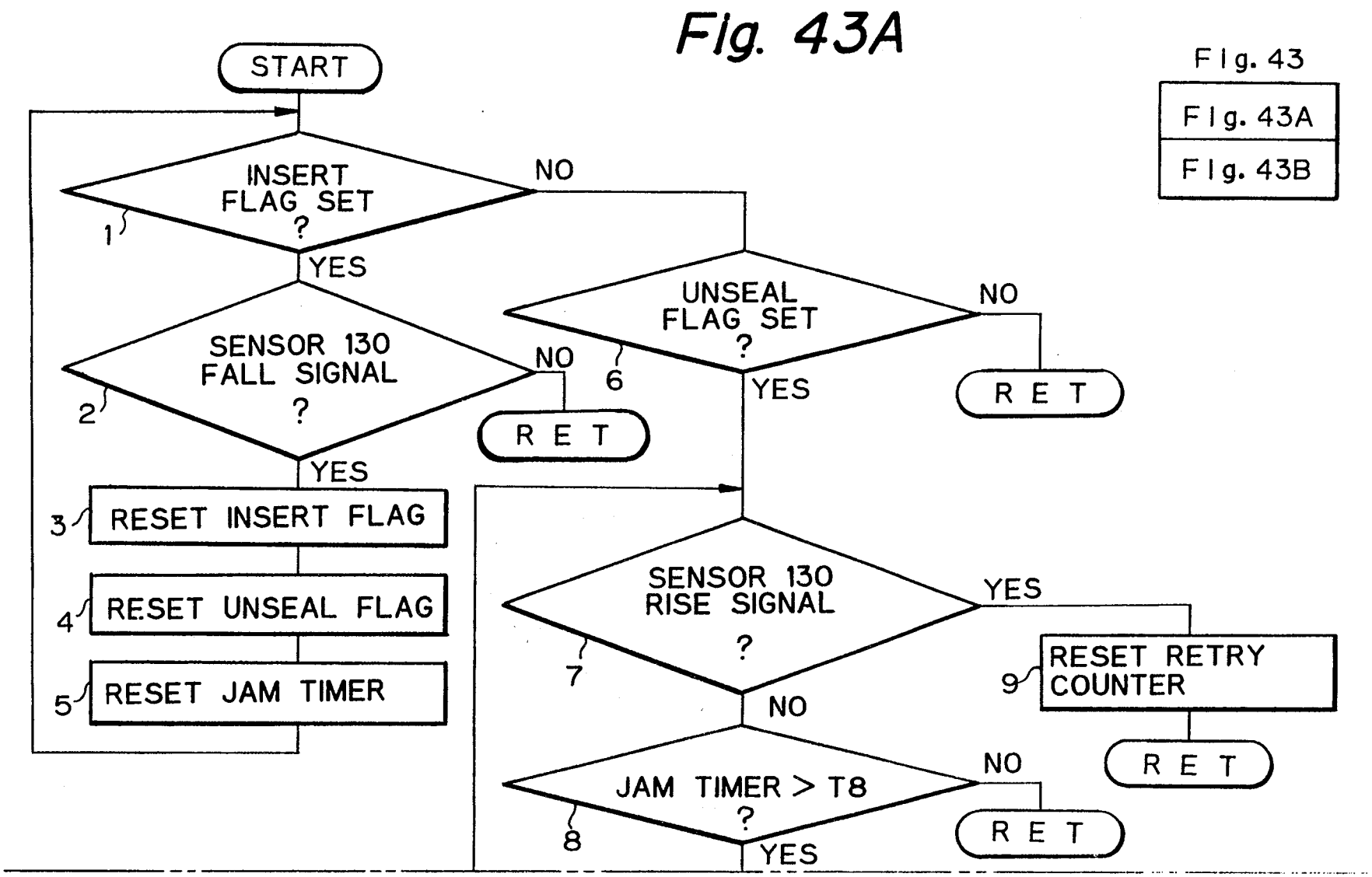
Figure 43B:
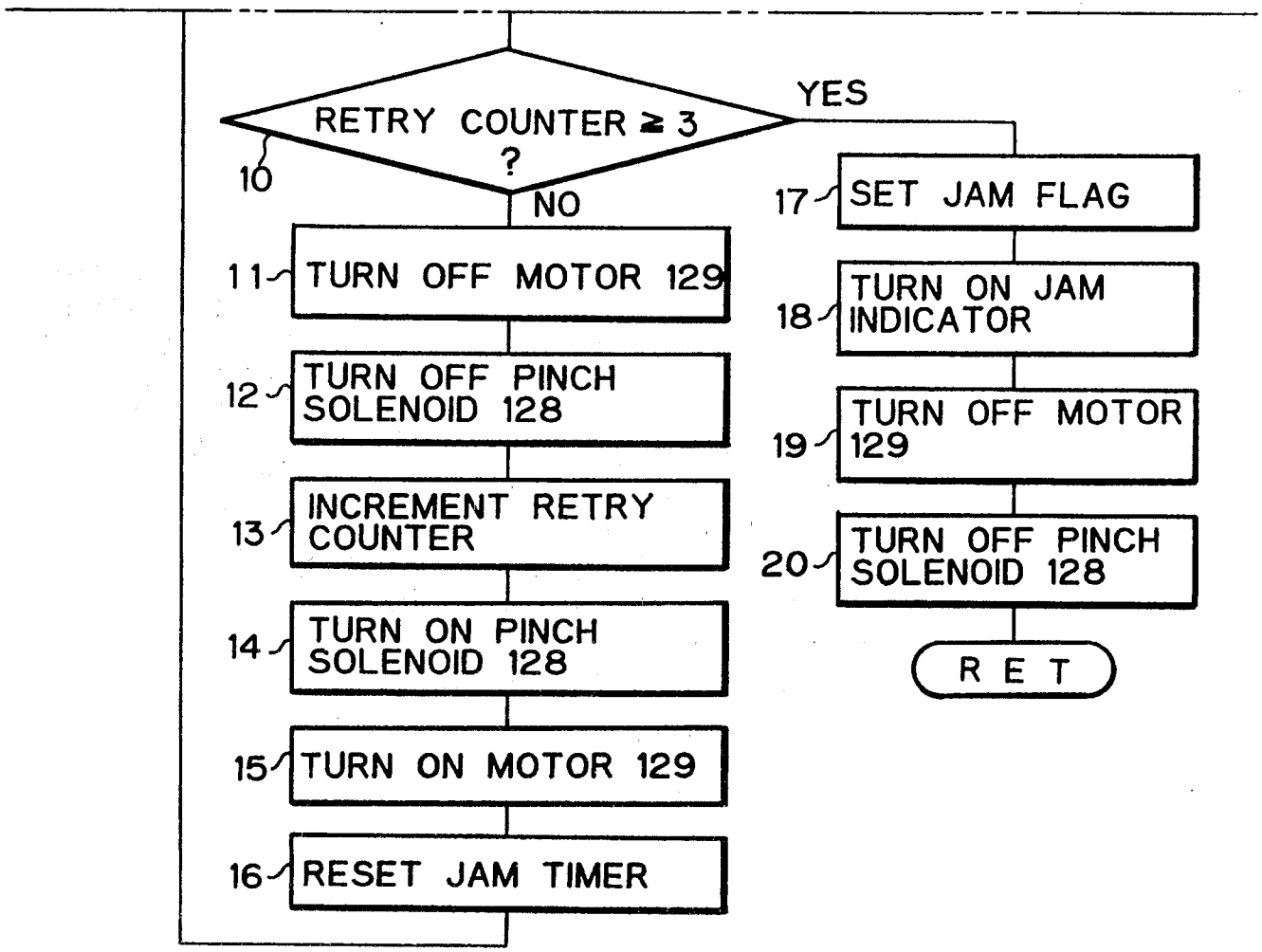

A reference will be made to FIG. 43 for describing jam processing to be executed when the unseal rollers 150 fail to fully remove the seal member 114 from the bottom of the cartridge 112 having been transported to above the hopper opening 124. As the trailing end of the cartridge 112 moves away from the feeler 130*a*, the sensor 130 is turned off to in turn energize the motor 129 which drives the rollers 150, as stated earlier. The jam processing which will be described occurs in the former half of the interval between the times indicated by circled 2 and 3 in FIG. 23.

Specifically, because the cartridge 112 has been inserted and the insert flag has been set, the program executes a step 2 for determining whether or not the sensor 130 has turned off. If the answer of the step 2 is positive, steps 3–5 are executed to reset the insery flag, set an unseal flag, and start a jam timer assigned to this jam processing, followed by the step 1. Because the insert flag has been reset (3) and the unseal flag has been set (4), the step 1 is followed by steps 6 and 7 for referencing the status of the sensor 130. At this instant, a predetermined period of time is necessary for the free end of the seal member 114 having been removed from the bottom of the cartridge 112 to reach the feeler 130*b* of the sensor 130 after the start of rotation of the rollers 150. Hence, after the step 7, whether or not a jam timer assigned to this jam processing and started on the turn-off of the sensor 130 has exceeded a set value T8 is determined (8). If the answer of the step 8 is negative, the program returns to the step 1 and repeats the steps 6, 7 and 8 until the jam timer exceeds T8 (8) or the sensor 130 turns on (7). The set value T8 is the sum of the time necessary for the free end of the seal member 114 to reach the feeler 130*b* after the turn-off of the sensor 130 and a scattering $\alpha$. Whether or not the seal member 114 has jammed is determined on the basis of the relation between the content of the jam timer and the set value T8.

If the cartridge 112 is adequately unsealed, the free end of the seal member 114 reaches the feeler 130*b* to turn on the sensor 130 before the jam timer exceeds T8. Then, the step 7 is followed by a step 9 for resetting a retry counter assigned to this jam processing. On the other hand, assume that the rollers 150 have failed to nip the free end of th seal member 114 accurately and, therefore, to unseal the cartridge 112 in the expected manner. Then, the jam counter exceeds T8. As a result, the step is followed by a step 10 and successive steps for executing jam processing, as follows.

The program tries to restore the free end of the seal member 114 to the expected condition by executing the steps of stopping the motor 129 and deenergizing the pinch solenoid 128 to thereby release the rollers 150 from the seal member 114, and then energizing the pinch solenoid 128 and motor 129 up to, for example, three times while determining whether or not the sensor 130 turns on. If the sensor 130 does not turn on despite the thee times of retry, a jam indicator assigned to this processing is turned on, the motor 129 is deenergized, and the pinch solenoid 128 is deenergized. As a result, the procedure for unsealing the cartridge 112 is interrupted.

In detail, whether or not the retry counter has exceeded 3 is determined (10). If the answer of the step 10 is negative, the motor 129 is deenergized (11), the pinch solenoid 128 is deenergized (12), the retry counter is incremented (13), the pinch solenoid 128 and motor 129 are energized again (14) to start on another retry, the jam timer is reset (16), and then the operation returns to the step 7. At this time, because the step 7 immediately follows the first retry, the program advances to the step 8 determining that the sensor 130 has not turned on. In the step 8, too, because the jam timer has just started, the program returns to the step 1 determining that the jam timer is not greater than T8. Thereafter, the steps 1, 6, 7 and 8 are repeated until the sensor 130 turns on (7) or the jam timer exceeds T8 (8).

If the cartridge 112 is successfully unsealed by the first retry, the sensor 130 turns on before the jam timer exceeds T8. Then the step 7 is followed by the step 9 for resetting the retry counter. However, if the seal member 114 being stripped from the cartridge 112 is in an inadequate condition, the jam timer exceeds T8 without the sensor 130 turning on. At this time, the step 8 is followed by the steps 10–16 for executing the second retry, the increment of the retry counter, and the restart of the jam timer. Subsequently, the program repeats the steps 1, 6, 7 and 8 until the sensor 130 turns on (7) or the jam timer exceeds T8 (8). When the seal member 114 is not restored to the expected condition even after the second retry, the jam timer again exceeds T8 without the sensor 130 turning on. Then, the step 8 is followed by the steps 10–16 to effect the third retry, the increment of the retry counter, and the restart of the jam timer, followed by the step 7. When even the third retry fails to restore the seal member 144 to the expected condition, the step 10 is followed by a step 17 because the retry counter is 3. In the step 17, a jam flag assigned to this routine is set. Thereafter, a jam indicator is turned on (step 18), the motor 129 is turned off (19), and the pinch solenoid 128 is deenergized (20). In this condition, the program waits until the operator removes the cartridge 112 from the toner supply position.

When the operator removes the jamming cartridge 112 from the transport path and then inserts it again, the insert flag is set again. Then, the jam detection described above is repeated.

As stated above, when, for example, the unseal rollers 150 fail to accurately nip the free end of the seal member 114 and, therefore, to fully unseal the cartridge 112, the embodiment restores the seal member 114 to the expected condition. When the seal member 114 cannot regain the expected condition despite the retry or retries, a critical jam of the seal member or that of the cartridge 112 ascribable to the continuation of the unsealing operation is eliminated while the operator is informed of the jam.

Figure 44A:
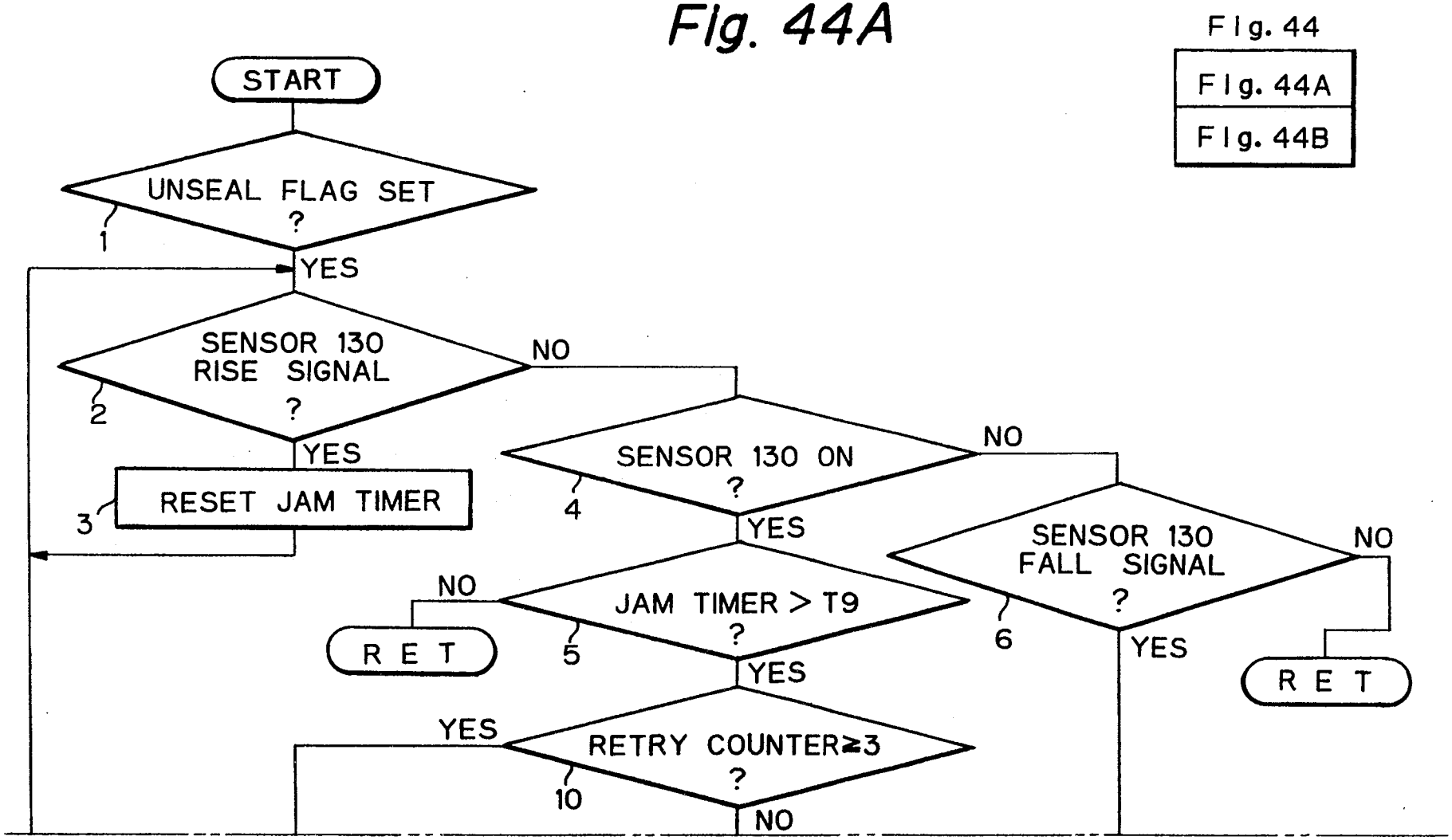
Figure 44B:
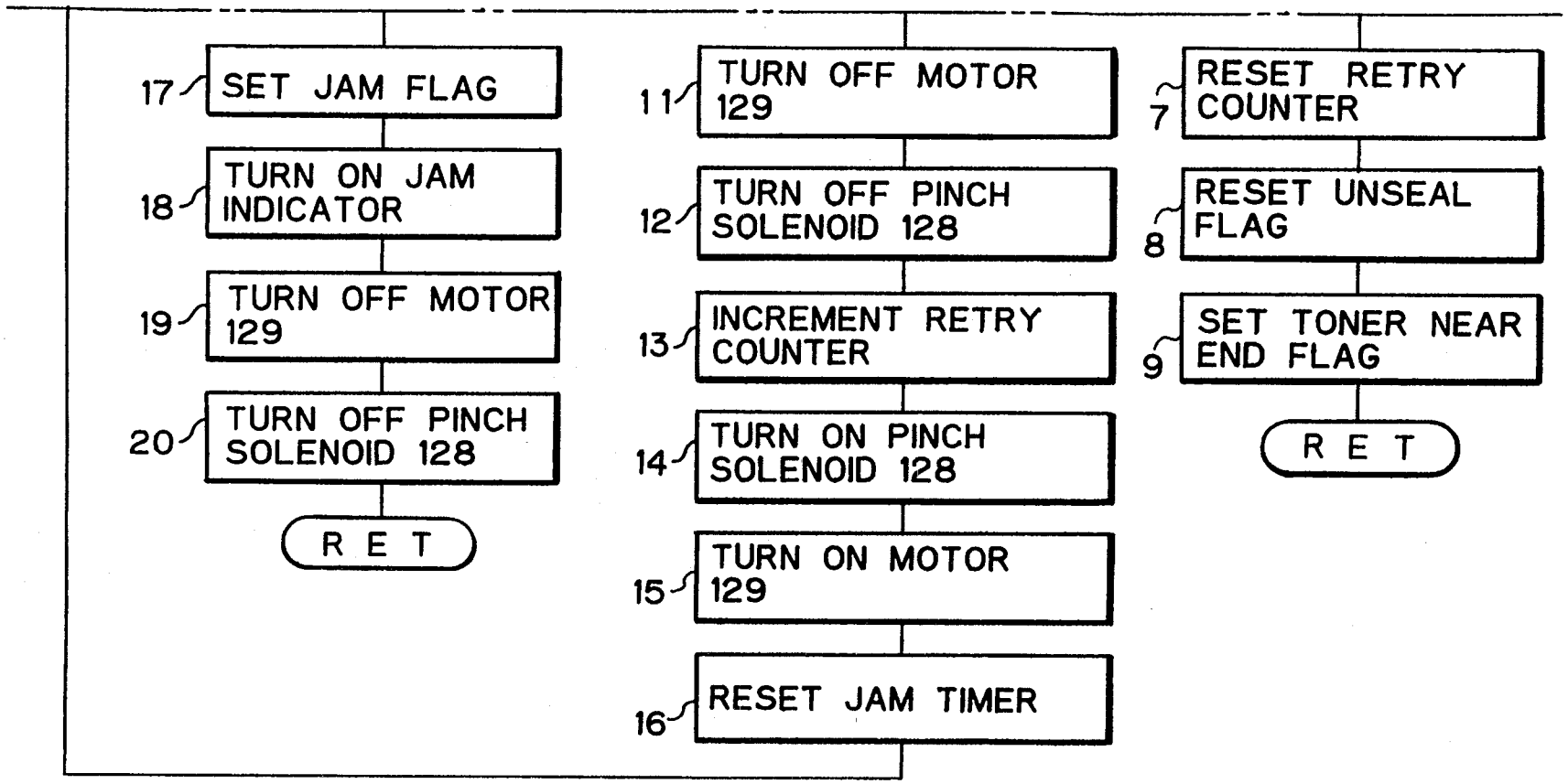

Now, it may occur that after the free end or leading end of the seal member 114 has reached the feeler **130*b* of the sensor 130, the trailing end of the same may fail to move away from the feeler 130*b* and stay at the feeder 130*b*. Then, another jam processing shown in FIG. 44 is executed. This jam processing occurs in the latter half of the interval between the times indicated by circled 2 and 3 in FIG. 23**.

Specifically, so long as the cartridge 112 is disposed above the hopper opening 124 and the unsealing operation is continued on the basis of the above stated jam processing, the unseal flag is set. In this condition, the free end of the seal member 114 has moved away from the feeler **130*b*, and the part of the seal member 114 having removed from the bottom of the cartridge 112 is pressing the feeler 130*b* downward. Hence, the sensor 130 is in an ON state. At the time when the free end of the seal member 144 arrives at the feeler 130*b* to turn on the sensor 130, steps 1, 2 and 3 are executed to start a jam timer assigned to this routine is started. The step 2 is followed by a step 4 to see if the sensor 130 is in an ON state. Here, a predetermined period of time is necessary for the trailing end of the seal member 114 to move away from the feeler 130*b* and therefore turn off the sensor 130 after the free or leading end of the same has arrived at the feeler 130*b*. Hence, the step 4 is followed by a step 5 to determined whether or not the jam timer having started on the turn-on of the timer 130 is greater than a set value T9. Thereafter, the steps 1, 2, 4 and 5 are repetitively executed until the answer of the step 4 changes to negative or the answer of the step 5 changes to positive. The set time T9 is the sum of the time necessary for the trailing end of the seal member 114 to move away from the feeler 130*b* after the sensor 130 has turned on due to the arrival of the leading end of the seal member 114 at the feeler 130*b* and a scattering $\alpha$. Whether or not the seal member 114** being peeled off has jammed is determined on the basis of the relation between the content of the jam timer and the set value T9.

So long as the cartridge 112 is removed in an adequate manner, the trailing end of th seal member 114 moves away from the feeler **130*b* to turn off the sensor 130 before the jam timer exceeds the set time T9. Then, the step 4 is followed by steps 6 and 7 to reset a retry counter assigned to this routine. Subsequently, the unseal flag is reset (8), and a toner near end flag is set (9). Assume that the cartridge 112 is not unsealed in the expected manner because, for example, the rollers 150 have failed to accurately nip the seal member 11 therebetween. Then the jam timer exceeds T9 without the sensor 130 turning off. At this time, the step 5 is followed by a step 10** and successive steps for executing jam processing.

Specifically, the program tries to restore the nipping condition of the rollers 150 to normal by repeating the steps of denergizing the motor 129 and pinch solenoid 8 to thereby release the seal member 114 from the rollers 150, and again energizing the pinch solenoid 128 and motor 129 up to, for example, three times while determining whether or not the sensor 130 turns off. If the sensor 130 remains in an ON state even after the three times of retry, and exclusive jam indicator for this routine is turned on while the motor 129 and pinch solenoid 128 are deenergized to interrupt the unsealing operation.

In detail, whether or not the retry counter has exceeded 3 is determined (10). If the answer o the step 10 is negative, the motor 129 is deenergized (11), pinch solenoid 128 is turned off (12), the retry counter is incremented (13), the pinch solenoid 128 is turned on again (14), the motor 129 is energized to start on another retry (15), the jam timer is reset (16), and then the operation returns to the step 2. At this time, because the step 2 immediately follows the first retry, the program advances to the steps 4 and 5 determining that the sensor 130 is in an ON state. In the step 5, too, the program determined that the jam timer is not greater than T9 because the jam timer has just restarted. Thereafter, the steps 1, 2, 4 and 5 are repeated until the answer of the step 4 changes to negative or the answer of the step 5 changes to positive.

If the unsealing operation is restored to normal by the first retry, the trailing end of the seal member 114 moves away from the feeler **130*a* to cause the sensor 130 to turn on before the jam timer exceeds T9. Therefore, the step 4 is followed by the steps 6–9. If the unsealing operation is not restored to normal even after the first retry, the jam timer exceeds T9 without the senor 130 turning off. Then, the step 5 is followed by the step 10 and steps 11–16 for effecting the second retry, the increment of the retry counter, an the restart of the jam timer. Subsequently, the steps 2, 4 and 5 are repeated until the answer of the step 4 changes to negative or the answer of the step 5** changes to positive.

If the second retry has failed to correct the unsealing condition, the jam timer again exceeds T9 without the sensor 130 turning on. Then, the step 5 is followed by the step 10 and then by the steps 11–16 for executing the third retry, the increment of the retry counter, and the restart of the jam timer. Thereafter, the program returns to the step 2. When even the third retry is not successful, the step 10 is followed by a step 17 for setting a jam flag because the retry counter has been incremented to 3. Subsequently, a jam indicator is turned on (18), the motor 129 is turned off (19), and the pinch solenoid 128 is turned off (20). In this condition, the program waits until the operator removes the cartridge 112 from the toner supply position. After the operator has removed the cartridge 112 from the supply position and inserted it again into the equipment body, the cartridge 112 is transported to the supply position. As the unsealing operation begins again, the program repeats the above-stated sequence of steps again for detecting a jam.

As stated above, when the cartridge 112 is not properly unsealed due to, for example, the incomplete operation of the rollers 150, a proper unsealing condition can be set up. Even if the cartridge 112 cannot be restored to the proper condition, a serious jam of the seal member 114 or that of the cartridge 112 ascribable to the contination of the unsealing operation is eliminated while the operator is informed of this kind of jam.

Figure 45A:
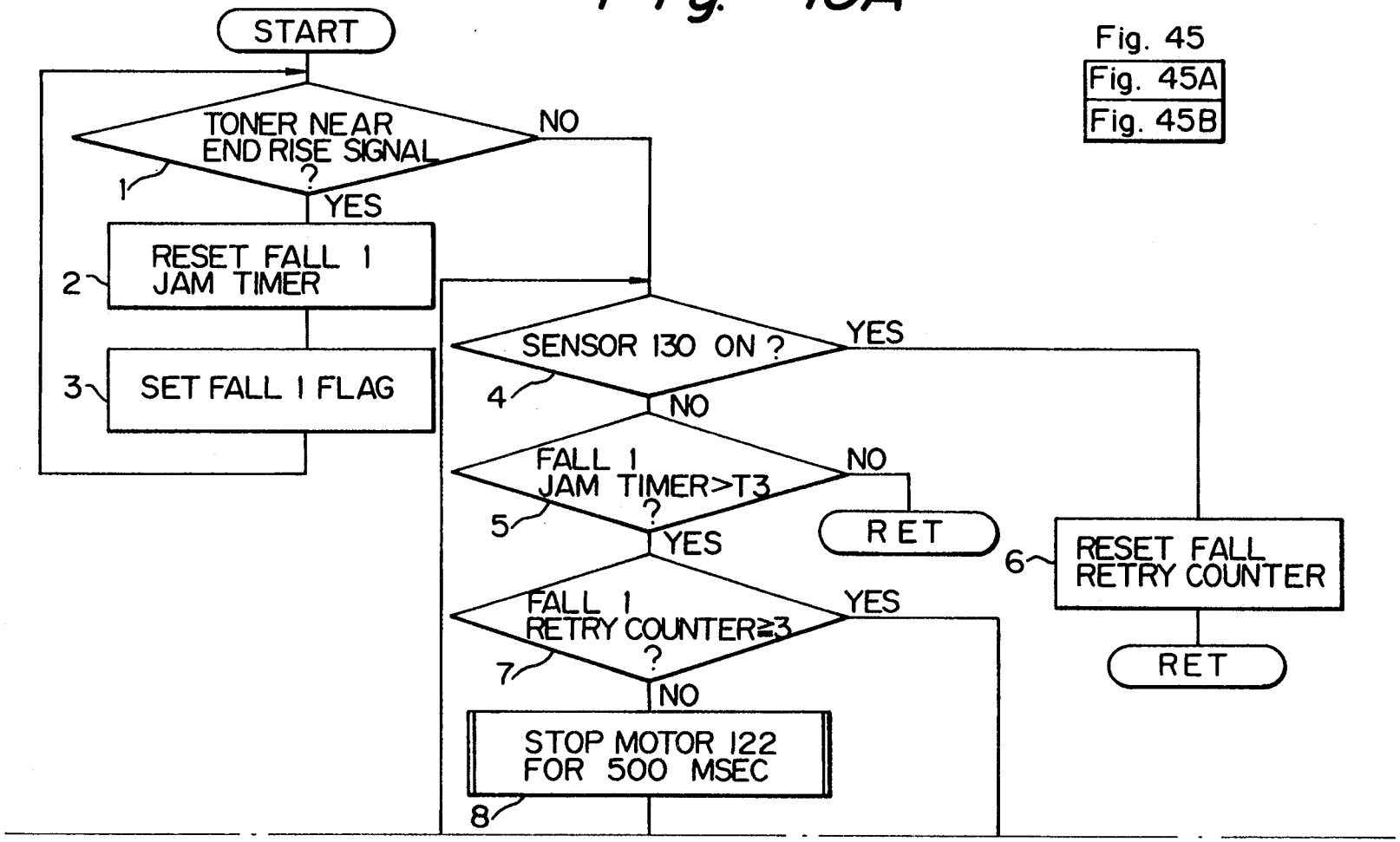
Figure 45B:
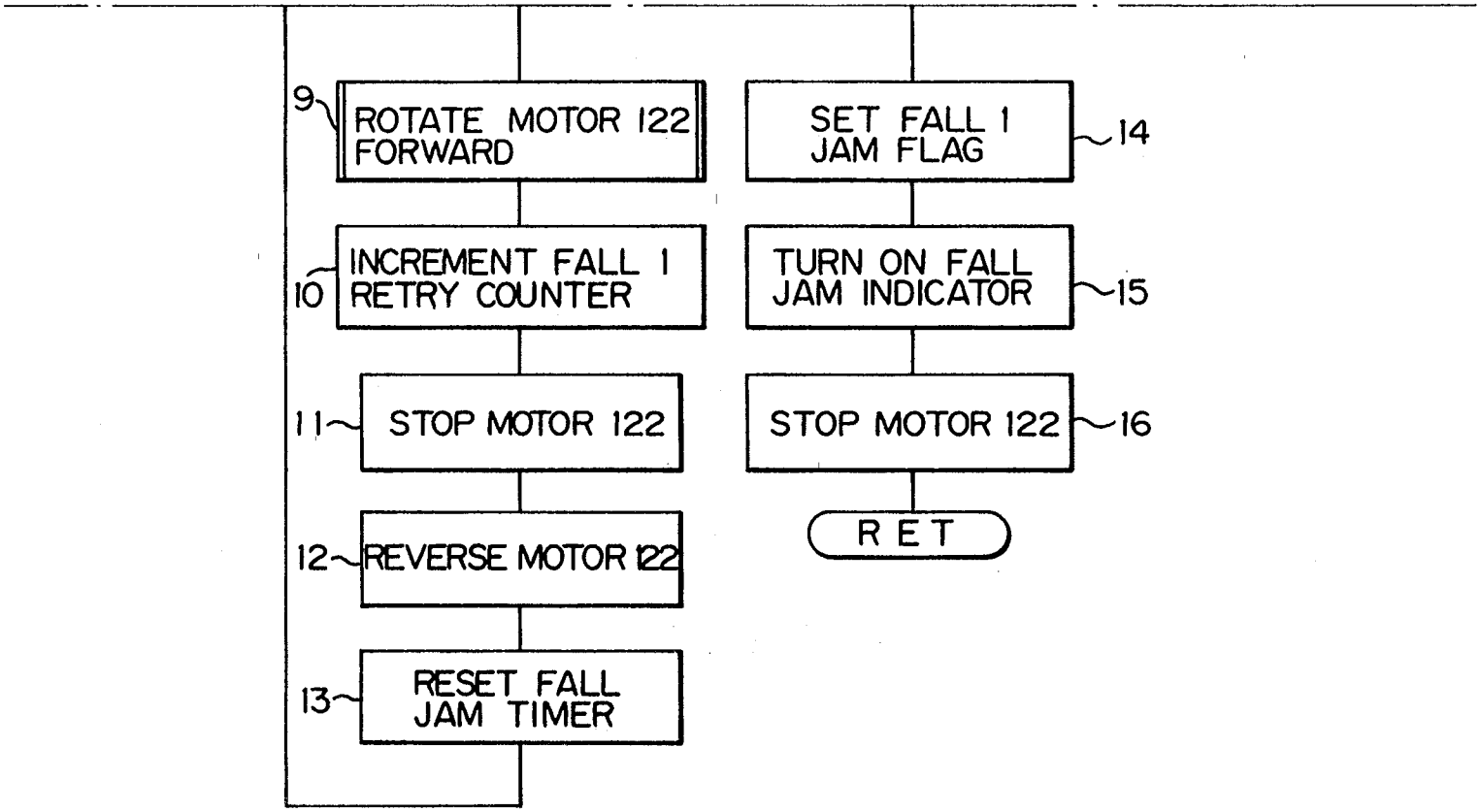

FIG. 45 shows a jam detection procedure which corresponds to the former half of the tims [I] and [II ] of FIG. 24 and associated with the fall of the cartridge 112 into the hopper opening 124. The processing of FIG. 45 determines whether or not the trailing end of the cartridge 112 (in the direction of insertion) reaches the feeler **130*a* in a predetermined period of time after the motor 212 has been reversed to start transporting the cartridge 112 from the hopper opening 124 to the collecting box 133**.

Because the reverse transport from the hopper opening 124 toward the collecting box 133 has been started on the detection of a toner end condition, the program executes steps 1–3 for starting a fall 1 jam timer and a fall 1 flag, returns to the step 1, and then advances to a step 4 to see if the sensor 130 is in an ON state. At this instant, a predetermined period of time is necessary for the trailing end of the cartridge 112 to reach the feeler 130 to thereby cause the sensor 130 to turn on after the start of the reverse transport. Hence, the program executes a step 5 to see if the fall 1 jam timer has exceeded a set value T3. Thereafter, the steps 1, 4 and 5 are repeated until the answer of the step 4 or that of the step 5 changes to positive. The set value T3 is the sum of the time necessary for the trailing end of the cartridge 112 to reach the feeler 130*a* after then turn-on of a toner near end signal during the reverse transport and a scattering $\alpha$. Whether or not the cartridge 122 has jammed the transport path is determined on the bases of the relation between the content of the fall 1 jam timer and the set value T3.

When the cartridge 112 is in normal transport in the reverse direction, the trailing end of the cartridge 112 reaches the feeler 130*a* to cause the sensor 130 to turn on before the fall 1 jam timer exceeds T3. Hence, the step 4 is followed by a step 6 for resetting a fall 1 retry counter. If the reverse transport of the cartridge 112 is not proper due to, for example, the tilt of the cartridge 112, the fall 1 jam timer exceeds T3 with the result that the step 5 is followed by a step for executing jam processing. Briefly, this processing tries to correct the transport condition, e.g., the tilt of the cartridge 112 by repeating the steps of stopping the reverse rotation of the motor 122, causing it to rotate in the forward direction, and then causing it to rotate in the reverse direction up to, for example, three times while determining whether or not the sensor 130 turns on. If the sensor 130 does not turn on even after the three times of retry, a fall 1 jam indicator is turned on while the motor 122 is turned off.

Specifically, Whether or not the fall 1 retry counter has exceeded 3 is determined (7). If the answer of the step 7 is negative, the motor 122 is deenergized for 500 milliseconds (8) and then rotated in the forward direction (9), and the fall 1 retry counter is incremented (10). Subsequently, the motor 122 is deenergized again (11) and then rotated in the reverse direction (12), the fall 1 jam timer is reset and then restarted (13). Then, the operation returns to the step 4. At this time, because the step 4 immediately follows the first retry, the program advances to the step 5 determining that the sensor 130 is not in an ON state. In the step 5, too, the program returns that the fall 1 jam timer is not greater than T3 because the fall 1 jam timer has just been restarted. Thereafter, the steps 1, 4 and 5 are repeated until the answer of the step 4 changes to positive or the answer of the step 5 changes to positive.

If the reverse transport condition is successfully corrected by the first retry, the railing end of the cartridge 112 reaches the feeler 130*a* before the fall 1 jam timer exceeds T3, turning on the sensor 130. As a result, the step 4 is followed by the step 5 to reset the fall 1 retry counter. On the other hand, when the first retry is not successful, the fall 1 jam sensor exceeds T3 without the sensor 130 turning on. Hence, the program advances from the step 5 to the step 7 and further to the steps 8–12 to effect the second retay, the increment of the fall 1 retry counter, and the restart of the fall 1 jam timer, and then returns to the step 4. Thereafter, steps 1, 4 and 5 are repeated until the answer of the step 4 or that of the step 5 changes to positive. If the second retry is not successful, the fall 1 jam timer again exceeds T3 without the sensor 130 turning on. Therefore, the program executes the steps 5, 7 and 8–13 to effect the third tray, the increment of the fall 1 retry counter, and the restart of the fall 1 jam timer. When even the third retry is not successful, the operation is transferred from the stp 7 to a step 14 to set a fall 1 jam flag. Then a fall 1 jam indicator is turned on (15), and the motor 122 is deenergized (16). In this condition, the program waits until the operator removes the jamming cartridge 112.

As stated above, when the reverse transport of the cartridge 112 is disturbed due to, for example, the tilt of the cartridge 112 on the transport path, it can be restored to normal. Even if the transport condition cannot be restored to normal, a serious jam ascribable to the continuous drive of the motor 122 is eliminated while the operator is informed of this kind of jam.

Figure 46A:
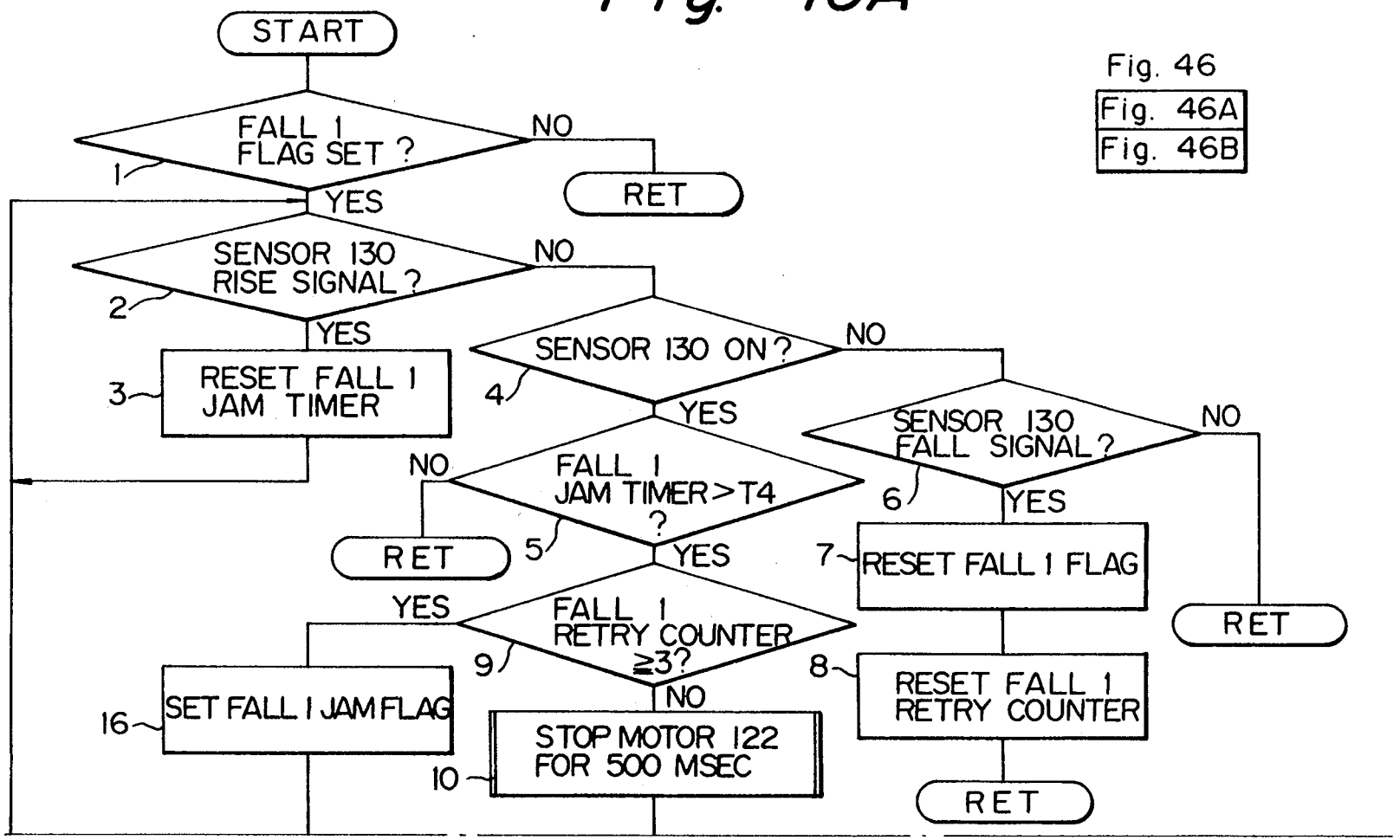
Figure 46B:
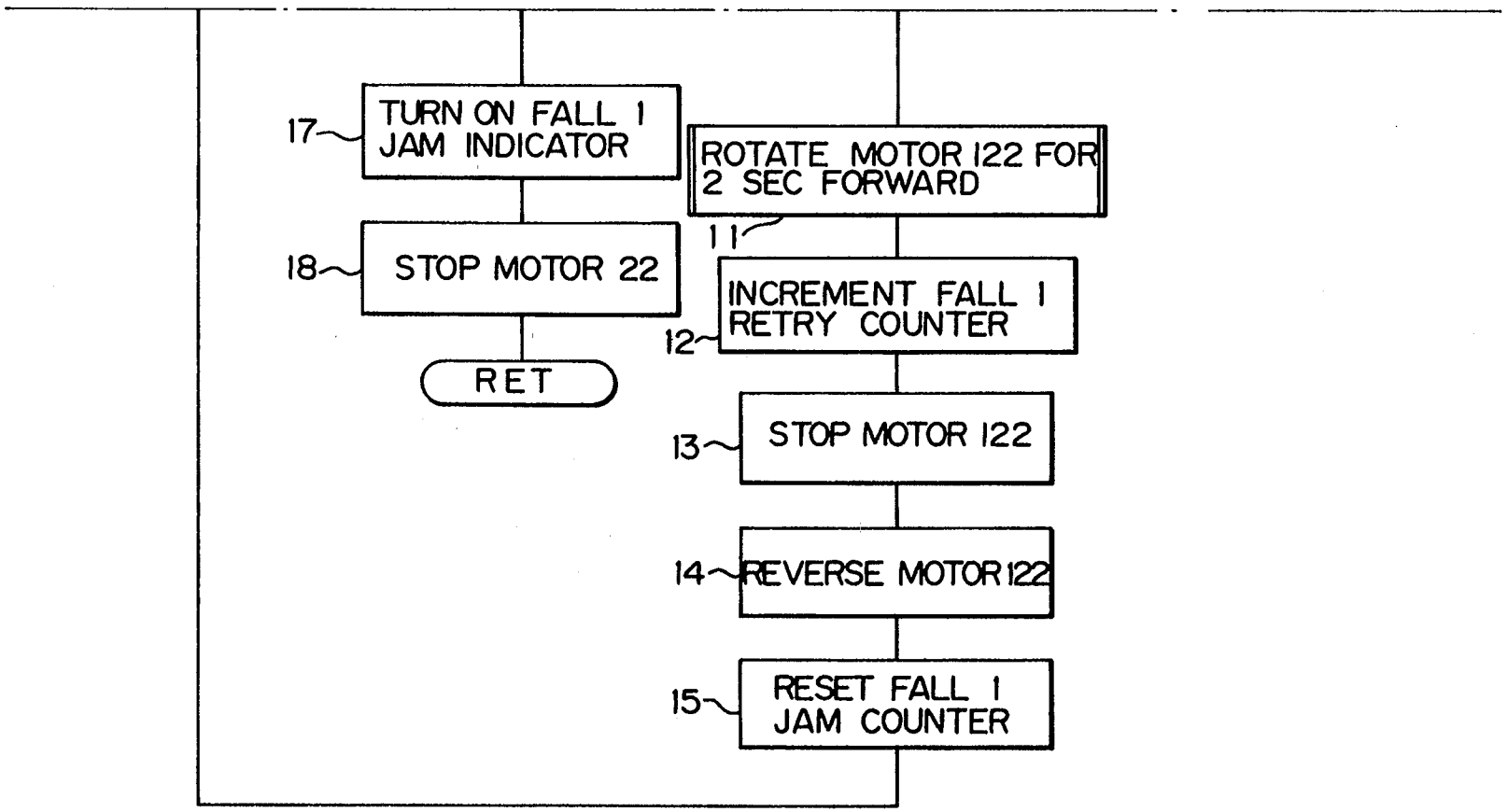

During the reverse transport of the cartridge 112, it may occur that a predetermined period of time expires after the trailing end of the cartridge has arrived at the feeler 130*a* and before the leading end of the same moves away from the feeler 130*a*. In this case, the embodiment executes jam processing which will be described hereinafter with reference to FIG. 46 and corresponds to the former half of the interval between the times indicated by circled 1 and 2 in FIG. 24.

Assume that the cartridge 112 is continuously transported in the reverse direction without the motor 122 being deenergized by the above-stated jam processing (see FIG. 45, step 15) which also pertains to the reverse transport. In this condition, the fall 1 flag is set. The sensor 130 is in an ON state because the trailing end of the cartridge 112 has moved away from the feeler 130*a* and the left portion of the flange 115*a* is pressing the feeler 130*a* downward with the lower surface thereof. When the trailing end of the cartridge 112 arrives at the feeler 130*a* to cause the sensor 130 to turn on, steps 1, 2 and 3 are executed to start the fall 1 jam timer. Then, the step 2 is followed by steps 4 and 5 for determining whether or not the sensor 130 is in an ON state. A predetermined period of time is necessary for the leading end of the cartridge 112 move away from the feeler 130*a* to turn off the sensor 130 after the trailing end of the cartridge 122 has turned on the sensor 130. For this reason, the step 4 is followed by the step to see if the fall 1 jam timer has exceeded a set value T4. Thereafter, the steps 1, 2, 4 and 5 are repeated until the answer of the step 4 changes to negative or the answer of the step 5 changes to positive. The time T4 is the sum of a predetermined period of time necessary for the leading end of the cartridge 112 to leave the feeler 130*a* after the trailing end of the cartridge has arrived at the feeler 130*a* to turn on the sensor 130 and a scattering $\alpha$. Whether or not a jam of the kind mentioned above has occurred is determined on the basis of the relation between the content of the fall 1 jam timer and the set value T4.

While the cartridge 112 is properly transported in the reverse direction, the leading end of the cartridge 112 moves away from the feeler 130*a* before the fall 1 jam timer exceeds the set value T4, causing the sensor 130 to turn off. Then, the step 4 is followed by the steps 6 and 8 for resetting the fall 1 flag and fall 1 retry counter. On the other hand, when the reverse transport is disturbed due to, for example, a tilt of the cartridge 112, the fall 1 jam timer exceeds T4 without the sensor 130 turning off. In this case, the step 5 is followed by the step 9 for executing jam processing. Briefly, the jam processing shown in FIG. 46 tries to correct, for example, the tilt of the cartridge 112 on the transport path by repeating the steps of deenrgizing the reverse rotation of the motor 122, causing it to rotate in the forward direction, an then reversing it again up to, for example, three times while determining whether or not the sensor 130 turns on. If the sensor 130 does not turn on even after the three times of retry, the fall 1 jam indicator is turned on while the motor 122 is energized.

In detail, in the step 9, whether or not the fall 1 retry counter is 3 is determined. If the answer of the step 9 is negative, the motor 122 is deenergized for 500 milliseconds (10) and then rotated in the forward direction for 3 seconds (11), and the fall 1 retry counter is incremented (12). Subsequently, the motor 122 is deenergized again (13) and then reversed (14). The fall 1 jam timer is reset and then restarted (15). Thereupon, the program returns to the step 2 and then advances to the step 4. At this time, because the step 4 immediately follows the first retry, the program executes the step 5 determining that the sensor 130 is in an ON state. In the step 5, too, the program determines that the fall 1 jam timer is not greater than T4 because the timer has just started. Thereafter, the steps 1, 2, 4 and 5 are repeated until the answer of the step 4 changes to negative or the answer of the step 5 changes to positive.

If the transport condition is successfully corrected by the first retry, the leading end of the cartridge 112 moves away from the feeler 130*a* before the fall 1 jam timer exceeds T4, causing the sensor 130 to turn off. Therefore, the step 4 is followed by the steps 6–8 to reset the fall 1 flag and fall 1 retry counter. If the first retry is not successful, the fall 1 jam timer exceeds T4 without the sensor 130 turning on. In this case, the operation is transferred from the step 5 to the step 9 and further to the steps 10–15 to effect the second retry, the increment o the fall 1 retry counter, and the restart of the fall 1 jam timer. Thereupon, the program returns to the step 2 and then executes the steps 4 and 5. Thereafter, the program repeats the steps 1, 2, 4 and 5 until the answer of the step 4 changes to negative or the answer of the step 5 changes to positive.

When the second retry is not successful, the fall 1 jam timer again exceeds T4 without the sensor 130 turning off. Hence, the step 5 is followed by steps 9–15 to effect the third retry, the increment of the fall 1 retry counter, and the restart of the fall 1 jam counter. If the transport condition is not corrected even after the third retry, the step 9 is followed by a step 16 because the fall 1 retry counter has been incremented to 3. In the step 16, the fall 1 jam flag is set. Subsequently, the fall 1 jam indication is turned on (17), and the motor 122 is deenergized (18). In this condition, the program waits until the operation removes the cartridge 122 jamming the transport path. As the jamming cartridge is removed by the operator, the sensor 130 turns off. As a result, the steps 1, 2, 4, 6, 7 and 8 are executed to reset the fall 1 flag and retry counter.

In the illustrative embodiment the fall 1 jam indicator is turned off by a reset button provided on the equipment. Alternatively the fall 1 jam indicator may be reset automatically by the removal of the jamming cartridge 112. Conversely, an arrangement may be made to reset the fall 1 jam flag and retry counter and turn the fall 1 jam indicator by a reset button provided on the equipment.

As stated above, the reverse transport of the cartridge 112 is disturbed by, for example, a tilt of the cartridge 112, the transport can be restored to normal. Even when the transport cannot be restored to normal, a serious jam due to the continuous drive of the motor 122 is eliminated while the operator is informed of the jam.

Figures 47, 47A:
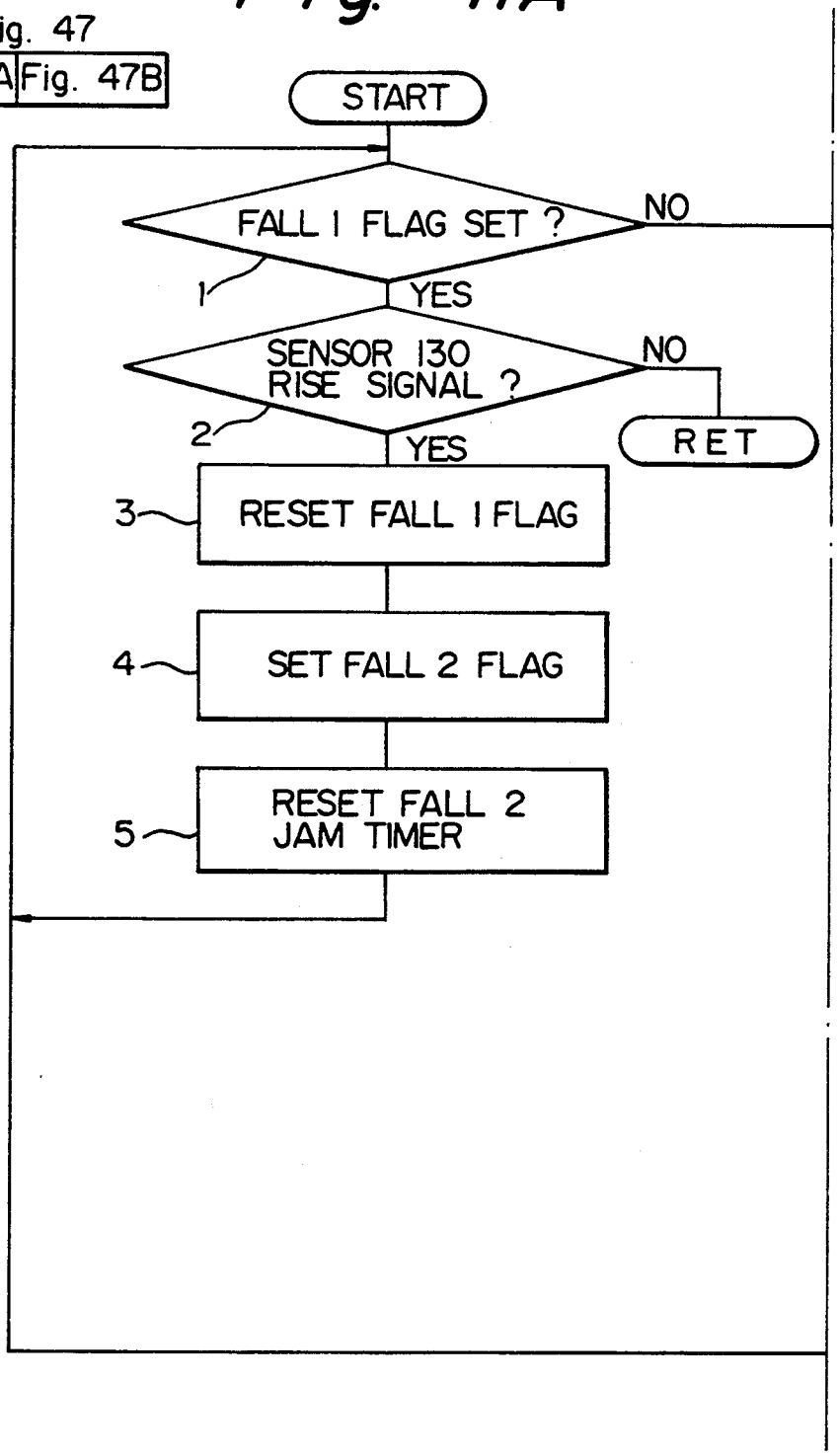
Figure 47B:
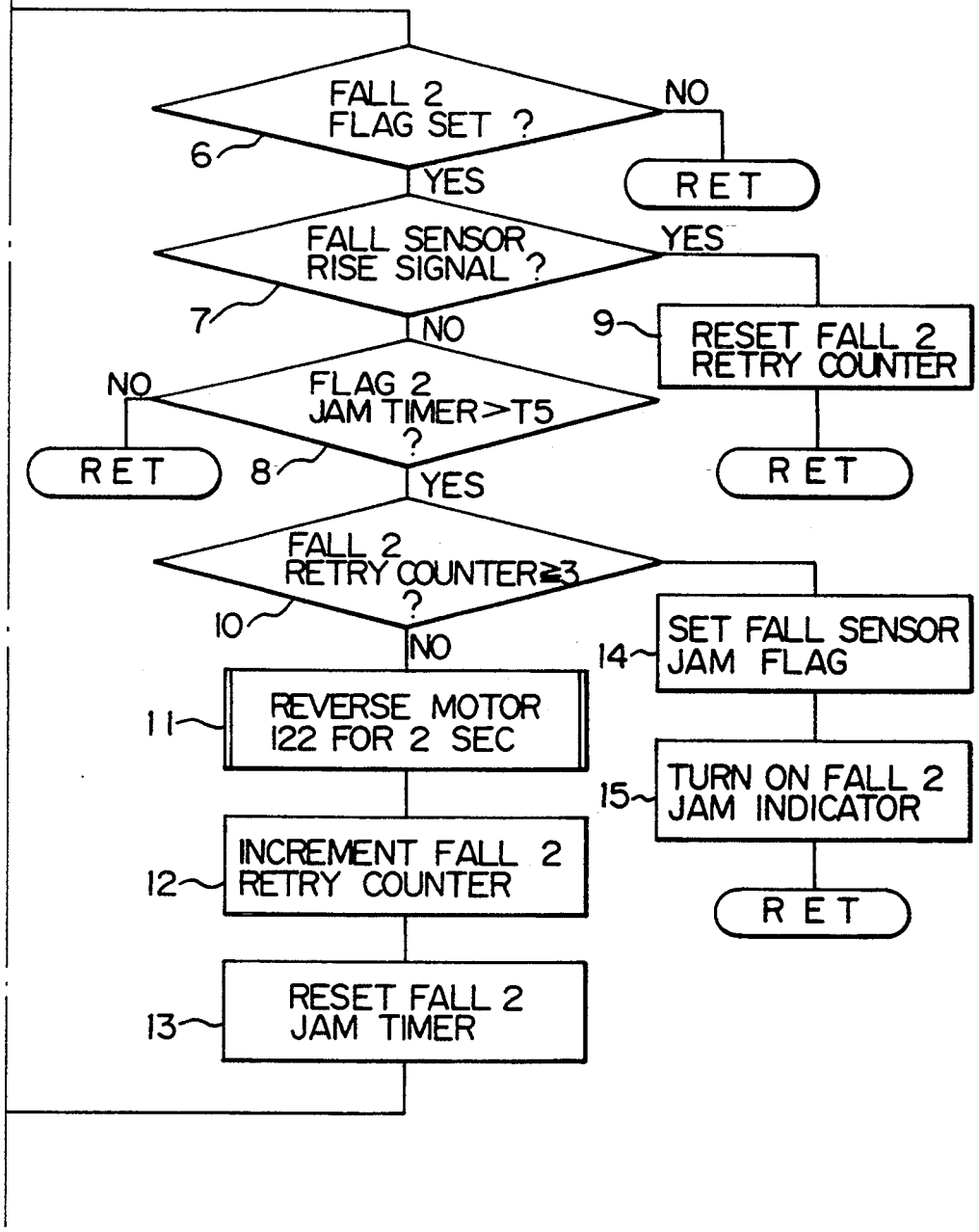

A reference will be made to FIG. 47 for describing a procedure which determines whether or not the cartridge 112 is sensed by a sensor located at a predetermined position inside the collecting box 133 after the trailing end of the cartrige 112 has moved away from the feeler 130*a*. The cartridge 112 begins to fall into the box 133 after the leading end thereof has moved away from the feeler 130*a*. Therefore, the fall 1 flag is set. When the sensor 130 is turned off due to the movement of the leading end of the cartridge 112, steps 1–5 are executed to reset the fall 1 flag, set a fall 2 flag, and start a fall 2 jam flag, followed by the step 1. Because the fall 1 flag has been reset and the fall 2 flag has been set, the operation is transferred from the step 1 to steps 6 and 7 to determine whether or not the sensor accommodated in the box 133 has turned on. A predetermined period of time is necessary for the cartridge 112 to reach the fall sensor in the box 133 after the turn-off the sensor 130. Hence, the step 7 is followed by a step 8 to see if the fall 2 jam timer has exceeded a set time T5. Thereafter, the steps 1, 6, 7 and 8 are repeated until the answer of the step 7 changes to positive or the answer of the step 8 changes to positive. The set time T5 is the sum of the necessary for the cartridge 122 to reach the fall sensor in the box 133 after the leading end thereof has moved away from the feeler 130*a* and a scattering $\alpha$. Whether the cartridge 122 has jammed the path is determined on the basis of the relation between the content of the fall 2 jam timer and the set value T5.

When the cartridge 112 begins to fall in a normal condition, it reaches the fall sensor in the box 133 before the fall 2 jam timer exceeds T5, thereby turning on the timer. Then, the step 7 is followed by a step 9 for resetting the fall 2 retry counter. If the condition in which the cartridge 112 is falling into the box 133 is not normal due to, for example, a tilt of the cartridge 112, the fall 2 jam timer exceeds T5 without the sensor turning on. Then, a step 10 is executed after the step 8 to execute jam processing. In this case, the jam processing tried ty correct, for example, the tilt of the cartridge 112 in the vicinity of the fall position by repetitively causing the motor 122 deenergized at the end of reverse transport to rotate in the reverse direction over a predetermined period of time up to, for example, three tims while determining whether or not the fall sensor turns on. If the fall sensor does not turn on even after the three times of retry, a fall 2 jam indicator is turned on.

In detail, whether or not the fall 2 retry counter has exceeded 3 is determined (10). If the answer of the step 10 is negative, the motor 122 is rotated in the reverse direction for 2 seconsds (11), the fall 2 retry counter is incremented (12), the fall 2 jam timer is reset and then restarted (13), and the operation is returned to the step 1. The steps 1, 6, 7 and 8 are repeated until the answer of the step 7 changes to positive or the answer of the step 8 changes to positive.

If the cartridge 112 begins to fall in a normal condition as a result of the fist retry, it reaches the fall sensor in the box 133 before the fall 2 jam timer exceeds T5, causing the sensor to turn on. Then, the step 7 is followed by the step 9 to reset the fall 2 retry counter. If the first retry is not successful, the fall 2 jam timer exceeds T5 without the fall sensor turning on. In this case, the step 8 is followed the step 10 and further by the steps 11–13 to effect the second retry, the increment the fall 2 retry counter, and the restart of the fall 2 jam timer, followed by the step 1. Thereafter, steps 1, 6, 7 and 8 are repeated until the answer of the step 7 or that of the step 9 changes to positive. If the cartridge 112 fails to begin to fall in a normal condition despite the second retry, the fall 2 jam timer again exceeds T5 without the fall sensor turning on. As a result, the program executes the steps 11–13 to effect the third retry, the increment of the fall 2 retry counter, and the restart of the fall 2 jam timer and then returns to the step 1. When even the third retry is not successful, the step 10 is follows by a step 14 to set a fall 2 jam flag because the retry counted has been incremented to 3. Then, a fall 2 jam indicator is turned on (15). In this condition, the program waits until the operator removes the cartridge 112 remaining in the vicinity of the fall position. As the operator removes the cartridge 112 and then presses a reset button provided on the equipment, the fall 2 jam flag and retry counter are reset and the fall 2 jam indicator is turned on.

As stated above, when the cartridge 112 remains in the vicinity of the fall position without starting falling into the box 133, it can be let fall in a normal condition by the above processing. Even when the cartridge 112 does not start falling despite the processing, the operator is surely informed of this kind of jam.

Figure 48A:
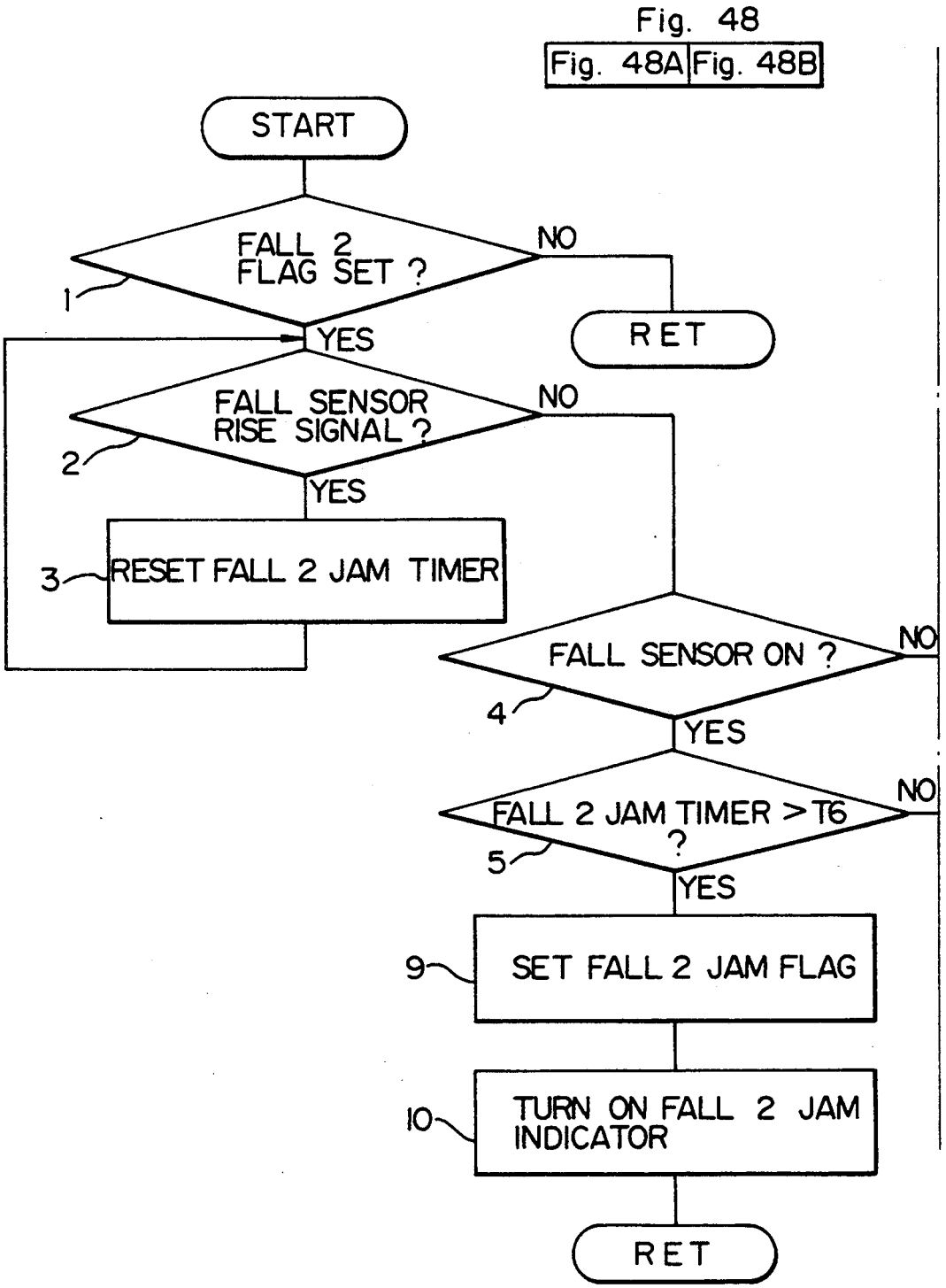
Figure 48B:
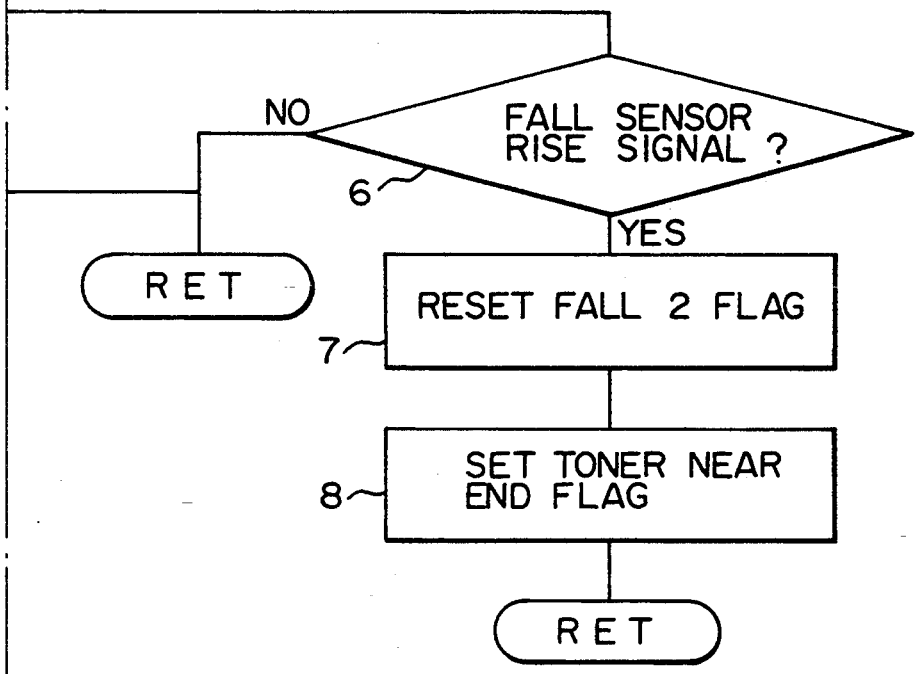

FIG. 48 shows a jam detection procedure for coping with an occurrence that after the cartridge 112 has successfully fallen into the collecting box 133 as far as the fall sensor, it does not move away from it in a predetermined period of time. This procedure corresponds to the latter half of the timing chart shown in FIG. 24. Specifically, while the cartridge 112 having begun to fall as far as the fall sensor is passing the fall sensor, the fall 2 flag is set (see FIG. 47, step 4) and the sensor is in an ON state. As soon as the cartridge 112 reaches the sensor, the sensor is turned on with the result that steps 1, 2 and 3 are executed to start the fall 2 jam timer. The step 2 is followed by a step 4 by way of the step 2. A predetermined period of time is necessary for the cartridge 112 to move away from the fall sensor after it has reached and turned on the sensor. Hence, the step 4 is followed by a step 5 to see if the fall 2 jam timer has exceeded a set value T6. Thereafter, the steps 1, 2, 4 and 5 are repeated until the answer of the step 4 changes to negative or the answer of the step 5 changes to positive. The set value T6 is the sum of the time necessary for the cartridge 112 to leave the fall sensor after arriving at and turning on the fall sensor and a scattering $\alpha$. Whether or not the cartridge 112 has jammed the path inside the box 133 is determined on the basis of the relation between the content of the fall 2 jam timer and the set value T6.

So long as the cartridge 112 falls in a normal condition, the cartridge 112 moves away from the fall sensor before the fall 2 jam timer exceeds T6, thereby turning on the sensor. Then, the step 4 is followed by steps 6 and 7 to reset a fall 2 flag and then by a step 8 to set a toner near end flag. On the other hand, assume that the cartridge is, for example, tilted from the horizontal position such that the opening thereof is oriented sideways at the beginning of the fall, and part of the cartridge 112 has reached the bottom of the box 133 or a cartridge fallen thereonto before the entire cartridge 112 leaves the fall sensor. Then, the fall 2 jam timer exceeds T6 without the fall sensor turning off with the result that the step 5 is followed by a step 9 to set the fall 2 jam flag. Then, in a step 10, the fall 2 jam indicator is turned on. This is successful in informing the operator of the jam in the box 133.

Figure 49:
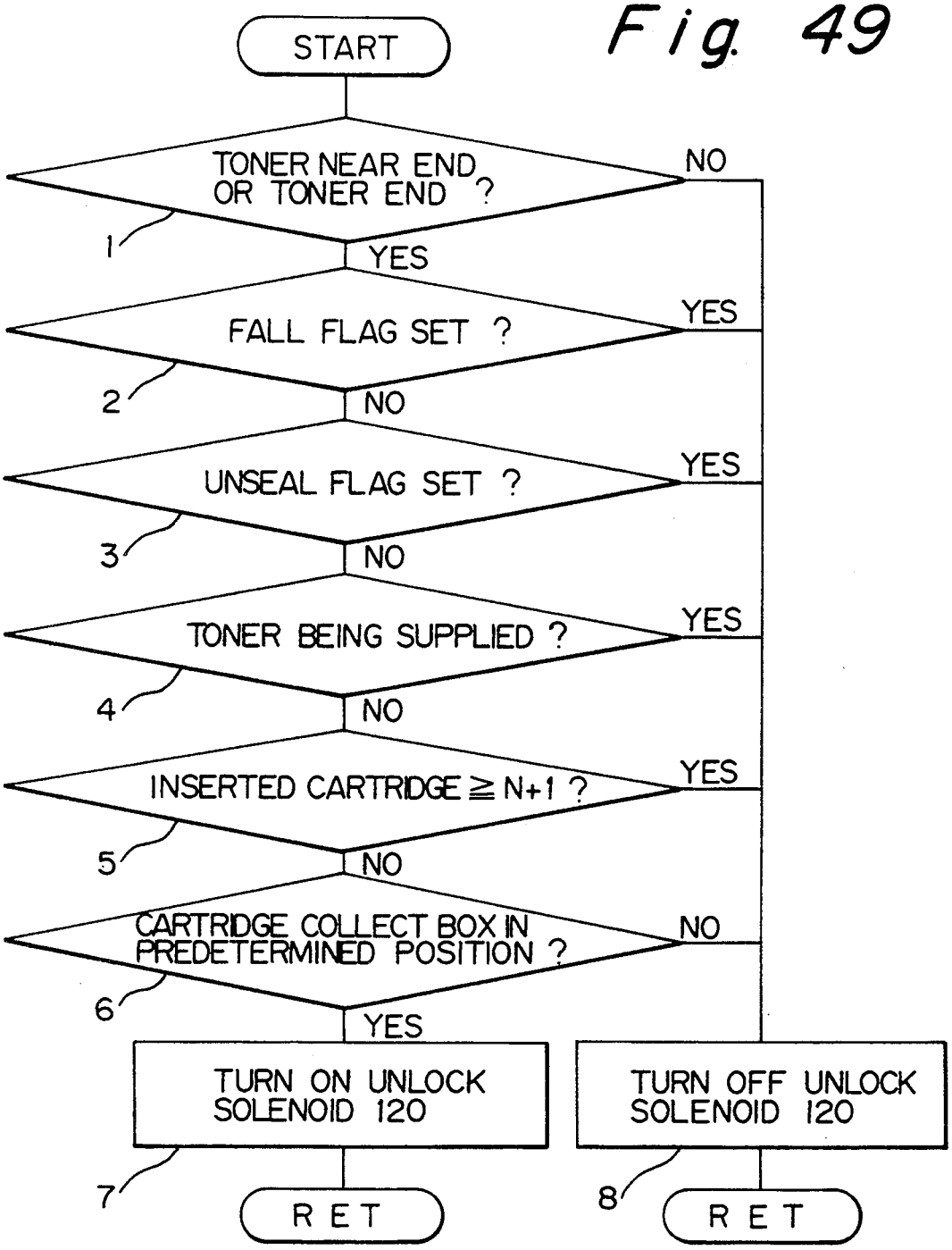

A reference will be made to FIG. 49 for describing door lock and unlock control associated with the cartridge inserting section. Preferably, the door 118 closing the opening 117 should not be opened except when needed, so that toner particles floating in the equipment may not be scattered about to the outside. In the illustrative embodiment, only when all the predetermined conditions are satisfied, the unlock solenoid is driven to allow the door 118 to be opened, as follows.

A first condition is that a toner near end condition or a toner end condition has been detected by toner density detection control. This is determined in a step 1. In such a condition, a new cartridge 112 filled with a toner has to be inserted into the equipment body.

A second condition is that the fall flag is not set, as determined in a step 2. The fall flag includes the fall 1 flag and the fall 2 flag. The fall 1 flag is set at the rise of a toner end signal which causes the reverse transport of the cartridge 112 to begin (see FIG. 45, step 3) and is reset at the fall of the output of the sensor 130 occurring when the leading end of the cartridge 112 moves away from the feeler 130*a* during the reverse transport (see FIG. 47, step 3). The second fall 2 flag is set simultaneously with the resetting of the fall 1 flag (see FIG. 47, step 4) and is reset at the rise of the output of the fall sensor in the box 133 occurring when the entire cartridge 112 moves away from the sensor (see FIG. 48, step 7). When the fall 1 flag is set, the cartridge 112 exists on the transport path during reverse transport. When the fall 2 flag is set, it is likely that the cartridge 112 having started to fall is partly remaining on the transport path. Therefore, it is necessary to inhibit the insertion of the next cartridge 112 while at least one of the fall 1 flag and fall 2 flag is set.

A third condition is that the unseal flag is not set, as determined in a step 3. The unseal flag is set at the rise of the output of the sensor 130 occurring when the trailing end of a cartridge 112 having been inserted moves away from the feeler 130*a* (see FIG. 43, step 4) and is reset at the fall of the output of the sensor 130 occurring when the trailing end of the seal member 114 removed from the bottom of cartridge 112 moves away from the feeler 130*b* (see FIG. 44, step 8). Specifically, when the unseal flag is set, the cartridge 112 is disposed above the hopper opening 124 and the rollers 150 are unsealing the cartridge 112.

A fourth condition is that toner supply is not under way, as determined in a step 4. While the toner supply is under way, the cartridge 112 is disposed above the hopper opening 124 to play the role of a lid and, therefore, the next cartridge 112 has to be prevented from being inserted.

A fifth condition is that the number of cartridges having been inserted is not greater than the number of cartridges which can be accommodated in the collecting box 133, plus one, as determined in the step 5. Specifically, the number of cartridges having been inserted means the total number of cartridges 112 inserted into the equipment while a single corrugated cardboard box 410 is used. Every time a cartridge 112 has been fully inserted (e.g. after the step 3, FIG. 43), the number of cartridges is incremented by one, and the resulting sum is stored in, for example, a nonvolatilt memory. The number of cartridges 112 which can be inserted into the equipment is the sum of the number of empty cartridges which can be accommodated in the box 133 and the number of cartridges that can be positioned above the hopper opening 124, i.e., one.

A sixth condition is that the collecting box 133 exists in a predetermined position in the equipment, as determined in a step 6. While the box 133 is pulled out of the equipment, the insertion of the next cartridge 112 has to be inhibited because the empty cartridge 112 cannot be transported in the reverse direction or let fall into the box 133.

Only if all the conditions described above are satisfied, the unlock solenoid 120 can be turned on to open the door, as executed in a step 7. When even one of such conditions is not satisfied, the unlock solenoid 120 is turned off by the step 8 to maintain the door in a locked state.

Figure 50:
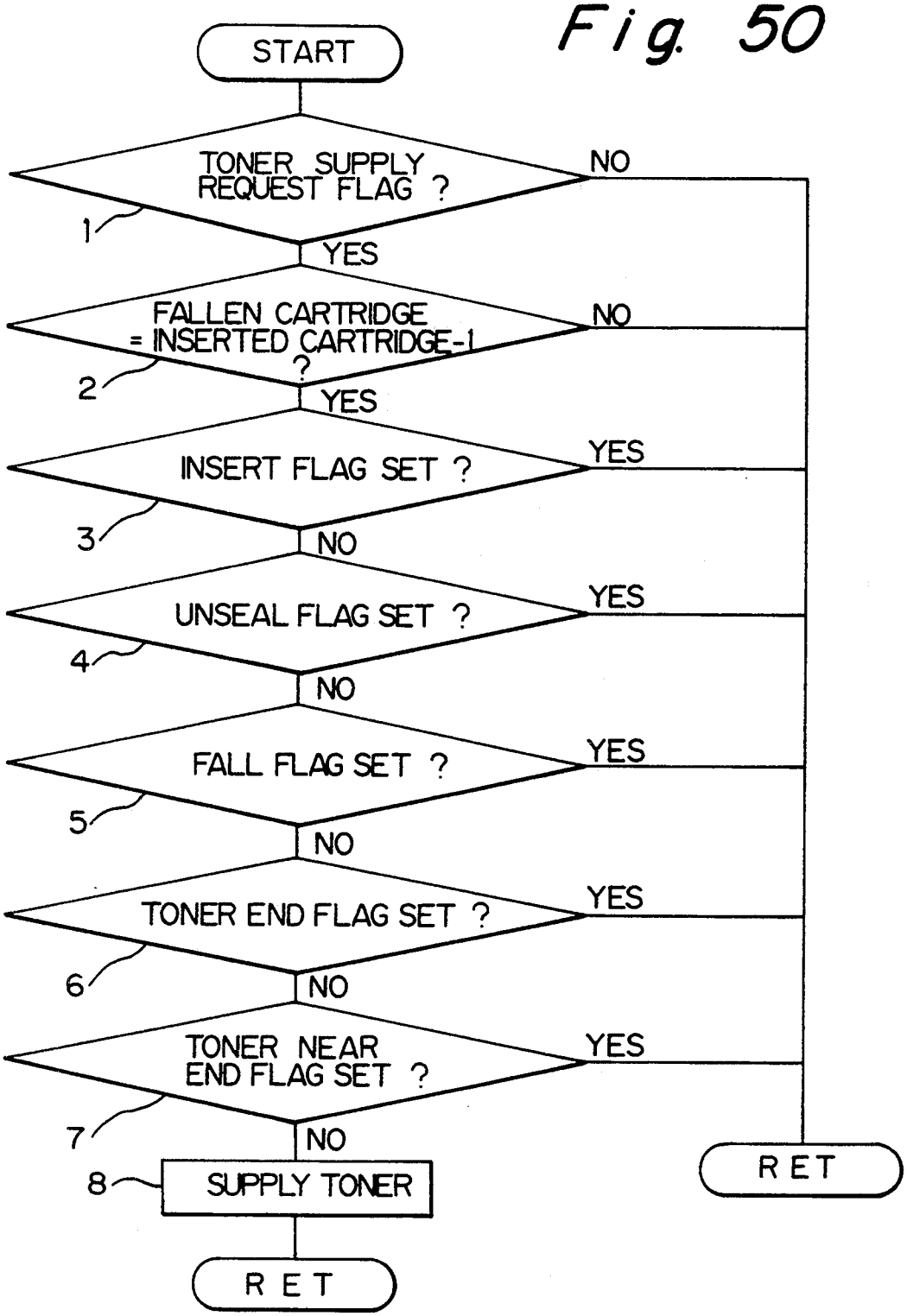

FIG. 50 shows a sequence of steps for inhibiting a toner from being supplied. Even when a toner supply request flag is set (step 1, YES), a toner supplying operation is inhibited when at least one of the following conditions is satisfied.

A first condition is that the number of cartridges fallen is not equal to the number of cartridges inserted, minus one, as determined in a step 2. The number of cartridges fallen means the total number of cartridges 112 fallen into the corrugated cardboard box 410 while the latter is used. Every time a cartridge 112 falls into the box 410, a fall counter counts it. The resulting count is stored in, for example, a nonvolatilt memory. So long as the number of cartridges fallen is equal to the number of cartridges inserted minus one, a cartridge 112 exists above the hopper opening 124. However, when the above-mentioned condition is satisfied, i.e., when the number of cartridges fallen is equal to the number of cartridges inserted, the cartridge 112 inserted last has already been transported in the reverse direction by the rise of a toner end signal and collected in the box 133, i.e., it does not exist above the hopper opening 124. Should the toner supply be effected in the absence of the toner cartridge 112 above the hopper opening 124, the toner would be sprinkled via the hopper opening 124 to the interior of the equipment, especially the cartridge transport path, due to mechanical vibrations generated by the agitator 111 and other members disposed in the hopper 109.

A second condition is that the insert flag is set, as determined in a step 3. The insert flag is set on the turn-on of the door open sensor (see FIG. 41, step 7) and is reset on the turn-off of the sensor 130 occurring when the trailing end of a cartridge 123 having been inserted moves away from the feeler 130*a* (see FIG. 43, step 3). Therefore, when the insert flag is set, a cartridge 112 is being transported toward the position above the hopper opening 124. Allowing a toner to be supplied in such a condition would also cause it to be scattered about.

A third condition is that the unseal flag is set, as determined in a step 4. The unseal flag is set while the rollers 150 are unsealing the cartridge 112, as stated earlier. When the cartridge 112 is being unsealed, the roller 131 for pressing the top of the cartridge 112 is not operative and, therefore, the cartridge 112 cannot satisfactorily serve as a lid although it is present above the hopper opening 124. This also brings about the scattering problem.

A fourth condition is that the fall flag is set, as determined in a step 5. The fall flag includes the fall 1 flag and the fall 2 flag. When at least one of the two fall flags is set, no cartridge 112 exists above the hopper opening 124.

A fifth condition is that the toner end flag is set, as determined in a step 6. The toner end flag is set during the course of copy inhibition control to be described later (FIG. 51, step 4) and is reset by the toner concentration detection control The toner end flag is set just after the toner near end flag which is set when the empty cartridge 112 transported in the reverse direction has fallen into the box 133 (FIG. 48, step 8). In this condition, too, no cartridge 122 exists above the hopper opening 124.

A sixth condition is that the toner end flag is set, as determined in the step 6. This toner end flag is set when the processing for dripping a cartridge 112 into the box 133 to be executed when a toner near end condition is detected by the toner concentration detection control complete (FIG. 48, step 8) and is reset by the copy inhibition control responsive to a toner end condition (FIG. 51, step 5) or the toner conentration detection control. This flag is set just after an empty cartridge 122 has fallen into the box 133, i.e., when no cartridge 122 exists above the hopper opening 124.

When at least one of the conditions described above is satisfied, toner supply is inhibited. When none of such conditions is satisfied, toner supply is effected in the step 6.

Figure 51A:
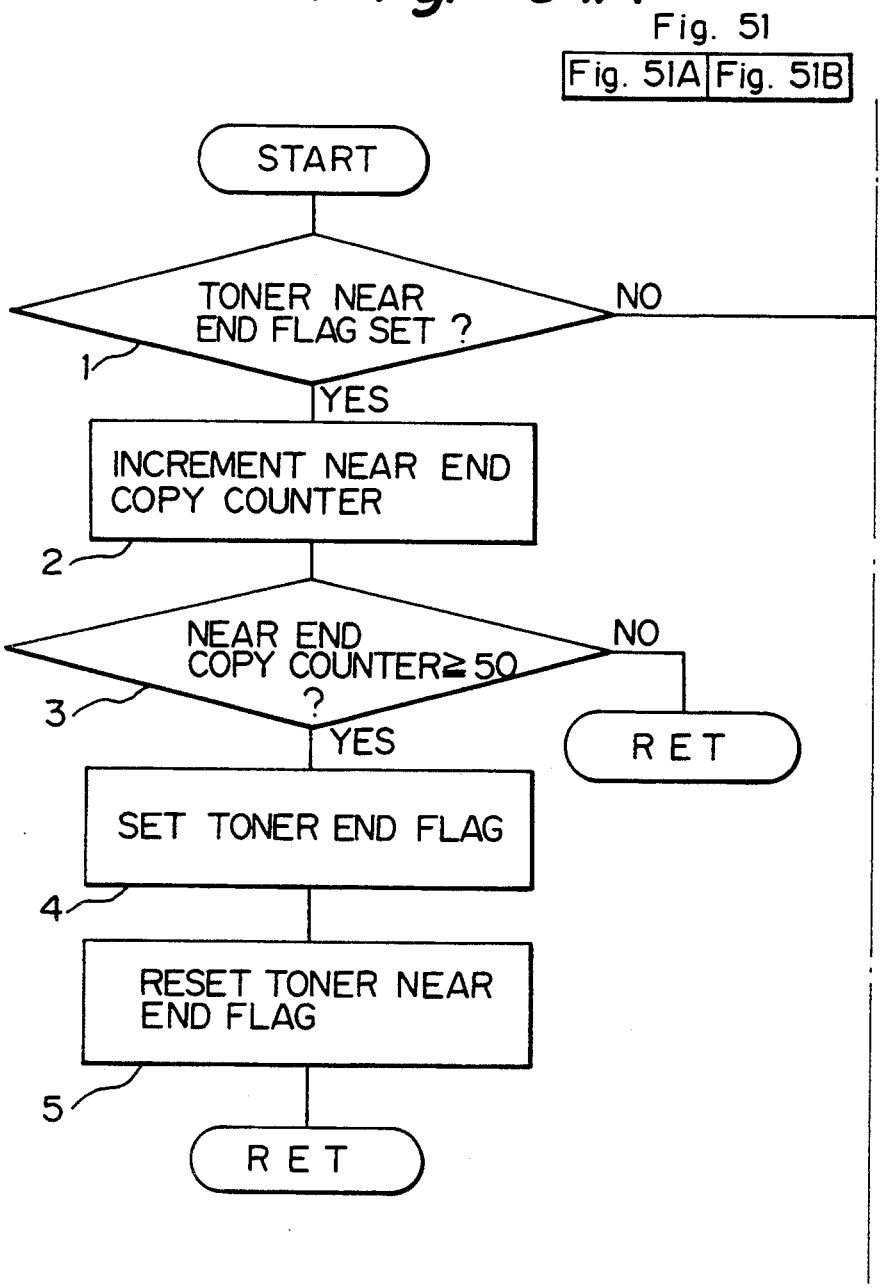
Figure 51B:
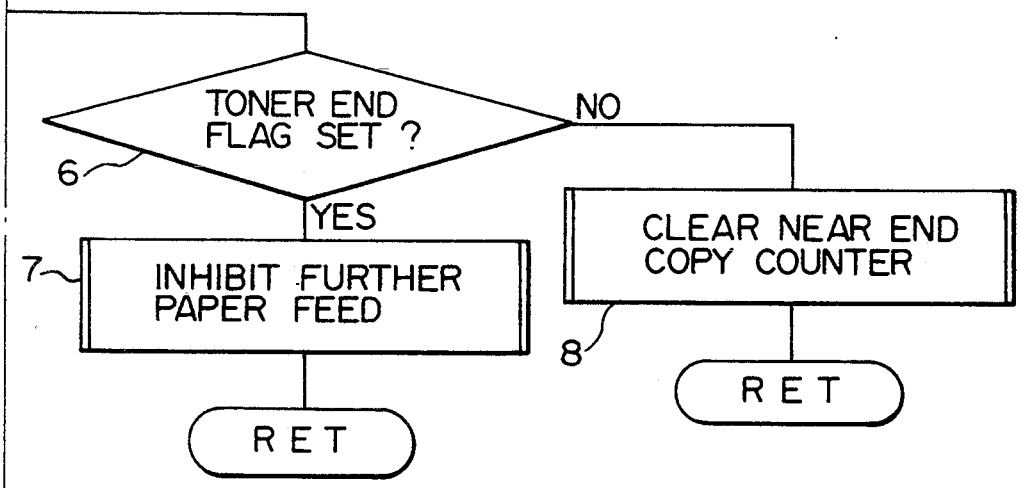

The copy inhibition control shown in FIG. 51 and responsive to a toner end condition is as follows. In a toner end condition wherein scarcely any toner is left in the casing 101, the control inhibits copying operations because a satisfactory image density would not be attainable. First, whether or not the toner near end flag is set is determined (1). The toner near end flag is set when the processing for dropping an empty cartridge into the box 133 to be executed when a toner near end condition is detected by the toner concentration detection control complete (FIG. 48, step 8), as stated previously. If the toner near end flag is set, a near end copy counter is incremented when a paper sheet is fed during a copying operation (2). Then, whether or not the content of the near end copy counter is greater than 50 is determined (3). If the answer of the step 3 is negative, the program returns to the step 1. The steps 1–3 are repeated until the near end copy counter exceeds 50 in the step 3. If the answer of the step 3 changes from negative to positive, the toner end flag is set (4), and then the toner near end flag is reset (5). Thereafter, the operation is transferred from the step to steps 6 and 7. In the step 7, any further paper feed is inhibited to thereby inhibit the copying operation. When the toner concentration is increased to toner supply, the toner near end flag and toner end flag are reset. As a result, the operation is transferred from the step 1 to a step 8 via the step 6 with the result that the near end copy counter is cleared. The content of the near end copy counter is written to, for example, a nonvolatilt memory.

Figures 53, 53A:
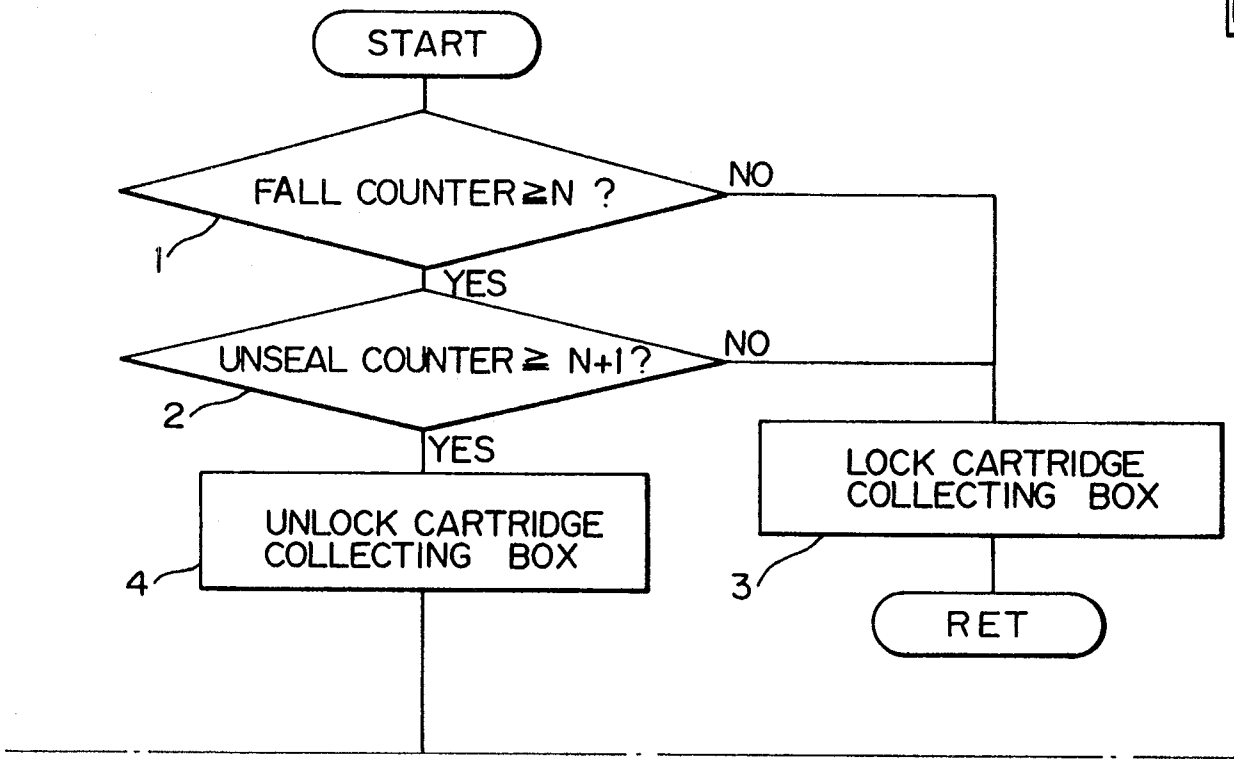
Figure 53B:
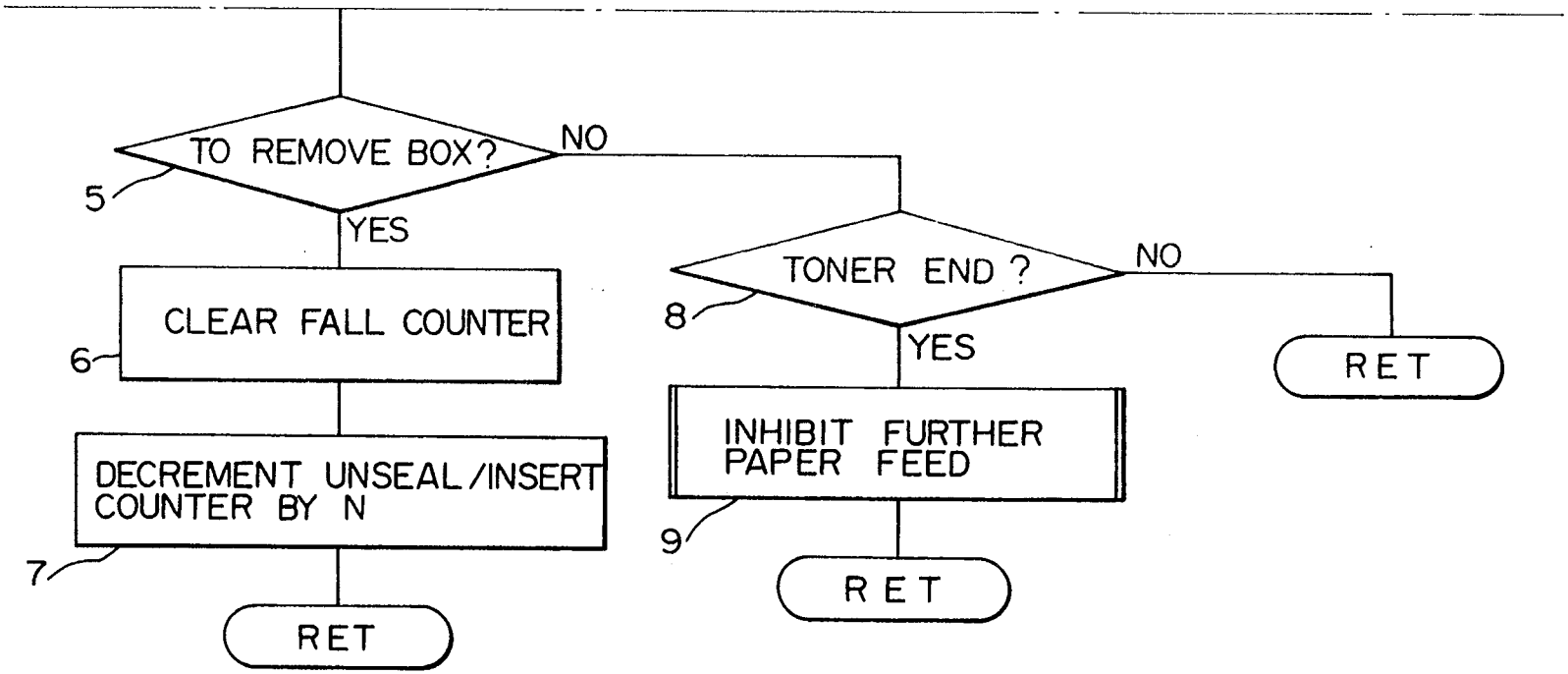

FIG. 53 shows a procedure for determining whether or not to allow the collecting box 133 to be pulled out of the equipment when the box 133 is full. When the box 133 is pulled out of the equipment, it is likely that the next cartridge 112 is inhibited from being inserted despite the detection of a toner near end condition, because the empty cartridge 112 cannot be transported in the reverse direction. It is preferable, therefore, that the box 133 is prevented from being pulled out of the equipment except when needed. In the illustrative embodiment, the unlock solenoid 431 (see FIGS. 25 and 27) is energized to allow the box 133 to be pulled out only when predetemined conditions are satisfied, as follows.

A first condition is that the content of the fall counter is equal to greater than the number of cartridges N that can be accommodated in the box 133, as determined in the step 1. The fall counter counts the number of empty cartridges 112 which are collected in the box 133, as stated earlier. If the number of collected cartridges 112 is smaller than N, there is a room for accommodating cartridges 112 in the box.

A second condition is that the content of the unseal counter is equal to or greater than N+1, as determined in a step 2. The unseal counted counts the cartridges 112 which were unsealed. Specifically, every time the operation for unsealing a cartridge 112 complete (e.g. after step 8, FIG. 44), the unseal counter is incremented and the resulting count is written to, for example, a nonvolatilt memory. This condition is selected for the following reason. The total number of cartridges 112 which can be inserted into the equipment is N which is the number of cartridges 112 accommodatable in the box 133, plus one which is the cartridge 112 positioned above the hopper opening 124, as stated earlier. Hence, while the number of inserted cartridges is N, it is not necessary to pull out the box 133. On the other hand, to insert a cartridge 112 after the "N+1" cartridge 112, the "N+1" cartridge above the hopper opening 124 has to be collected in the box 133. Therefore, it is necessary to make the box 133 ready to move outward before, at latest, the reverse transport of the "N+1" cartridge to the box 133 begins. The box 133 may be prepared for the pull-out when the "N+1" cartridge 122 has been fully inserted. This is not satisfactory, however, because it is likely that the "N+1" cartridge 112 may jam the path in the event of unsealing and be removed from the position above the hopper opening 124. Such a cartridge would not be the subject of reverse transport. To eliminate this problem, the illustrative embodiment determines whether or not to allow the box 133 to be pulled out on the basis of the number of cartridges existing in the equipment at the time when a cartridge 112 which is the subject or reverse transform is finally determined. For this purpose, use is made of the unseal counter which counts the cartridges which were unsealed.

Only if all the conditions described above are satisfied, the collecting box 133 can be pulled out.

In detail, whether or not the content of the fall counter is equal to or greater than N is determined (1). If the answer of the step 1 is negative, the collecting box 133 is locked in position. If the answer of the step 1 is positive, whether or not the content of the unseal counter is equal to or greater than N+1 is determined (2). If the answer of the step (2) is negative, the box 133 is locked (3). If the answer of the step (2) is positive, the box 113 is unlocked to allow it to be pulled out. Thereafter, whether or not the box 133 has been pulled out is determined (5). If the answer of the step 5 is positive, the fall counter is cleared (6), and the unseal counter and insert counter are each reduced by N (7). Thereafter, the programs repetitively executes the step 1 or 2 and then the step 3 until the above two conditions have been satisfied. If the answer of the step 5 is negative, meaning that the box 133 is not pulled out, whether or not a toner end condition has occurred is determined (8) and, if the answer is negative, the program returns. Thereafter, the steps 1, 2, 4, 5 and 8 are repetitively executed with the box 133 while holding the box 133 in the locked state, until the answer of the step 5 of that of the step 4 changes to positive. If the box 133 has been pulled out as determined in the step 5, the fall counter is cleared (6) and the unseal counter and insert counter are each reduced by N. On the other hand, when a toner end condition has occurred as determined in the step 8, any further paper sheet operations are inhibited to thereby inhibit copying operations (9). At this instant, the box 133 remains in the unlocked state. It is to be noted that when the unlock solenoid 431 is turned on to unlock the box 133, the reverse transport of the empty cartridge above the hopper opening 124 is inhibited.

Figure 54:
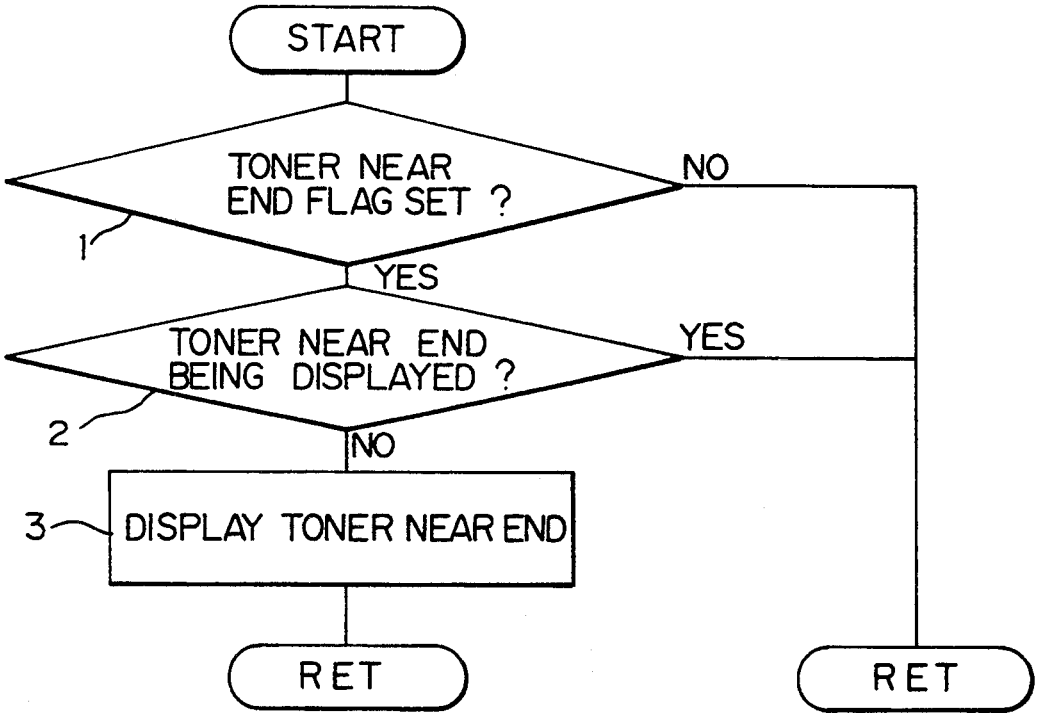

FIG. 54 shows control over the turn-on of a toner near end indicator. It has been customary to turn on a toner near end indicator as soon as a toner near end condition is detected by toner concentration detection control, urging the operator to supply a toner. This is not applicable to the illustrative embodment for the following reasons. In the embodiment, when a toner near end condition is detected by the toner concentration detection control, the processing for dropping the empty toner cartridge 122 above the hopper opening 124 into the box 133 is executed first. While such processing is under way, the next cartridge 112 cannot be inserted because the empty cartridge 112 exists on the transport path. Moreover, the door 118 closing the opening 117 is locked in position by the previously stated door lock/unlock control (FIG. 49, step 2). Hence, should the toner near end indicator be unconditionally turned on on the detection of a toner near end condition, the operator would be urged to insert a toner cartridge 112 despite that the door 118 does not open. In light of this, the embodiment turns on the toner near end indicator after the toner near end flag has been set and not just after the detection of a condition of interest. The near end flag is set when the processing for dropping the empty cartridge 112 into the box 133 and executed on the detection of a toner near end condition by the toner concentration detection control completes (FIG. 48, step 8) and is reset by the copy inhibition control responsive to toner end detection, which will be described, or by the toner concentration detection control. When the near end flag is set, the procedure for dropping the cartridge 122 into the box 133 has been completed. In this condition, the transport path is not occupied and allows the next cartridge 112 to be inserted. Specifically, whether or not the near end flag is set is determined (1) and, if it is set, whether or not the toner near end indicator is turned on is determined (2). If the answer of the step 2 is negative, the toner near end indicator is turned on (3).

Figure 55:
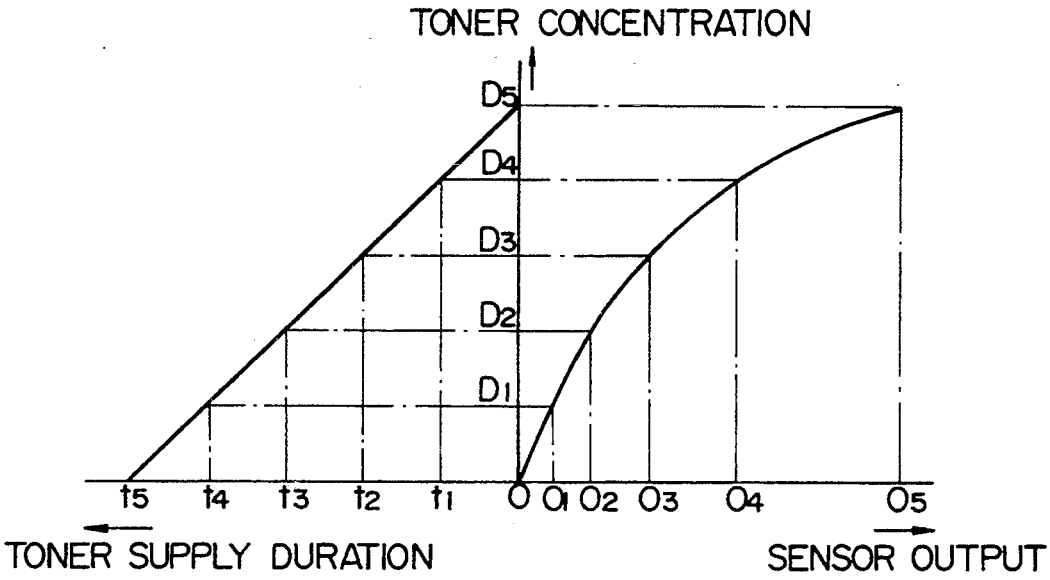
FIG. 55 shows a relation between the toner concentration an the amount of toner supply particular to the embodiment.
Figure 56:
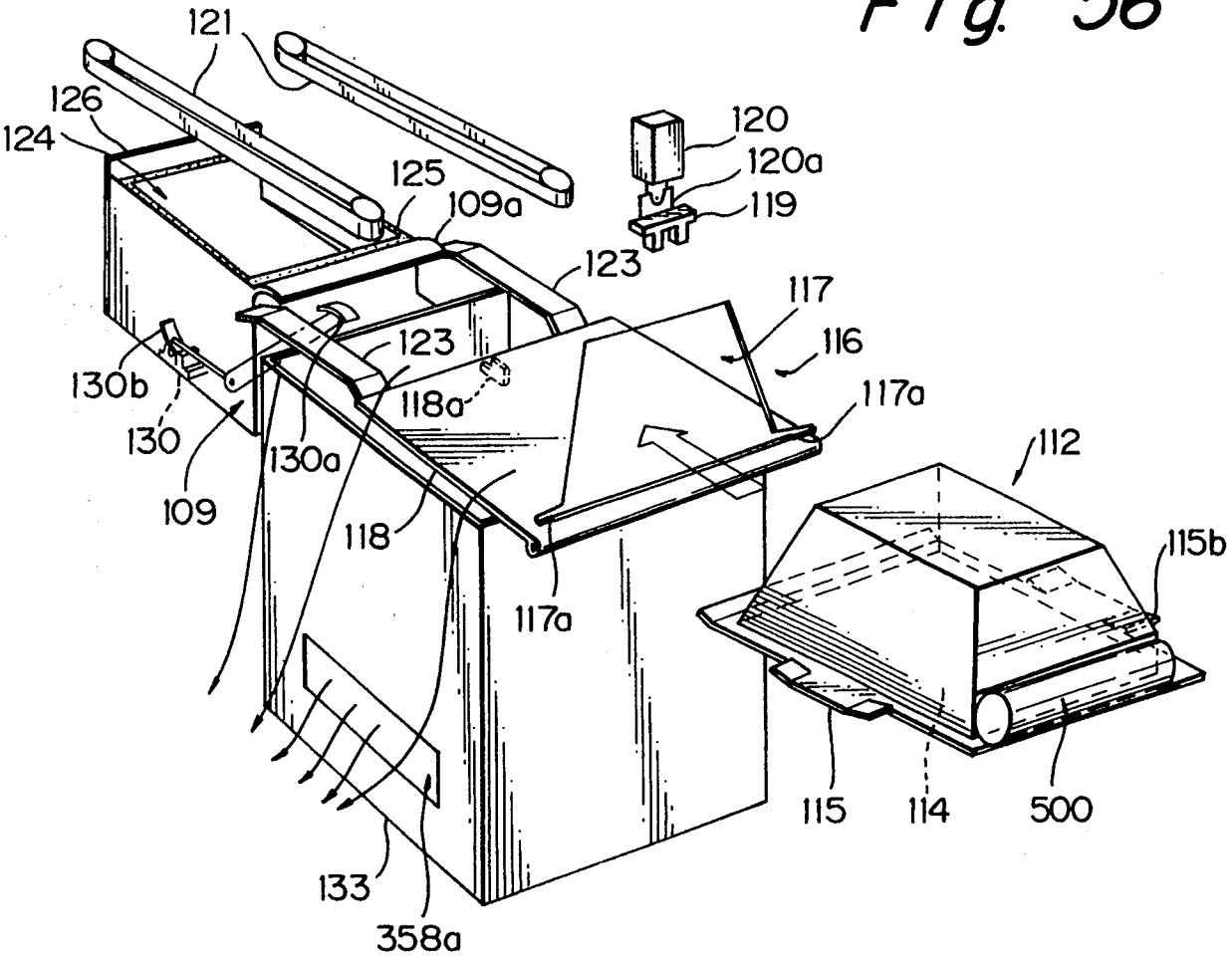
FIG. 56 is a perspective view showing a modified form of the toner supply mechanism.
Figure 57:
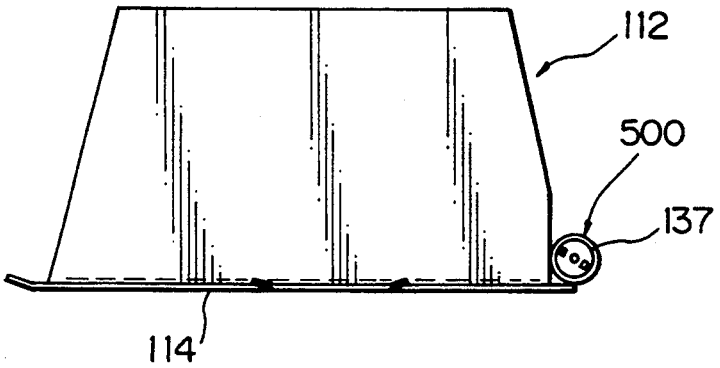
FIG. 57 is a side elevation as viewed from the left, showing a cartridge forming part of the modified toner supply mechanism.
Figure 58:
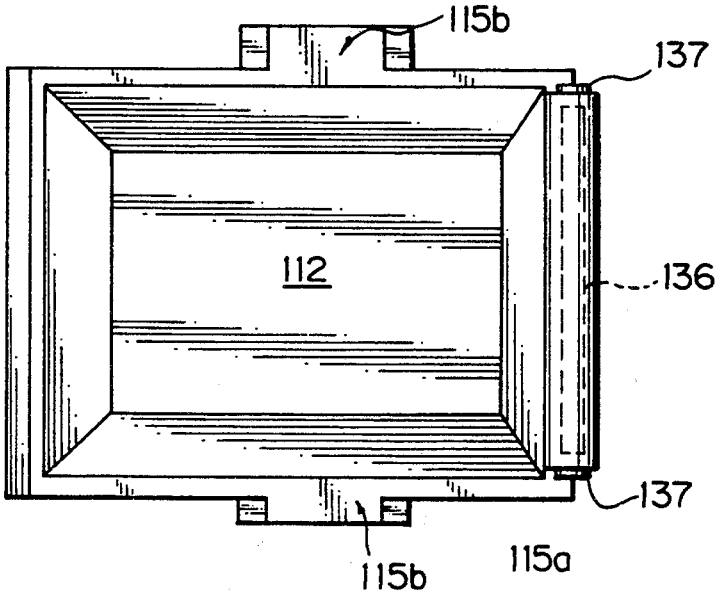
FIG. 58 is a bottom view of the cartridge shown in FIG. 57.
Figure 59:
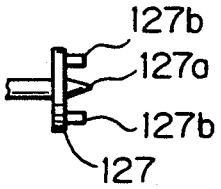
FIG. 59 is an enlarged view of a joint included in the modified toner supply mechanism.
Figure 60:
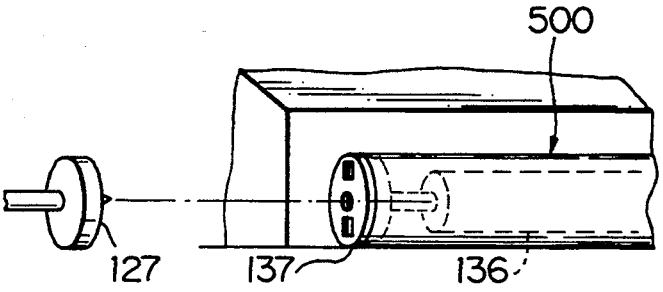
FIG. 60 is a view showing a relation between the joint and a rotary disk mounted on the cartridge.

How to determine the duration of toner supply when a cartridge 122 is inserted will be described with reference to FIG. 52. The duration of toner supply mentioned means a period of time T15 over which a toner should be supplied just after the toner cartridge 112 has been unsealed at the toner supply position. This is effected at a timing indicated by a circled 3 in FIG. 23. In this embodiment, the period of time T15 is determined such that a toner is supplied in an amount matching a difference between the latest toner concentration detected by the toner concentration detection control and a target concentration particular to the toner concentration control. For this purpose, use is made of a lookup table listing toner concentrations and corresponding durations of toner supply which are determined by experiments. Alternatively, an adequate duration may be determined by using an equation representative of a toner concentration and a duration. In the illustrative embodiment, an area of predetermined potential formed by a laser beam from the semiconductor laser 74 is developed, and the photosensor 360 detects a toner concentration in terms of the quantity of light incident thereto from the developed area. FIG. 55 shows a relation between the output of the photosensor 360 and the toner concentration and the relation between the toner concentration and the duration of toner supply.

Figure 52:
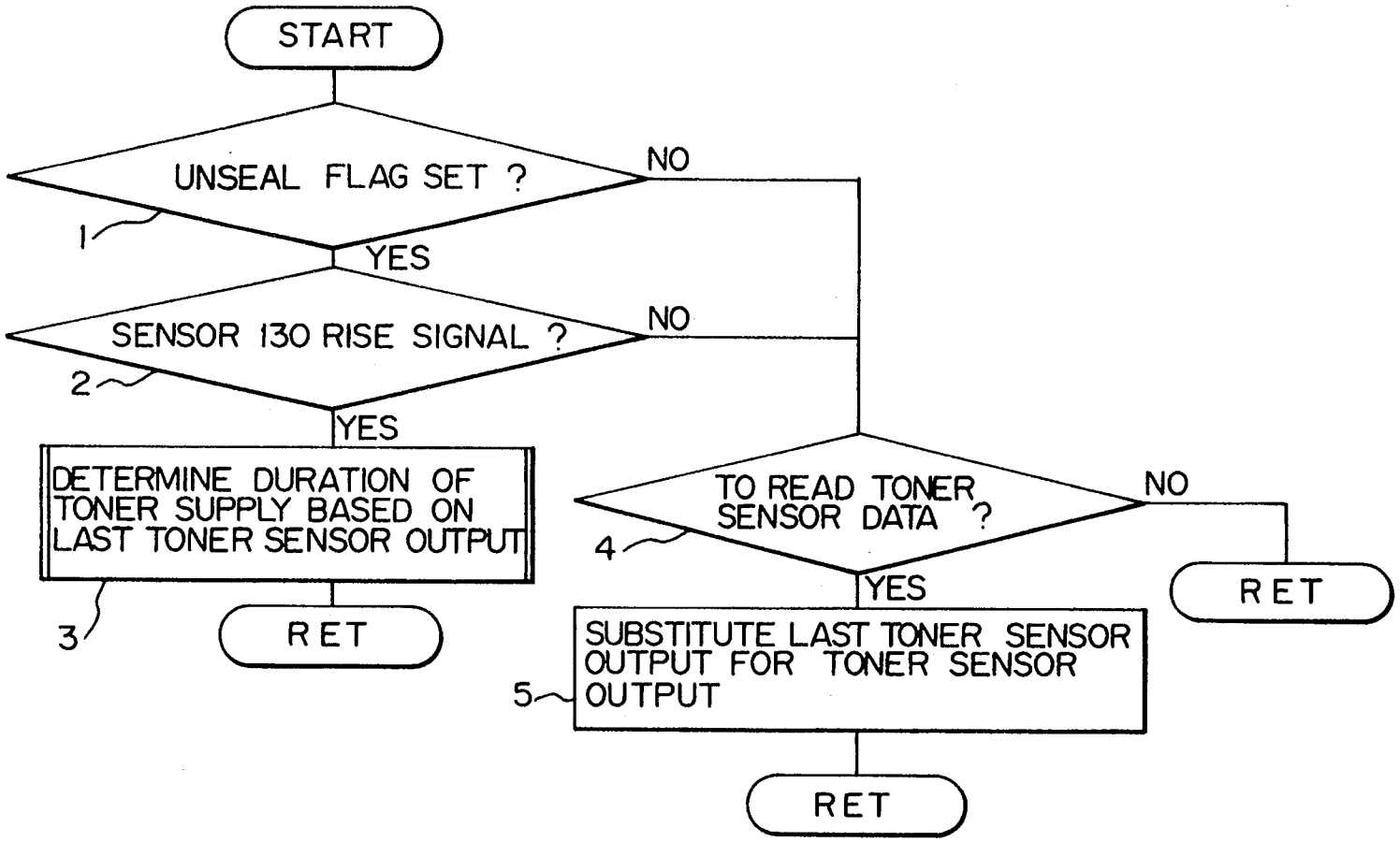

As shown in FIG. 52, whether or not the rollers 150 have fully unsealed the cartridge 112 is determined (1 and 2). If the answer of the step 2 is positive, a duration of toner supply is determined by use of the last toner sensor output (3). Regarding the last toner sensor output, when the concentration data from the sensor 360 is read every ten paper sheets (4 and 5), the read data is written to a last toner sensor output memory while updating the latter.

A modified form of the toner supply mechanism will be described hereinafter.

In the mechanism described above, the seal members 114 stripped from the cartridges 112 are collected in the seal collecting box 151. Hence, when the box 151 is full, it has to be pulled out of the equipment or otherwise positioned to facilitate the removal of the seal members 114. Moreover, the cartridge 112 is unsealed by the rollers 150 which are mounted on the equipment body and rotated while nipping the free end of the seal member 114. The seal member 114 is apt to jam the path around the rollers 150 for the reasons described earlier. The modified mechanism which will be described enhances efficient discarding of the seal member 114 stripped from the bottom of the cartridge 112 and promotes sure unsealing of the cartridge 112. The modification differs from the above embodiment in the configuration of the cartridge 112 and the structure of the unsealing means.

Referring to FIGS. 56–60, a cartridge 112 has a seal container 500 at the rear end thereof with respect to the direction of insertion into the equipment. A take-up roller is accommodated in the seal container 500. Rotatable disks 137 are provided on both sides of the seal container 500, and each is connectable to a joint 127 mounted on the equipment body as will be described. The shaft of the take-up roller 136 is affixed at opposite ends to the inner surfaces of the disks 137. Each joint 127 of the equipment body has a conical positioning lug 127*a* and a pair of drive lugs 127*b* each having a rectangular cross section. The disks 137 are each formed with holes for receiving the lugs 127*a* and 127 *b* of the associated joint 127. Adhesive is applied to the lower surfaces of the front, rear, right and left portions of the flange 115*a*. The seal member 114 is first adhered to the front portion of the flange 115*a*, then adhered to the other portions up to the rear end portion, then folded back to the front end of the cartridge 112, then extended to the take-up roller 136 through a seal inlet which is formed through the bottom of the seal container 500, and then adhered to the surface of the roller 136.

Figure 61:
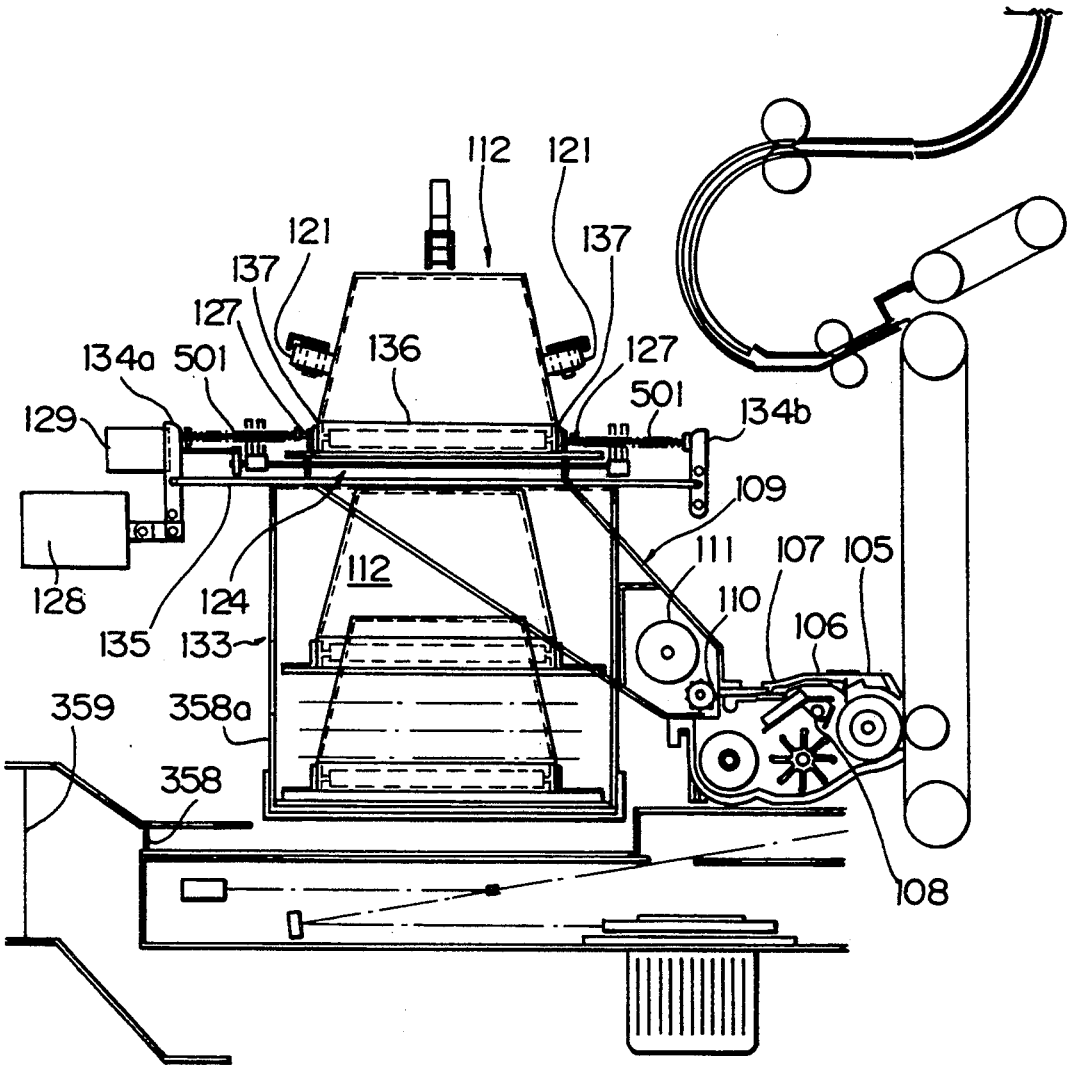
FIG. 61 is a front view of the modified toner supply mechanism.
Figure 62:
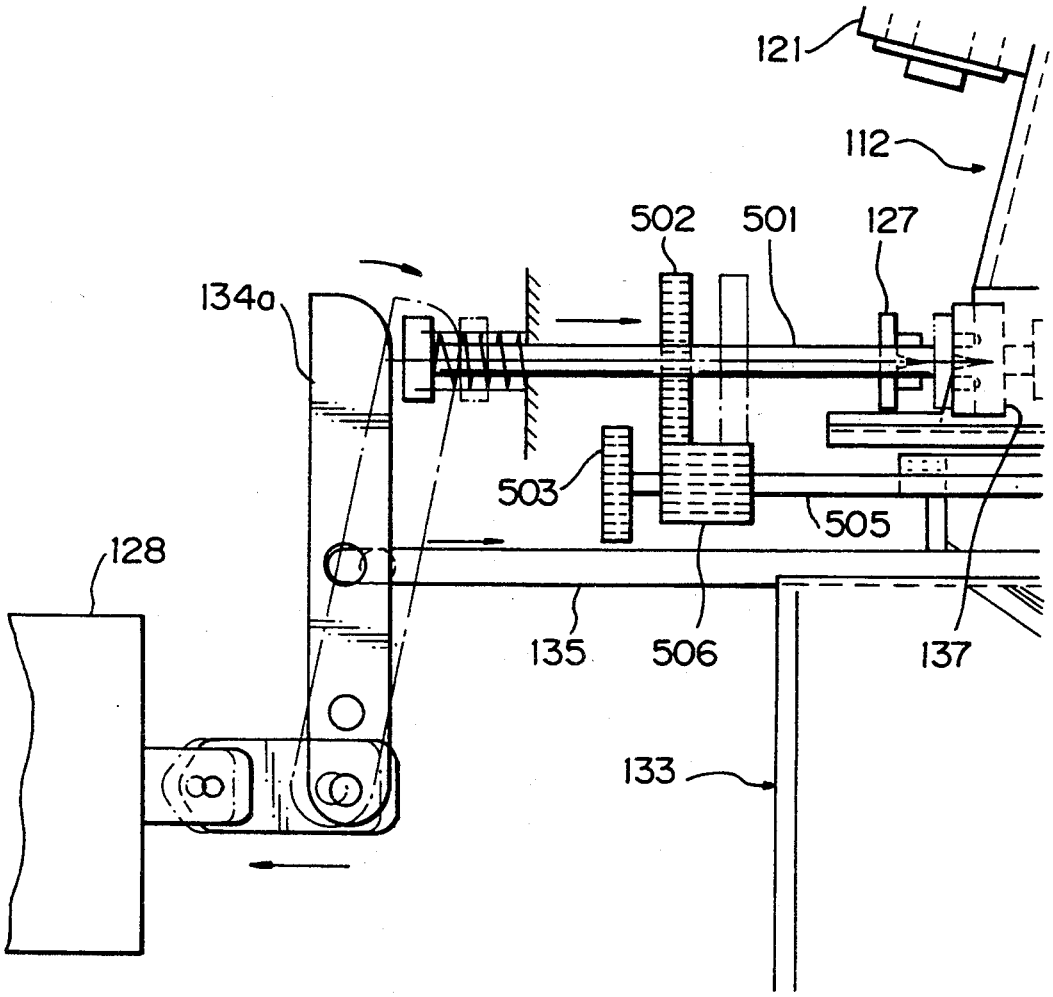
FIG. 62 is a front view as seen from the left, showing a mechanism for unsealing the cartridge.
Figure 63:
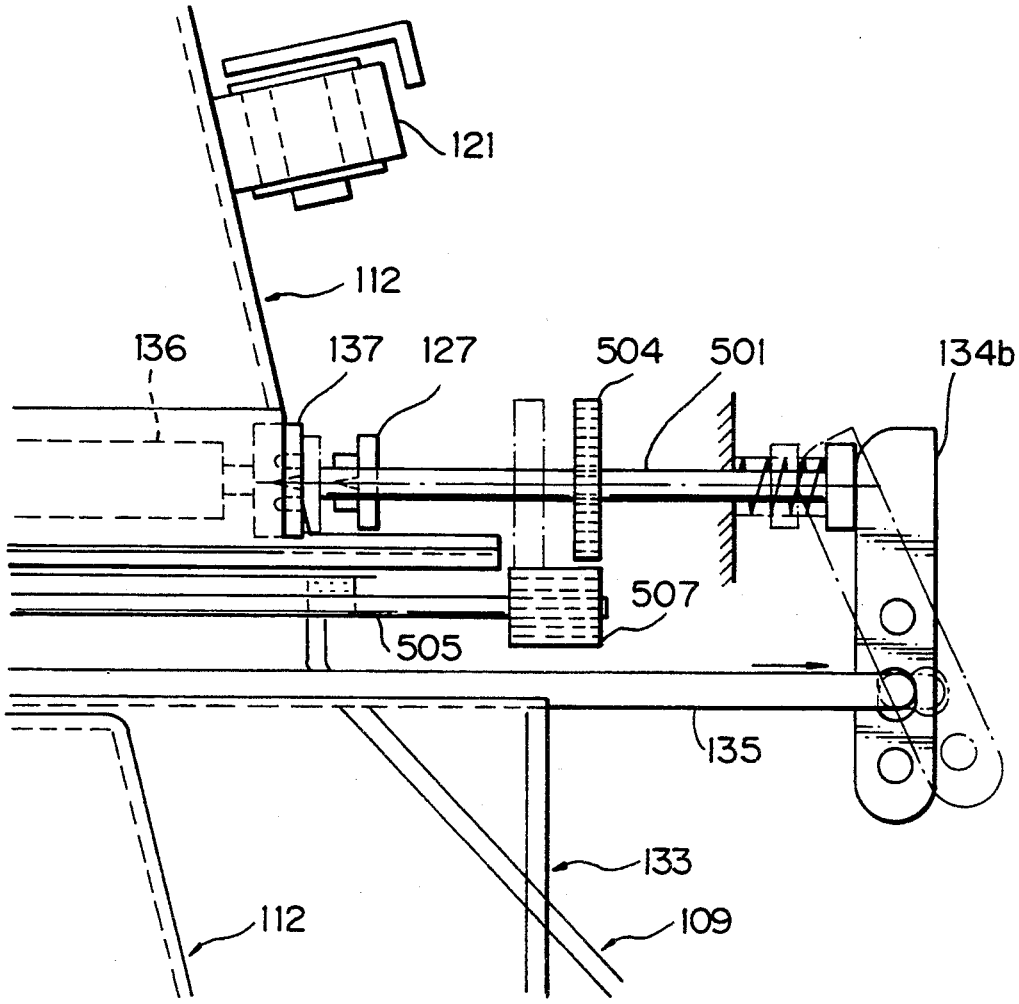
FIG. 63 is a front view of the unsealing mechanism as seen from the right.

FIGS. 61–63 show the unsealing means mounted on the equipment body. As shown, the unsealing means has, in addition to the joints 127 connectable to the disks 137 of the cartridge 122, a mechanism for selectively moving the each joint 127 to either one of an operative position where the lugs 127*a* and 127*b* mate with the holes of associated one of the disks 137 of the cartridge 124 when the cartridge 124 is disposed above the hopper opening 124 and an inoperative position where the former is retracted away from the latter in the left-and-right direction, and a mechanism for rotating the joints 127. The mechanism for moving the joints 127 has a right and left rotary shaft 501 each being journalled to a side panel of the equipment at one end thereof and carrying one of the joints 127 at the other end. The shafts 501 are constantly biased away from each other by springs. A left lever 134*a* is operatively connected to the pinch solenoid 128 at the lower end thereof and is rotatably supported by a shaft. The other end of the left lever 134*a* abuts against the rear end of the shaft 501. A right lever 134*b* is rotatably supported by a shaft substantially at the center thereof and abuts against the rear end of the other of right shaft 501 at one end thereof. A connecting rod 135 has one end thereof rotatably connected to the left lever 134*a* above the support shaft of the latter and has the other end rotatably connected to the right lever 134*b* below the support shaft of the latter. A gear 502 is fixed in place substantially at the center of the shaft 501. The mechanism for rotating the joints 127 has a rotatable gear shaft 505. An input gear 503 is affixed to the left end of the gear shaft 505 for reducing the drive speed transmitted thereto from the motor 129 (see FIG. 61). The right end of the gear shaft 505 extends as far as a position below a gear 504 which is mounted on the right rotatable shaft 501. A left output gear 506 is mounted on the gear shaft 505 in a position where if faces the gear 502 mounted on the left shaft 501. A right output gear 507 is mounted on the gear shaft 505 in a position where if faces the gear 504 mounted on the right shaft 501. The output gears 506 and 507 and respectively held in mesh with the gears 502 and 504 mounted on the shafts 501. The gears 506 and 507 each has a length, as measured in the right-and-left direction, which allows it to remain in mesh with the associated gear 502 and 504 even when the joint 127 is moved in the right-and-left direction between the operative and inoperative positions.

The unsealing mechanism described above is operated as follows. While an unsealing operation is not under way, the pinch solenoid 128 and motor 129 are turned off. In this condition, the rotary shafts 501 of the moving mechanism are urged away from each other in the right-and-left direction by springs, maintaining their joints 127 in the inoperative positions. To start an unsealing operation, the pinch solenoid 128 and motor 129 are tuned on. Then, the solenoid 128 rotates the left lever 134*a* clockwise about the support shaft thereof with the result that the left lever 134*a* pushes the rear end of the right rotary shaft 501 with the end thereof. This moves the joint 127 mounted on the left shaft 5051 to the operative position. The connecting rod 135 supported at one end by the left lever 134*a* is bodily moved to the right to in turn rotate the right lever 134*b* counterclockwise about the support shaft. Then, the right lever 134*b* pushes the right shaft 501 with the end thereof and thereby moves the joint 127 of the shaft 501 to the operative position. As a result, the right and left shafts 501 are connected to the shaft of the take-up roller from opposite sides. The rotation of the motor 129 is transmitted to the take-up roller via the input gear 503, gear shaft 505, output gears 506 and 507, gears 502 and 504 on the shafts 501, shaft 501, joints, and disks 137. Consequently, the take-up roller 136 takes up the seal member 114 from the bottom of the cartridge 112 to thereby unseal the cartridge 112.

The modified cartridge 112 described above is inserted into the equipment body, transported (forward and reverse) and unsealed under the same control as in the previous embodiment. It is noteworthy that the modified cartridge 112 is less likely to jam the path around the unsealing position than the previous embodiment, eliminating the need for the jam detection control associated with such a position as well as the feeler 130*b*.

While the embodiment described above uses belts for positioning the cartridge 112 above the hopper opening 124, it may be modified to hold the belts in an inoperative condition and allow the user to insert the cartridge 112 as far as the position above the hopper opening 124.

The removable box 133 for collecting empty cartridges 112 may be replaced with a box which is fixed in a position easily accessible when a door mounted on the equipment body is opened.

The embodiment shown and described has unsealing means incorporated in the equipment for unsealing the cartridge 112 automatically. Alternatively, the operator may unseal the cartridge 112 before inserting it into the equipment or after positioning it in the toner supply position in the equipment. Specifically, the operator may unseal the cartridge 112 by positioning it upside down and insert it into the equipment. Then, the unsealed cartridge 112 will be brought to the supply position either automatically or manually and then turned over to let the toner fall. To allow the operator to unseal the cartridge 112 after locating it at the supply position, the seal member 114 may be adhered to the front edge of the cartridge 112 first, adhered over to the other edges up to the rear edge, folded back to the front edge, and extended to the outside by a length which the operator can pinch. Then, the operator will locate the cartridge 112 at the supply position and then pull the tag of the seal member to unseal the cartridge.

The opening for the mounting and dismounting the box 133 and the opening for inserting the cartridge 112 may be formed on different sides of the equipment, instead of the common front panel 116. For example, the box 113 may be removably mounted at the rear of the hopper opening 124, and the opening for the ingress and egress of the cartridge 112 may be formed in the rear panel of the equipment. In such a case, the transport belts will be disposed between the hopper opening 124 and the box 133 located at the rear of the opening 124. Further, when the box 133 is located at the rear of the hopper opening 124, the belts may be extended from the front end of the equipment to the box 133 to convey the cartridge 112 from the inlet of the equipment to the hopper opening 124 and from the hopper opening 124 to the box 133.

While the embodiment has been shown and described in relation to a developing device using a two component developer made up of a toner and a carrier, the present invention is also practicable with a developing device of the type using a one component developer, i.e., a toner.

In summary, image forming equipment of the present invention achieves various unprecedented advantages, as enumerated below.

(1) An empty cartridge released a toner at a supply position is transported to a collecting position remote from the supply position by transporting means. The operator, therefore, can insert the next cartridge without removing the empty cartridge.

(2) Since the empty cartridge is automatically removed to provide a space for the next cartridge and collected in a remote place, the toner remaining in the empty cartridge is not scattered about despite a stream of air which will be produced in the event of insertion of the next cartridge.

(3) Since empty cartridges are collected in a location independent of the toner supply position, use can be made cartridges of the same size.

(4) The operator can discard empty cartridges by pulling out the entire collecting means from the equipment, so that toner particles remaining on the cartridges are not scattered about.

(5) The collecting means and the cartridge are introduced into the equipment through openings which are formed in the same wall of the equipment, promoting efficient operations.

(6) Transporting means transports the cartridge to a predetermined position above the opening of the collecting means by guiding particular portions of the cartridge. These particular portions are positioned substantially at the center of the cartridge with respect to the direction of transport. Hence, the cartridge can be collected in the collecting means in a relatively horizontal position and, therefore, stacked in a desirable manner.

(7) The toner cartridges attracting means other by attracting means provided thereon. This is successful in accommodating a great number of cartridges in the collecting section.

(8) As soon as the concentration of toner in a developing device is reduced to predetermined one, the transporting means is automatically driven to transport the empty cartridge from the toner supply position to the collecting section. The operator, therefore, does not have to perform any operation for starting the transport of the cartridge.

(9) Empty cartridges are stack in the collecting section with their open ends facing downward. Hence, each cartridge accommodates at least part of the underlying cartridge. This is successful in reducing the space for collection and, therefore, increasing the number of cartridges which can be accommodated in the collecting section.

Various modifications will become possible for those skilled in the art after receiving the teachings of the present disclosure without departing from the scope thereof.

What is claimed is:

1. Image forming equipment of the type supplying a toner to a developing device thereof by using a cartridge which contains said toner therein and has an openable wall portion, said equipment comprising:

a cartridge inserting section for inserting said cartridge into said equipment;

a toner supplying section independent of said cartridge inserting section and having a toner supply position where said cartridge supplies the toner;

opening means for opening said openable wall portion;

cartridge transporting means for transporting said cartridge having been inserted via said cartridge inserting section to said toner supply position, said opening means opening said openable wall portion of said cartridge at said toner supply position, whereby the toner is supplied to said toner supplying section; and sensing means for determining whether or not said cartridge has been brought to a predetermined position by said cartridge transporting means; and alerting means responsive to an output of said sensing means for showing an occurrence that said cartridge has failed to reach said predetermined position despite that said cartridge transporting means has operated a predetermined period of time.

2. Equipment as claimed in claim 1 further comprising control means responsive to an output of said sensing means for causing said cartridge transporting means to repeat an operative and an inoperative state alternately a predetermined number of times when said cartridge has failed to reach said predetermined position despite that said cartridge transporting means has operated a predetermined period of time.

3. Equipment as claimed in claim 1, further comprising control means responsive to an output of said sensing means for inhibiting said cartridge transporting means from operating when said cartridge has failed to reach said predetermined position despite said cartridge transporting means has operated a predetermined period of time.

4. Equipment as claimed in claim 1, further comprising agitating means for agitating the toner in said developing device in response to the supply of the toner to said toner supplying section, and control means for controlling the duration of agitation by said agitating means.

5. Equipment as claimed in claim 4, further comprising duration determining means for determining said duration of agitation on the basis of the concentration of the toner in said developing device.

6. Equipment as claimed in claim 1, further comprising toner sensing means for sensing the amount of the toner remaining in said developing device.

7. Image forming equipment of the type supplying a toner to the developing device thereof by using a cartridge which contains said toner therein and has an openable wall portion, said equipment comprising:

a cartridge inserting section for inserting said cartridge into said equipment;

a toner supply section independent of said cartridge inserting section and having a toner supply position where said cartridge supplies the toner;

opening means for opening said openable wall portion;

cartridge transporting means for mechanically and automatically transporting said cartridge having been inserted via said cartridge inserting section to said toner supply position, said opening means opening said openable wall portion of said cartridge at said toner supply position, whereby the toner is supplied to said toner supply section;

an openable door provided in an inlet to said cartridge inserting section; and control means for inhibiting said equipment from operating when said door is not closed within a predetermined period of time after said cartridge has been inserted into said cartridge inserting section.

8. Equipment as claimed in claim 7, further comprising alerting means for showing an occurrence that said door is not closed within a predetermined period of time after said cartridge has been inserted into said cartridge inserting section.

9. Image forming equipment of the type supplying a toner to a developing device thereof by using a cartridge which contains said toner therein and has an opening for releasing said toner and a seal member for sealing said opening, said equipment comprising:

a cartridge inserting section for inserting said cartridge;

a toner supplying section independent of said cartridge inserting section and having a toner supply section where said cartridge supplies the toner;

unsealing means for removing said seal member from said cartridge;

accommodating means for accommodating said seal member removed from said cartridge by said unsealing means;

cartridge transporting means for transporting said cartridge having been inserted into said cartridge inserting section to said toner supply position;

sensing means for monitoring a condition in which said unsealing means removes said seal member from said cartridge; and alerting means responsive to an output of said sensing means for showing an occurrence that a predetermined removal condition is not set up despite that said unsealing means has operated a predetermined period of time.

10. Equipment as claimed in claim 9, further comprising accommodating means for accommodating said seal member removed from said cartridge by said unsealing means.

11. Equipment as claimed in claim 9, further comprising cartridge transporting means for transporting said cartridge having been inserted into said cartridge inserting section to said toner supply position.

12. Equipment as claimed in claim 11, further comprising sensing means for monitoring a condition in which said unsealing means removes said seal member from said cartridge.

13. Equipment as claimed in claim 12, further comprising alerting means responsive to an output of said sensing means for showing an occurrence that a predetermined removal condition in not set up despite that said unsealing means has operated a predetermined period of time.

14. Equipment as claimed in claim 9, further comprising control means responsive to an output of said sensing means for causing said unsealing means to repeat an operative state and an inoperative state alternately a predetermined number of times when a predetermined removal condition is not set up despite that said unsealing means has operated a predetermined period of time.

15. Equipment as claimed in claim 9, further comprising control means responsive to an output of said sensing means for inhibiting the operation of said unsealing means when a predetermined removal condition is not set up despite that said unsealing means has operated a predetermined period of time.

16. Equipment as claimed in claim 9, further comprising a collecting section inependent of said toner supply position for collecting said cartridge having supplied the toner to said toner supplying section.

17. Equipment as claimed in claim 9, further comprising empty cartridge transporting means for transporting said cartridge having supplied the toner from said toner supply position to said collecting section.

18. Equipment as claimed in claim 17, said collecting section being disposed on a path defined by said cartridge transporting means, said cartridge transporting means and said empty cartridge transporting means sharing part of members.

19. Equipment as claimed in claim 17, wherein said toner supply position is located on a path defined by said empty cartridge transporting means, said cartridge transporting means and said empty cartridge transporting means sharing part of members.

20. Equipment as claimed in claim 17 further comprising an openable door poositioned at an inlet to said cartridge inserting section.

21. Equipment as claimed in claim 20, further comprising door control means for holding said door in a closed position.

22. Equipment as claimed in claim 17, wherein said collecting section comprises collecting means capable of accommoadting a plurality of empty cartridges.

23. Equipment as claimed in claim 17, further comprising sensing means for determining whether or not said cartridge having been emptied has brought to a predetermined position by said empty toner transporting means.

24. Equipment as claimed in claim 23, further comprising alerting means responsive to an output of said sensing means for showing an occurrence that said cartridge having been emptied does not reach said predetermined position despite that said empty cartridge transporting means has operated a predetermined period of time.

25. Equipment as claimed in claim 23, further comprising control means responsive to an output of said sensing means for causing said empty cartridge transporting mean to repeat an operative state and an inoperative state alternately a predetermined number of times when said cartridge having been emptied does not reach said predetermined position despite that said empty cartridge transporting means has operated a predetermined period of time.

26. Equipment as claimed in claim 23, further comprising control means responsive to an output of said sensing means for inhibiting said empty cartridge transporting means from operating when said cartridge having been emptied does not reach said predetermined position despite that said empty cartridge transporting means has operated a predetermined period of time.

27. Equipment as claimed in claim 17, further comprising collection sensing means for monitoring a condition in which toner said cartridge having been emptied is collected in said collecting section.

28. Equipment as claimed in claim 27, further comprising alerting means responsive to an output of said collection sensing means for showing an occurrence that said cartridge having been emptied does not reach a predetermined collection condition despite that said empty cartridge transporting means has operated a predetermined period of time.

29. Equipment as claimed in claim 27, further comprising control means responsive to an output of said collection sensing means for causing said empty toner transporting means to repeat an operative state and an inoperative state alternately a predetermined number of times when said cartridge having been emptied does not reach a predetermined collection condition despite that said empty cartridge transporting means has operated a predetermined period of time.

30. Equipment as claimed in claim 27, further comprising control means responsive to an output of said collection sensing means for inhibiting said empty cartridge sensing means from operating when said cartridge haing been emptied does not reach a predetermined collection condition despite that said empty toner transporting means has operated a predetermined period of time.

31. Equipment as claimed in claim 17, further comprising an opening formed in said collecting section for receiving said cartridge having been emptied.

32. Equipment as claimed in claim 31, further comprising closing means for closing said opening.

33. Equipment as claimed in claim 17, further comprising air stream generating means disposed on a path defined by said empty cartridge transporting means for generating a stream of air in a direction different from an intended direction of transport of said cartridge having been emptied.

34. Image forming equipment of the type supplying a toner to the developing device thereof by using a cartridge which contains said toner therein and has an openable wall portion, said equipment comprising:

a cartridge inserting section for inserting said cartridge into said equipment;

a toner supply section independent of said cartridge inserting section and having a toner supply position where said cartridge supplies the toner;

opening means for opening said openable wall portion;

cartridge transporting means for transporting said cartridge having been inserted via said cartridge inserting section to said toner supply position, said opening means opening said openable wall portion of said cartridge at said toner supply position, whereby the toner is supplied to said toner supply section; and air stream generating means for generating a stream of air on a path along which said transporting means transports said cartridge in a direction different from an intended direction of the cartridge transport.

35. Image forming equipment of the type supplying a toner to the developing device thereof by using a cartridge which contains said toner therein and has an openable wall portion, said equipment comprising:

a cartridge inserting section for inserting said cartridge into said equipment;

a toner supply section independent of said cartridge inserting section and having a toner supply position where said cartridge supplies the toner;

opening means for opening said openable wall portion;

cartridge transporting means for transporting said cartridge having been inserted via said cartridge inserting section to said toner supply position, said opening means opening said openable wall portion of said cartridge at said toner supply position, whereby the toner is supplied to said toner supply section; and pressing means for pressing said cartridge located at said toner supply position such that said cartridge covers an opening formed in said toner supply section.

36. Equipment as claimed in claim 7, further comprising door control means for actuating said door to said closed position when a power source of said equipment if turned off.

* * * * *